US010538254B2

(12) United States Patent
Grip et al.

(10) Patent No.: US 10,538,254 B2
(45) Date of Patent: Jan. 21, 2020

(54) VACUUM TRANSPORT TUBE VEHICLE, SYSTEM, AND METHOD FOR EVACUATING A VACUUM TRANSPORT TUBE

(71) Applicant: The Boeing Company, Chicago, IL (US)

(72) Inventors: Robert Erik Grip, Rancho Palos Verdes, CA (US); Mark A. DeHaan, Rancho Palos Verdes, CA (US); John C. Vassberg, Long Beach, CA (US); Ted K. Rothaupt, Lancaster, CA (US)

(73) Assignee: The Boeing Company, Chicago, IL (US)

( * ) Notice: Subject to any disclaimer, the term of this patent is extended or adjusted under 35 U.S.C. 154(b) by 322 days.

(21) Appl. No.: 15/476,399

(22) Filed: Mar. 31, 2017

(65) Prior Publication Data

US 2018/0281820 A1 Oct. 4, 2018

(51) Int. Cl.
*B61B 13/10* (2006.01)
*B61B 13/12* (2006.01)
*B61B 13/08* (2006.01)

(52) U.S. Cl.
CPC ..... *B61B 13/122* (2013.01); *B61B 13/08* (2013.01); *B61B 13/10* (2013.01)

(58) Field of Classification Search
CPC ..... B61B 13/08; B61B 13/10; B61B 13/122; B61B 13/12; B60L 13/04; B60L 13/10;
(Continued)

(56) References Cited

U.S. PATENT DOCUMENTS 3,565,011 A * 2/1971 Edwards ..... B61B 13/122 104/138.1
5,653,175 A * 8/1997 Milligan ..... B60L 13/04 104/138.1

(Continued)

FOREIGN PATENT DOCUMENTS

CN 105292135 * 2/2016

OTHER PUBLICATIONS

Wikipedia Article on Hyperloop, 13 web pages, from website web address at https://en.wikipedia.org/wiki/Hyperloop, as of Mar. 31, 2017.

(Continued)

*Primary Examiner* — Mark T Le

(57) ABSTRACT

A vacuum transport tube vehicle, system, and method for evacuating a vacuum transport tube are provided. The vehicle has a first end having a first end outer surface. An annular gap is formed between the first end outer surface and an inner surface of the vacuum transport tube. The vehicle has a second end having a second end outer diameter, and a body in the form of a piston with a structural framework. The vehicle has an orifice extending from a first inlet portion in the first end to a second outlet portion of the vehicle. The vehicle has a drive assembly coupled to the body, and a power system. The vehicle evacuates the vacuum transport tube by reducing pressure within the tube with each successive vehicle pass through the tube, until a desired pressure is obtained and a vacuum is created in the interior of the tube.

25 Claims, 23 Drawing Sheets

(58) Field of Classification Search
CPC ..... B60L 15/005; B61C 11/06; B65G 51/04; B65G 51/08; B65G 54/025; B61D 17/02
See application file for complete search history.

(56) References Cited

U.S. PATENT DOCUMENTS

| | | | | |
|---|---|---|---|---|
| 5,950,543 | A * | 9/1999 | Oster | B61B 13/10 104/130.05 |
| 6,418,857 | B1 * | 7/2002 | Okano | B60L 13/04 104/281 |
| 2011/0283914 | A1 * | 11/2011 | Kwon | B61B 13/08 104/138.1 |
| 2013/0276665 | A1 * | 10/2013 | Dalrymple | B61B 13/10 104/23.1 |
| 2014/0261054 | A1 * | 9/2014 | Oster | E01B 25/34 104/130.02 |

OTHER PUBLICATIONS

Wikipedia Article on Maglev, 27 web pages, from website web address at https://en.wikipedia.org/wiki/Maglev, as of Mar. 31, 2017.

* cited by examiner

VACUUM TRANSPORT TUBE VEHICLE, SYSTEM, AND METHOD FOR EVACUATING A VACUUM TRANSPORT TUBE

BACKGROUND

1) Field of the Disclosure

The disclosure relates generally to systems and methods for evacuating tubes to create a vacuum, and more particularly, to systems and methods for evacuating air from tubes used for high-speed vacuum tube transportation systems.

2) Description of Related Art

The concept of high-speed travel through tubes has been known for years. Recently, there has been a renewed and increased interest in and investigation of high-speed vacuum or pneumatic tube transportation systems, in which a vehicle travels through an evacuated tube or near evacuated tube near the surface of the earth at high speeds, e.g., 200-2000 miles per hour (mph) average speed. The high speeds may be enabled by a magnetic levitation ("mag-lev") propulsion system that eliminates or greatly reduces rolling friction, and by evacuating the tube of air so that aerodynamic drag is eliminated or greatly reduced.

However, evacuating the tube and creating and maintaining a vacuum, or near vacuum, in the tube may be difficult, in particular, if the tube route is several hundred miles long, or more. The initial evacuation of the tube may entail a significant investment of vacuum pump equipment and energy to achieve and maintain a vacuum in the tube. The amount of vacuum pump equipment needed, such as hundreds of vacuum pumps, to evacuate the tube of air depends upon the tube volume to be evacuated, the degree of vacuum to be achieved, and the time allotted to evacuate the tube volume. Although the energy cost may be somewhat less than the vacuum pump equipment cost, as the energy may not vary with the evacuation time because the total amount of energy required to evacuate the tube may remain the same, the energy cost to achieve and maintain the vacuum may still be high.

Known systems of evacuating a tube for high-speed vacuum transportation systems have been proposed. One such known system installs and uses commercially available vacuum pumps in the interior of a vacuum tube vehicle used to evacuate the tube. This allows the vacuum pump equipment, attached to the vacuum tube vehicle, to be easily transferred from one tube route to another tube route. Although the cost of the vacuum pump equipment may be spread over multiple routes, the cost of the vacuum pump equipment is still high. In addition, the vacuum pump equipment may wear out over time and may need to be maintained, repaired, and/or eventually replaced. This may increase the costs of maintenance, repair, and replacement for such known system. Further, the vacuum pump equipment may be heavy and may increase the overall weight of the vacuum tube vehicle, which may, in turn, affect the speed at which the vacuum tube vehicle moves or travels through the tube. Moreover, such known systems also require pressure seals, such as modular pressure seals, to be used with the installed vacuum pump equipment. Such pressure seals may be costly to use and install, and may, in turn, increase the overall cost of manufacturing.

Thus, it is desirable to provide a system and method for evacuating a tube for high-speed vacuum transportation systems that do not require the use of expensive vacuum pump equipment and pressure seals. Moreover, it is desirable to provide a system and method for evacuating a tube for high-speed vacuum transportation systems that do not require close or tight tolerances of an interface between an inner surface of the tube and an exterior of a vacuum tube vehicle used to evacuate the tube. Such close tolerance requirements may increase the cost and complexity of manufacturing the vacuum tube vehicle used to evacuate the tube.

Accordingly, there is a need in the art for a vacuum transport tube vehicle, system, and method that effectively, efficiently, and inexpensively evacuates a vacuum transport tube, that do not require the use of expensive vacuum pump equipment and pressure seals, that do not require close tolerance manufacturing, and that provide other advantages over known systems and methods.

SUMMARY

Example implementations of this disclosure provide one or more embodiments of a vacuum transport tube vehicle, system, and method for evacuating a vacuum transport tube. As discussed in the below detailed description, embodiments of the vacuum transport tube vehicle, system, and method may provide significant advantages over existing systems and methods.

In one exemplary embodiment, there is provided a vacuum transport tube vehicle for evacuating a vacuum transport tube. The vacuum transport tube vehicle comprises a first end comprising a piston head. The first end has a first end outer diameter and a first end outer surface, wherein an annular gap is formed between the first end outer surface and an inner surface of the vacuum transport tube, when the vacuum transport tube vehicle is installed in an interior of the vacuum transport tube.

The vacuum transport tube vehicle further comprises a second end having a second end outer diameter. The vacuum transport tube vehicle further comprises a body disposed between the first end and the second end. The body comprises a piston having a structural framework.

The vacuum transport tube vehicle further comprises at least one orifice extending from a first inlet portion in the first end through to a second outlet portion of the vacuum transport tube vehicle. The second outlet portion is positioned aft of the first inlet portion. When the vacuum transport tube vehicle moves through the interior of the vacuum transport tube, air flows through the at least one orifice and the annular gap, and a delta pressure is created between a forward pressure in front of the vacuum transport tube vehicle and an aft pressure behind the vacuum transport tube vehicle, such that the aft pressure is lower than the forward pressure.

The vacuum transport tube vehicle further comprises a drive assembly coupled to the body for driving the vacuum transport tube vehicle through the vacuum transport tube. The vacuum transport tube vehicle further comprises a power system coupled to the drive assembly for powering the drive assembly.

The vacuum transport tube vehicle evacuates the vacuum transport tube by reducing pressure in the interior of the vacuum transport tube with each successive vehicle pass through the vacuum transport tube, until a desired pressure is obtained and a vacuum is created in the interior of the vacuum transport tube.

In another exemplary embodiment, there is provided a vacuum transport tube vehicle system for evacuating a vacuum transport tube. The vacuum transport tube vehicle system comprises a vacuum transport tube having an inner surface, an outer surface, and an interior.

The vacuum transport tube vehicle system further comprises one or more vacuum transport tube vehicles configured for moving through the interior of the vacuum transport tube and evacuating air from the interior of the vacuum transport tube over a route length of a vacuum transport tube route. Each of the one or more vacuum transport tube vehicles comprises a first end comprising a piston head. The first end has a first end outer diameter and a first end outer surface. When each vacuum transport tube vehicle is installed in the vacuum transport tube, an annular gap is formed between the inner surface of the vacuum transport tube and the first end outer surface.

The vacuum transport tube vehicle further comprises a second end having a second end outer diameter. The vacuum transport tube vehicle further comprises a body disposed between the first end and the second end. The body comprises a piston having a structural framework.

The vacuum transport tube vehicle further comprises at least one orifice extending from a first inlet portion in the first end through to a second outlet portion of the vacuum transport tube vehicle. The second outlet portion is positioned aft of the first inlet portion. The at least one orifice is configured to allow air to flow from a forward space in front of the vacuum transport tube vehicle to an aft space behind the vacuum transport tube vehicle, to create a delta pressure between a forward pressure in the forward space and an aft pressure in the aft space, such that the aft pressure is lower than the forward pressure.

The vacuum transport tube vehicle further comprises a drive assembly coupled to the body for driving the vacuum transport tube vehicle through the vacuum transport tube. The vacuum transport tube vehicle further comprises a power system coupled to the drive assembly for powering the drive assembly.

The one or more vacuum transport tube vehicles evacuate the vacuum transport tube by reducing pressure in the interior of the vacuum transport tube with each successive vehicle pass through the vacuum transport tube, until a desired pressure is obtained and a vacuum is created in the interior of the vacuum transport tube.

The vacuum transport tube vehicle system further comprises one or more pressure barriers positioned in the interior of the vacuum transport tube aft of the one or more vacuum transport tube vehicles.

In another exemplary embodiment, there is provided a method for evacuating a vacuum transport tube. The method comprises the step of installing one or more vacuum transport tube vehicles in an interior of the vacuum transport tube. The vacuum transport tube has an inner surface and an outer surface.

Each of the vacuum transport tube vehicles comprises a first end comprising a piston head. The first end has a first end outer diameter and a first end outer surface, wherein an annular gap is formed between the first end outer surface and the inner surface of the vacuum transport tube. Each of the vacuum transport tube vehicles further comprises a second end having a second end outer diameter. Each of the vacuum transport tube vehicles further comprises a body disposed between the first end and the second end. The body comprises a piston having a structural framework. Each of the vacuum transport tube vehicles further comprises at least one orifice extending from a first inlet portion in the first end through to a second outlet portion of the vacuum transport tube vehicle. The second outlet portion is positioned aft of the first inlet portion.

Each of the vacuum transport tube vehicles further comprises a drive assembly coupled to the body for driving the vacuum transport tube vehicle through the vacuum transport tube. Each of the vacuum transport tube vehicles further comprises a power system coupled to the drive assembly for powering the drive assembly.

The method further comprises the step of installing one or more pressure barriers in the interior of the vacuum transport tube aft of the one or more vacuum transport tube vehicles. The method further comprises the step of moving each vacuum transport tube vehicle through the interior of the vacuum transport tube, and making one or more vehicle passes with each vacuum transport tube vehicle over a route length of a vacuum transport tube route.

The method further comprises the step of flowing air, through the at least one orifice and through the annular gap of each vacuum transport tube vehicle, from a forward space in front of each vacuum transport tube vehicle, to an aft space behind each vacuum transport tube vehicle, to create a delta pressure between a forward pressure in the forward space and an aft pressure in the aft space, such that the aft pressure is lower than the forward pressure.

The method further comprises the step of evacuating air from the vacuum transport tube, and reducing pressure in the interior of the vacuum transport tube with each successive vehicle pass, until a desired pressure is obtained and a vacuum is created in the interior of the vacuum transport tube.

The features, functions, and advantages that have been discussed can be achieved independently in various embodiments of the disclosure or may be combined in yet other embodiments further details of which can be seen with reference to the following description and drawings.

BRIEF DESCRIPTION OF THE DRAWINGS

The disclosure can be better understood with reference to the following detailed description taken in conjunction with the accompanying drawings which illustrate preferred and exemplary embodiments, but which are not necessarily drawn to scale, wherein.

The figures shown in this disclosure represent various aspects of the embodiments presented, and only differences will be discussed in detail.

DETAILED DESCRIPTION

Disclosed embodiments will now be described more fully hereinafter with reference to the accompanying drawings, in which some, but not all of the disclosed embodiments are shown. Indeed, several different embodiments may be provided and should not be construed as limited to the embodiments set forth herein. Rather, these embodiments are provided so that this disclosure will be thorough and fully convey the scope of the disclosure to those skilled in the art.

The disclosure, as discussed in detail below, includes embodiments of a vacuum transport tube vehicle system 10 (see FIGS. 2A, 2B, 16) for evacuating a vacuum transport tube 16 (see FIGS. 2A, 2B, 16), a vacuum transport tube vehicle 12 (see FIGS. 2A, 2B) for evacuating a vacuum transport tube 16 (see FIGS. 2A, 2B, 16), and a method 200 (see FIG. 17) for evacuating a vacuum transport tube 16 (see FIGS. 2A, 2B, 16).

Figure 1A:
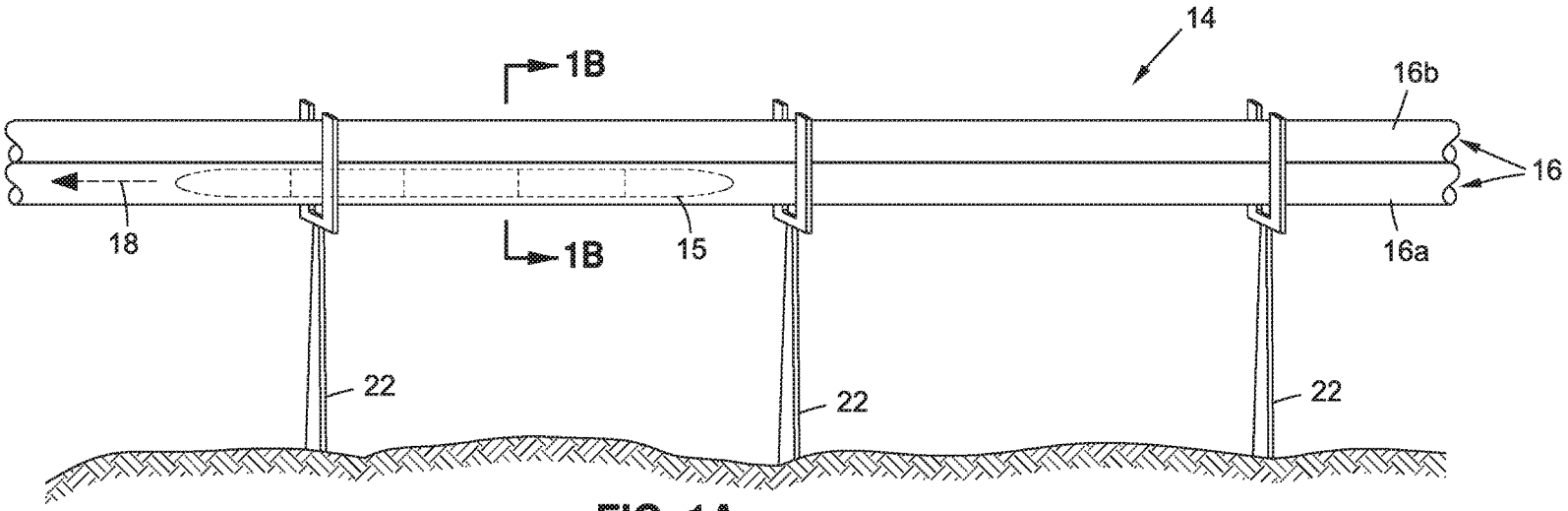
FIG. 1A (Prior Art)
FIG. 1A is an illustration of a side perspective view of a prior proposed high-speed vacuum tube transportation system having vacuum transport tubes that may be used with one or more embodiments of the vacuum transport tube vehicle system, vacuum transport tube vehicle, and method of the disclosure.

Now referring to the Figures, FIG. 1A is an illustration of a side perspective view of a prior proposed high-speed vacuum tube transportation system 14, e.g., 500-750 mph (miles per hour) average speed, with a high-speed vacuum tube transportation train 15 moving or traveling through a vacuum transport tube 16, such as a first vacuum transport tube 16*a*, in a direction of travel 18. However, other higher or lower speeds may also be used, for example, 200-2000 mph. As shown in FIG. 1A, the high-speed vacuum tube transportation system 14 may include the first vacuum transport tube 16*a* and a second vacuum transport tube 16*b*, one or both of which may be used with one or more embodiments of the vacuum transport tube vehicle 12 and the vacuum transport tube vehicle system 10 of the disclosure. As further shown in FIG. 1A, the vacuum transport tubes 16 are elevated above a ground surface 20 via a plurality of column support structures 22. However, the vacuum transport tubes 16 may also be installed underneath the ground surface 20.

Figure 1B:
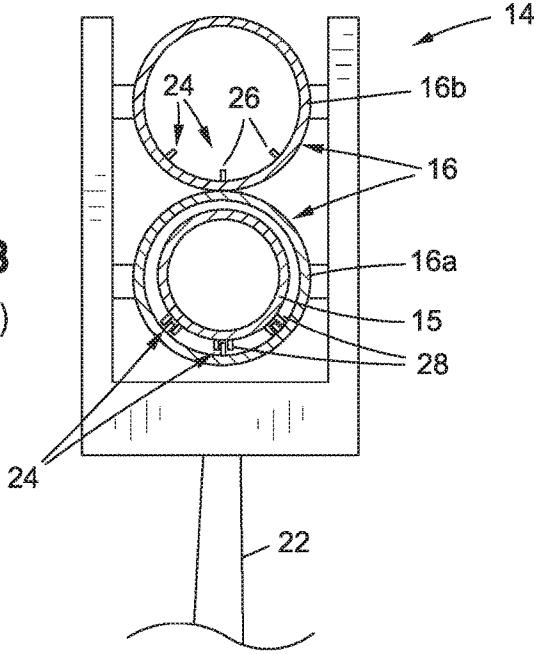
FIG. 1B (Prior Art)
FIG. 1B is an illustration of a cross-sectional view of the prior proposed high-speed vacuum tube transportation system taken along lines 1B-1B of FIG. 1A.

FIG. 1B is an illustration of a cross-sectional view of the prior proposed high-speed vacuum tube transportation system 14 taken along lines 1B-1B of FIG. 1A. FIG. 1B shows the high-speed vacuum tube transportation train 15 within the first vacuum transport tube 16*a*. The first vacuum transport tube 16*a* (see FIG. 1B) is positioned below the second vacuum transport tube 16*b* (see FIG. 1B), and the column support structure 22 (see FIG. 1B) supports the vacuum transport tubes 16 (see FIG. 1B). As further shown in FIG. 1B, the high speeds of the high-speed vacuum tube transportation train 15 may be enabled by a magnetic levitation (mag-lev) propulsion system 24, which is substantially frictionless and eliminates or greatly reduces rolling friction. The mag-lev propulsion system 24 (see FIG. 1B) may include a plurality of guide magnets 26 (see FIG. 1B) and a plurality of vehicle magnets 28 (see FIG. 1B) to create both lift and substantially frictionless propulsion to move the of high-speed vacuum tube transportation train 15 (see FIG.

1B) along a guideway through the vacuum transport tube 16 (see FIG. 1B) at very high speeds.

Figure 2A:
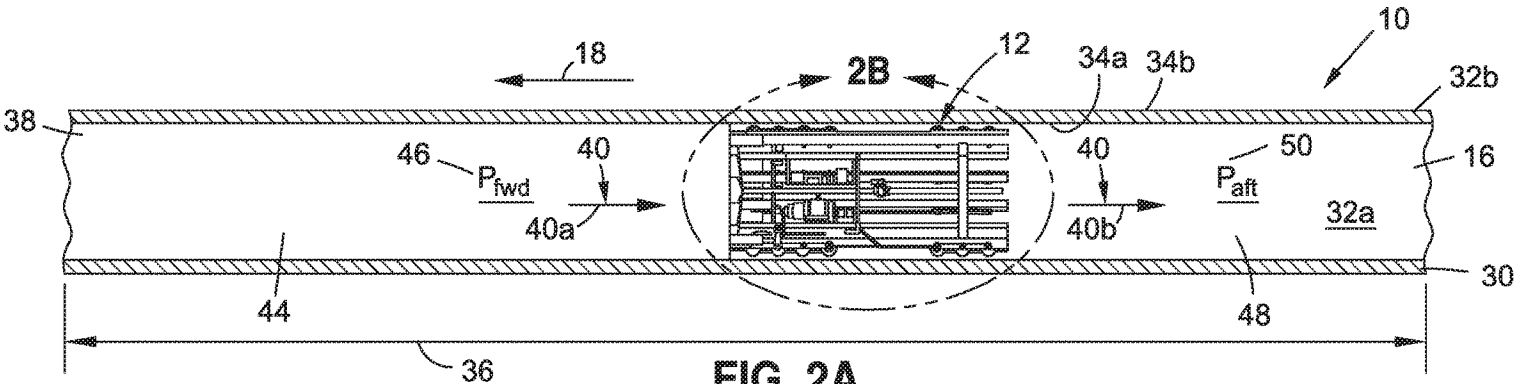
FIG. 2A is an illustration of a sectional side view of an embodiment of a vacuum transport tube vehicle system and a vacuum transport tube vehicle of the disclosure.

Now referring to FIGS. 2A-2F, a vacuum transport tube vehicle 12 is provided for use in the vacuum transport tube vehicle system 10, for evacuating a vacuum transport tube 16. FIG. 2A is an illustration of a sectional side view of an embodiment of the vacuum transport tube vehicle system 10 comprising a vacuum transport tube 16 and a vacuum transport tube vehicle 12 of the disclosure. In one embodiment, as shown in FIG. 2A, the vacuum transport tube vehicle system 10 comprises one vacuum transport tube vehicle 12 for evacuating the vacuum transport tube 16. However, as discussed below, the vacuum transport tube vehicle system 10 (see FIGS. 2A, 3A, 16) may include more than one vacuum transport tube vehicle 12 and preferably includes multiple vacuum transport tube vehicles 12.

As shown in FIG. 2A, vacuum transport tube 16 comprises a cylindrical body 30 having an interior 32*a* that is configured to be evacuated of air 40, or other fluids, and having an exterior 32*b*. As further shown in FIG. 2A, the cylindrical body 30 of the vacuum transport tube 16 has an inner surface 34*a* and an outer surface 34*b*. The vacuum transport tube 16 (see FIG. 2A) is preferably continuous and made of steel, concrete, or another strong and durable material. The vacuum transport tube vehicle 12 is shown in FIG. 2A moving or traveling in a forward direction of travel 18*a* through the interior 32*a* of the vacuum transport tube 16, along a route length 36 of a vacuum transport tube route 38 of the vacuum transport tube 16.

As the vacuum transport tube vehicle 12 (see FIG. 2A) moves or travels through the vacuum transport tube 16 (see FIG. 2A), the vacuum transport tube vehicle 12 evacuates the vacuum transport tube 16 (see FIG. 2A), for example, evacuates air 40 (see FIG. 2A), from the vacuum transport tube 16 (see FIG. 2A), to create and maintain a vacuum 42 (see FIG. 16) within the vacuum transport tube 16 over the route length 36 (see FIG. 2A) of the vacuum transport tube route 38 (see FIG. 2A). Preferably, the vacuum transport tube vehicle 12 (see FIGS. 2A, 2B, 16) and the vacuum transport tube vehicle system 10 (see FIGS. 2A, 2B, 16) achieve an evacuation 41 (see FIG. 16), such as an initial evacuation 41*a* (see FIG. 16), of the vacuum transport tube 16 (see FIGS. 2A, 16), such as before use by high-speed vehicles, such as high-speed vacuum tube transportation trains 15 (see FIG. 1A), or other prior proposed or known high-speed vehicles.

FIG. 2A shows a forward space 44 having a forward pressure ($P_{fwd}$) 46 in front of the vacuum transport tube vehicle 12, and shows an aft space 48 having an aft pressure ($P_{aft}$) 50 in back of, or behind, the vacuum transport tube vehicle 12. The vacuum transport tube vehicle 12 (see FIGS. 2A, 2B) functions like a piston inside the vacuum transport tube 16 (see FIG. 2A) and enables the economic and quick evacuation 41 (see FIG. 16), such as an initial evacuation 41*a* (see FIG. 16), of air 40 (see FIGS. 2A, 16), or other fluids, from inside the vacuum transport tube 16 (see FIG. 2A), over the route length 36 (see FIG. 2A) of the vacuum transport tube route 38 (see FIG. 2A).

As the vacuum transport tube vehicle 12 (see FIG. 2A) is propelled in the forward direction of travel 18*a* (see FIG. 2A), it pushes the air 40 (see FIG. 2A), such as upstream air 40*a* (see FIG. 2A), that is in the forward space 42 (see FIG. 2A) in front of the vacuum transport tube vehicle 12 (see FIG. 2A) out of the way, and allows a small amount of the air 40, such as the upstream air 40*a*, to flow from the forward space 44 in front of the vacuum transport tube vehicle 12, past and/or through the vacuum transport tube vehicle 12, and into the aft space 48 (see FIG. 2A) behind the vacuum transport tube vehicle 12, becoming downstream air 40*b* (see FIG. 2A), behind or in back of the vacuum transport tube vehicle 12.

A lower aft pressure ($P_{aft}$) 50 (see FIG. 2A) aft of the vacuum transport tube vehicle 12 (see FIG. 2A) results because the air 40 (see FIG. 2A), such as the downstream air 40*b* (see FIG. 2A), behind the vacuum transport tube vehicle 12 is not allowed to flow into the forward space 44 (see FIG. 2A) that has been enlarged by the movement of the vacuum transport tube vehicle 12 in the forward direction of travel 18*a* (see FIG. 2A). Thus, the aft pressure ($P_{aft}$) 50 (see FIG. 2A) in the aft space 48 (see FIG. 2A) behind the vacuum transport tube vehicle 12 (see FIG. 2A) is reduced and lower than the forward pressure ($P_{fwd}$) 46 (see FIG. 2A) in the forward space 44 (see FIG. 2A) in front of the vacuum transport tube vehicle 12, as the vacuum transport tube vehicle 12 moves. A delta pressure 52 (FIGS. 11A-11B, 16), or pressure differential, is thus created between the forward pressure ($P_{fwd}$) 46 (see FIG. 2A) in the forward space 44 (see FIG. 2A) and the aft pressure ($P_{aft}$) 50 (see FIG. 2A) in the aft space 48 (see FIG. 2A), such that the aft pressure ($P_{aft}$) 50 is lower than the forward pressure ($P_{fwd}$) 46, and the forward pressure ($P_{fwd}$) 46 is higher than the aft pressure ($P_{aft}$) 50, as the vacuum transport tube vehicle 12 moves. As further discussed in detail below, the pressure 43 (see FIG. 16) in the interior 32*a* (see FIG. 2A) of the vacuum transport tube 16 (see FIG. 2A) becomes further reduced with each successive vehicle pass 53 (see FIG. 16) of the one or more vacuum transport tube vehicles 12 (see FIG. 2A) through the vacuum transport tube 16.

Figure 2B:
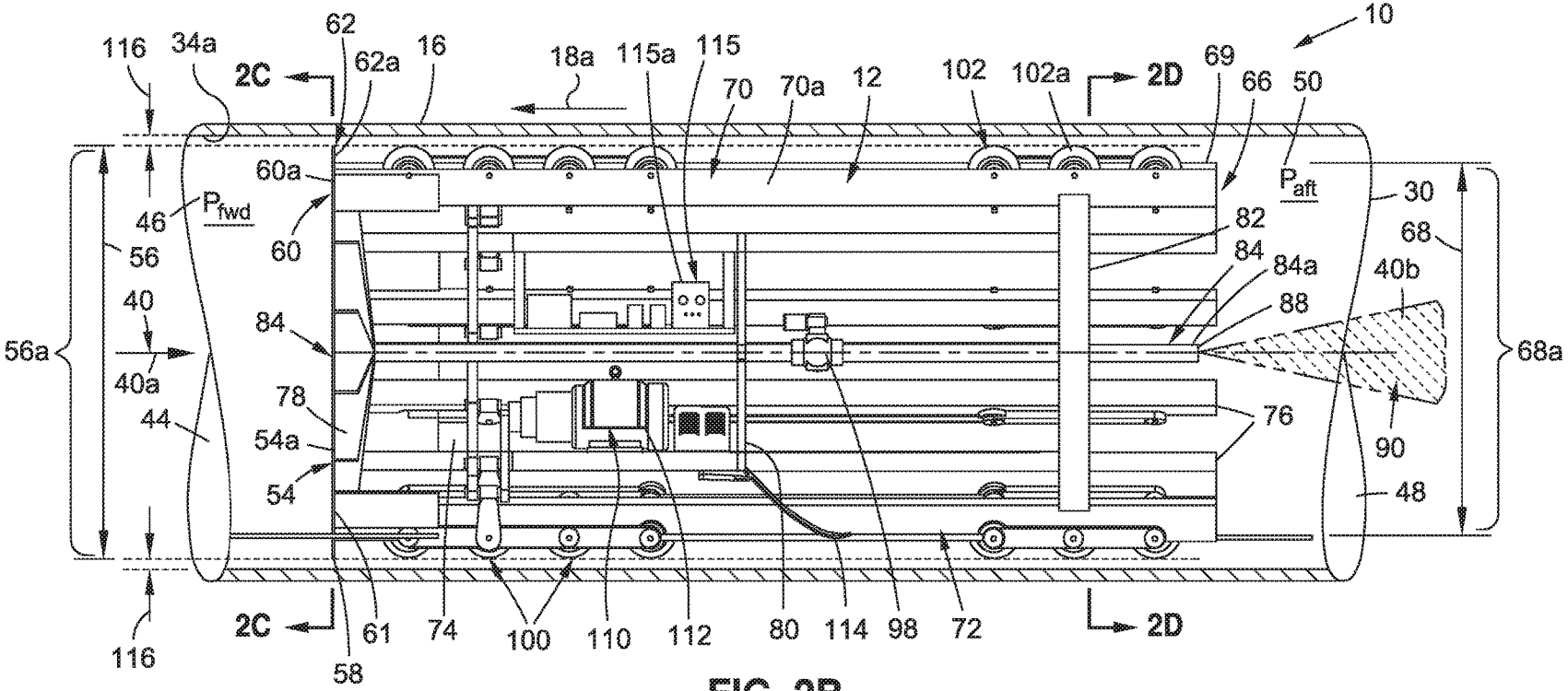
FIG. 2B is an illustration of an enlarged sectional side view of the circle 2B portion of the vacuum transport tube vehicle of FIG. 2A.
Figure 2C:
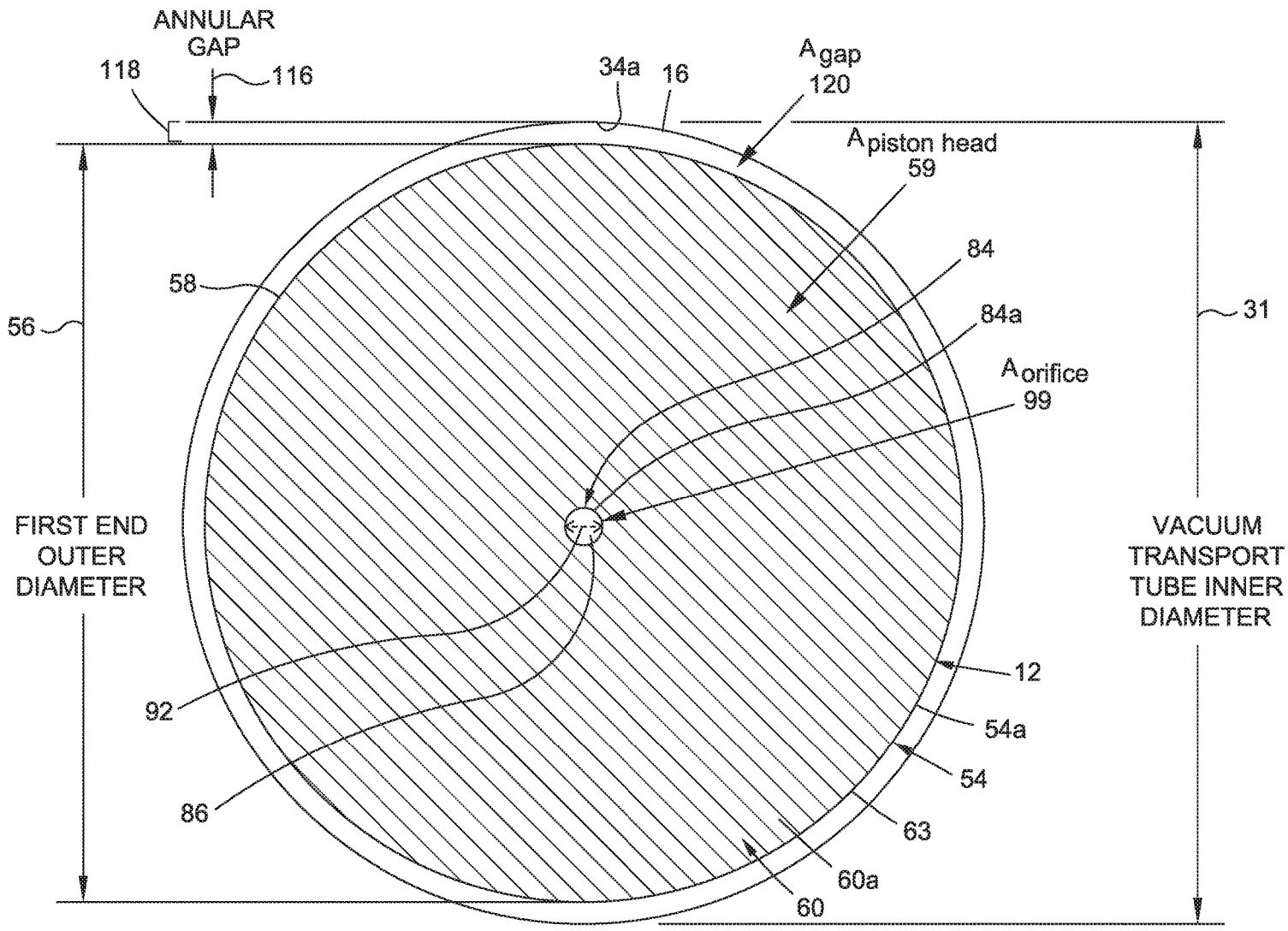
FIG. 2C is an illustration of a cross-sectional view of the vacuum transport tube vehicle taken along lines 2C-2C of FIG. 2B.
Figure 2D:
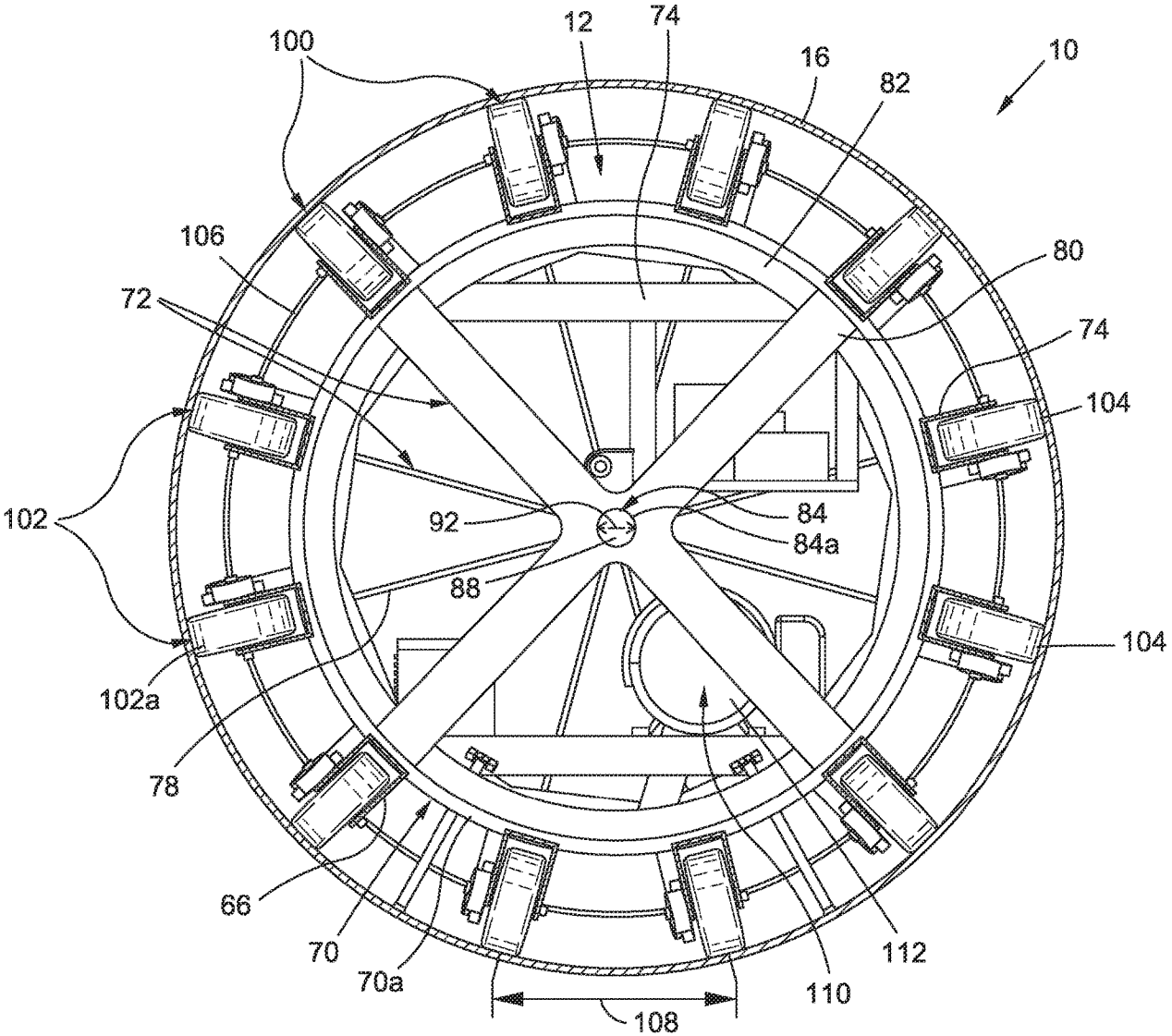
FIG. 2D is an illustration of a cross-sectional view of the vacuum transport tube vehicle taken along lines 2D-2D of FIG. 2B.
Figure 2E:
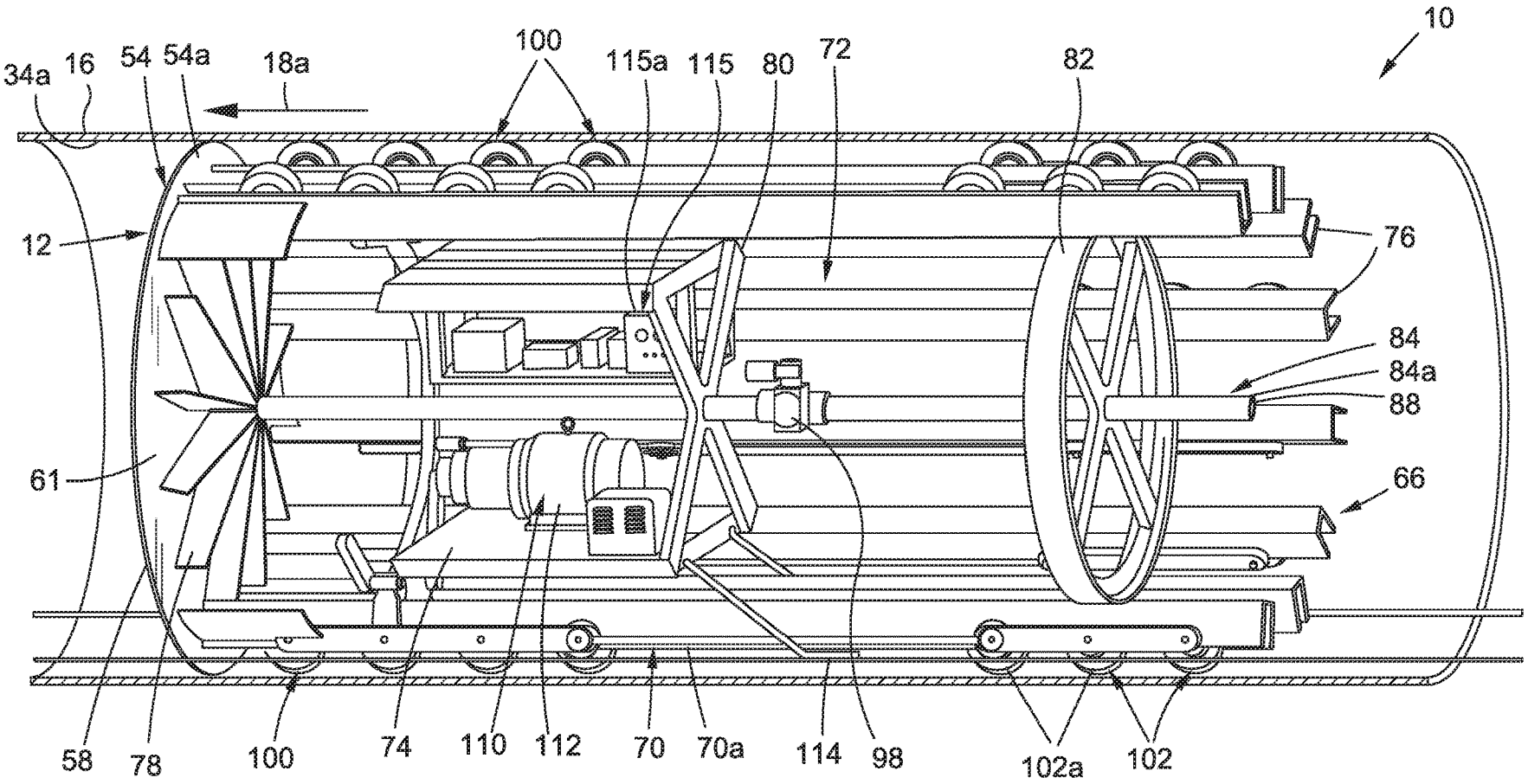
FIG. 2E is an illustration of a back side isometric view of the vacuum transport tube vehicle of FIG. 2B.
Figure 2F:
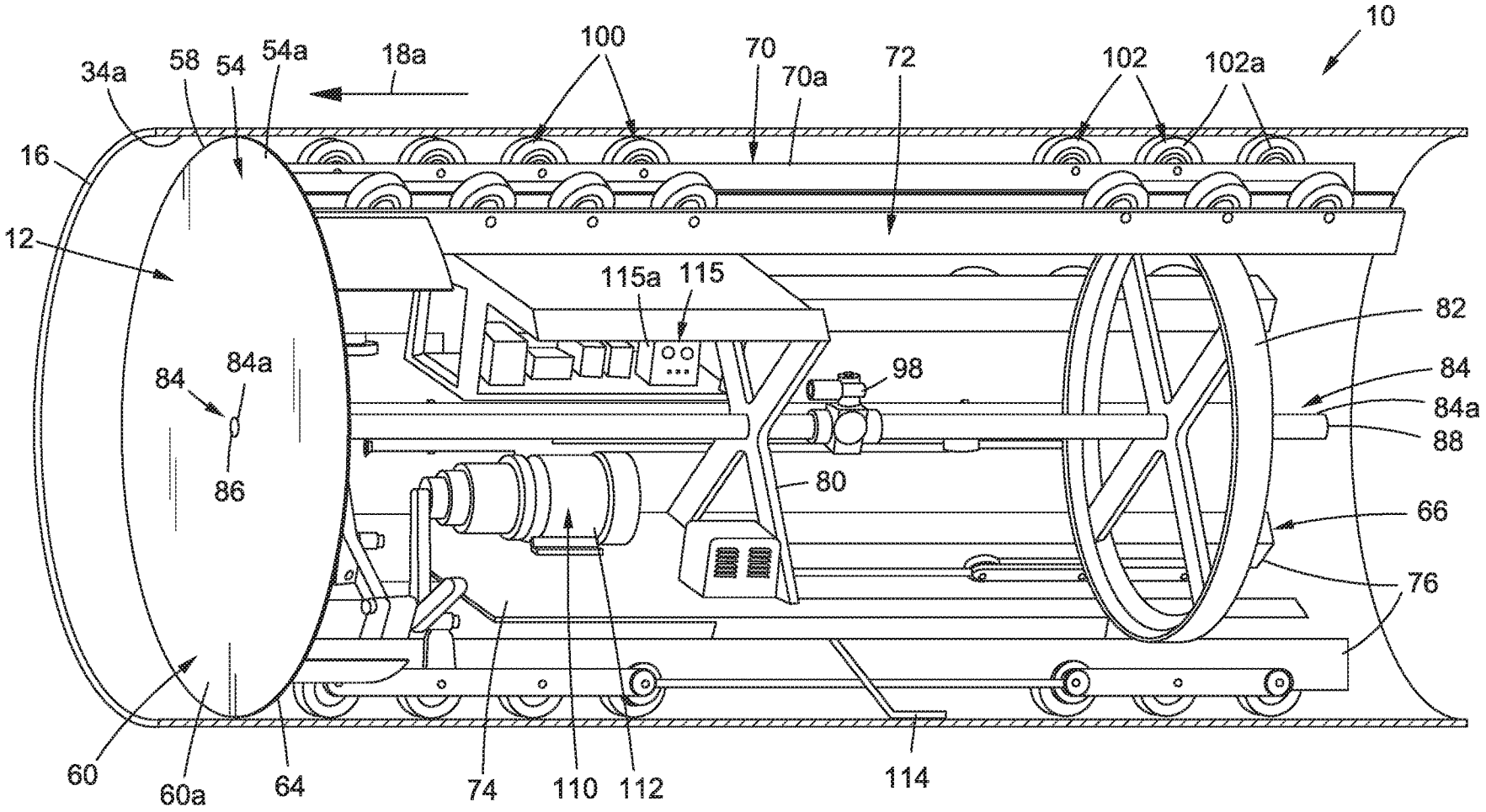
FIG. 2F is an illustration of a front side isometric view of the vacuum transport tube vehicle of FIG. 2B.

FIG. 2B is an illustration of an enlarged sectional side view of the circle 2B portion of the vacuum transport tube vehicle 12 of FIG. 2A in the interior 32*a* of the vacuum transport tube 16. FIG. 2C is an illustration of a cross-sectional view of the vacuum transport tube vehicle 12, taken along lines 2C-2C of FIG. 2B. FIG. 2D is an illustration of a cross-sectional view of the vacuum transport tube vehicle 12, taken along lines 2D-2D of FIG. 2B. FIG. 2E is an illustration of a back side isometric view of the vacuum transport tube vehicle 12 of FIG. 2B. FIG. 2F is an illustration of a front side isometric view of the vacuum transport tube vehicle 12 of FIG. 2B.

As shown in FIGS. 2B, 2C, 2E, 2F, the vacuum transport tube vehicle 12 has a first end 54. FIG. 2B shows the first end 54 facing the forward space 44 having the forward pressure ($P_{fwd}$) 46. The first end 54 (see FIGS. 2B, 2C, 2E, 2F) preferably comprises, and is preferably in the form of, a piston head 54*a* (see FIGS. 2B, 2C, 2E, 2F). The first end 54 (see FIG. 2B, 2C), such as in the form of piston head 54*a* (see FIGS. 2B, 2C), has a first end outer diameter 56 (see FIGS. 2B, 2C) and a first end outer surface 58 (see FIGS. 2B, 2E, 2F), such as an exterior side outer surface. As shown in FIG. 2C, the piston head 54*a* has a piston head area ($A_{piston\ head}$) 59 representing the area of the piston head 54*a*.

The first end 54 (see FIG. 2B), such as in the form of piston head 54*a* (see FIG. 2B), has a forward surface 60 (see FIGS. 2B, 2F) and an aft surface 61 (see FIGS. 2B, 2E). The forward surface 60 (see FIG. 2B) has a side profile 62 (see FIG. 2B). The forward surface 60 (see FIG. 2B) may comprise a flat forward surface 60*a* (see FIGS. 2B, 2F, 16) with a flat side profile 62*a* (see FIGS. 2B, 16); a curved forward surface 60*b* (see FIG. 16) with a curved side profile 62*b* (see FIG. 16), such as including, a convex forward surface 60*c* (see FIG. 16) with a convex side profile 62*c* (see FIG. 16), or a concave forward surface 60*d* (see FIG. 16) with a concave side profile 62*d* (see FIG. 16); or the forward surface 60 may comprise another suitable forward surface with a suitable side profile. Preferably, the flat forward surface 60*a* (see FIG. 2F) is a circular shape 64 (see FIG. 2F). However, the forward surface 60 may comprise another suitable shape.

The first end outer diameter 56 (see FIGS. 2B, 2C) of the first end 54 may vary in length and preferably comprises a length 56*a* (see FIGS. 2B, 16) that extends in a range of about 0.25 inch to about 1.0 inch from the inner surface 34*a* (see FIGS. 2B, 2E, 2F) of the vacuum transport tube 16 (see FIGS. 2B, 2E, 2F), when the vacuum transport tube vehicle 12 moves or travels through the vacuum transport tube 16.

As shown in FIGS. 2B, 2D-2F, the vacuum transport tube vehicle 12 further comprises a second end 66. The second end 66 has a second end outer diameter 68 (see FIG. 2B) and a second end outer surface 69 (see FIG. 2B). A length 68*a* (see FIGS. 2B, 16) of the second end outer diameter 68 (see FIG. 2B) is preferably less than, or smaller than, the length 56*a* (see FIG. 2B) of the first end outer diameter 56 (see FIG. 2B).

As shown in FIGS. 2B, 2D-2F, the vacuum transport tube vehicle 12 further comprises a body 70 disposed between the first end 54 and the second end 66. The body 70 preferably comprises, and is preferably in the form of, a piston 70*a* (see FIGS. 2B, 2D-2F). The vacuum transport tube vehicle 12 (see FIG. 2A) functions like a piston inside the vacuum transport tube 16 (see FIG. 2A) and enables the economic and quick evacuation 41 (see FIG. 16) of the vacuum transport tube 16 over the route length 36 (see FIG. 2A) of the vacuum transport tube route 38 (see FIG. 2A). In turn, the vacuum transport tube 16 functions like a cylinder of a very large pump that is miles long, e.g., 400 miles long, or more.

As shown in FIGS. 2B, 2D-2F, preferably, the body 70, such as in the form of piston 70*a*, has a structural framework 72. In one embodiment, as shown in FIGS. 2B, 2D-2F, the structural framework 72 preferably comprises a plurality of stiffened panels 74, a plurality of longitudinal stiffener members 76, one or more brace members 78, one or more cross support members 80, and one or more circumferential frame members 82. However, the structural framework 72 may comprise other suitable structural parts. The structural framework 72 (see FIGS. 2B, 2D-2F) may be made of steel or another strong and sturdy material and provides stiffness and strength to withstand the delta pressure 52 (see FIGS. 11A-11B, 16), or pressure differential, formed between the upstream air 40*a* (see FIG. 2A) in front of the vacuum transport tube vehicle 12 (see FIG. 2A) and the downstream air 40*b* (see FIG. 2A) behind the vacuum transport tube vehicle 12.

As shown in FIGS. 2B-2F, the vacuum transport tube vehicle 12 further comprises at least one orifice 84. The at least one orifice 84 (see FIGS. 2B-2F) preferably comprises, and is preferably in the form of, a passageway 84*a* (see FIGS. 2B-2F), extending from a first inlet portion 86 (FIGS. 2B-2D, 2F) in the first end 54 through to a second outlet portion 88 (see FIGS. 2B, 2D-2F) of the vacuum transport tube vehicle 12. The second outlet portion 88 is positioned aft of the first inlet portion 86. In one embodiment as shown in FIGS. 2B, 2DE, 2F, the at least one orifice 84, such as in the form of passageway 84, extends from the first inlet portion 86 in the first end 54, through the body 70, and to the second outlet portion 88 formed at the second end 66 of the vacuum transport tube vehicle 12. As shown in FIG. 2B, the at least one orifice 84 is configured to allow air 40, such as upstream air 40*a*, to flow from the forward space 44 in front of the vacuum transport tube vehicle 12, through the body 70, to the aft space 48 behind the vacuum transport tube vehicle 12, as orifice exhaust 90, such as downstream air 40*b*. In other embodiments, the second outlet portion 88 may comprise outlets, slots, or other passageways formed along the body 70, or located at the side of the body 70, or located at another suitable location at the second end 66.

As shown in FIGS. 2C, 2D, the orifice 84 preferably has an orifice diameter 92. The orifice diameter 92 is preferably variable and may vary in size and may be configurable based on, or directly proportional to, a desired speed 94 (see FIG. 16) and a desired power 96 (see FIGS. 12A-12B) of the vacuum transport tube vehicle 12. As shown in FIG. 2C, the orifice 84 has an orifice area ($A_{orifice}$) 99 representing the area of the orifice 84.

The flow of air 40 (see FIG. 2B) through the orifice 84 (see FIGS. 2B, 2C), such as in the form of passageway 84*a* (see FIGS. 2B, 2C), may be regulated or controlled by one or more flow regulating valves 98 (see FIGS. 2B, 2E, 2F) coupled to the orifice 84, such as in the form of passageway 84*a*, to regulate or control the flow of air 40 (see FIG. 2B) through the orifice 84, such as in the form of passageway 84*a*, from the forward space 44 (see FIG. 2B) to the aft space 48 (see FIG. 2B). The flow of air 40 may also be regulated or controlled with other suitable flow altering or flow regulating devices known in the art. For example, a valve, a slot, or a variable area inlet may be used to control the mass flow of air 40 (see FIG. 2B) through the orifice 84 (see FIG. 2C). Other methods of controlling the amount of air flow through the orifice 84 (see FIG. 2B) may also be employed. The amount of air flow through the orifice 84 (see FIG. 2B) may be governed by the power required 96*c* (see FIGS. 12A-12B, 16) and/or the speed 94 (see FIG. 16) of the vacuum transport tube vehicle 12. Sensors that monitor the power 96 (see FIG. 16) used by an electric motor 112 (see FIG. 2B), or the speed 94 (see FIG. 16) of the vacuum transport tube vehicle 12, may be employed to provide this information to a drive assembly 100 (see FIGS. 2B, 16) and/or to a control system 115 (see FIGS. 2B, 2E, 2F, 16), with one or more controllers 115*a* (see FIGS. 2B, 2E, 16) used to control the vacuum transport tube vehicle 12, such as a remotely controlled control system with sensors, wireless controls, and other suitable components.

As shown in FIGS. 2B, 2D-2F, the vacuum transport tube vehicle 12 further comprises a drive assembly 100. The drive assembly 100 (see FIGS. 2B, 2D-2F) is coupled to the body 70 for driving the vacuum transport tube vehicle 12 through the vacuum transport tube 16. In one embodiment, the drive assembly 100 (see FIGS. 2B, 2D-2F) comprises a plurality of drive wheels 102 (see FIGS. 2B, 2D-2F) arranged in a circumferential arrangement 104 (see FIG. 2D) around the body 70, such as in the form of piston 70*a*. As shown in FIG. 2D, the drive wheels 102 are secured within and partially surrounded by the plurality of longitudinal stiffener members 76 and may be connected or joined together via connector elements 106, such as metal cables, or another suitable connector element.

The plurality of drive wheels 102 (see FIGS. 2B, 2D-2F) preferably comprise, and are preferably in the form of, a plurality of tires 102*a* (see FIGS. 2B, 2D-2F), such as durable rubber tires, or another suitable type of tire. The drive wheels 102 (see FIGS. 2B, 2D-2F), such as in the form of tires 102*a* (see FIGS. 2B, 2D-2F), may be spring loaded to provide some flexibility to account for variations in the radius of the interior 32*a* (see FIG. 2A) of the vacuum transport tube 16 (see FIG. 2A). This flexibility may also be beneficial to allow the vacuum transport tube vehicle 12 to negotiate curves along the vacuum transport tube route 38 (see FIG. 2A).

FIG. 2D shows twelve (12) rows of drive wheels 102, such as in the form of tires 102*a*, in the circumferential arrangement 104, and FIGS. 2B, 2E, 2F show seven (7) drive wheels 102 in a row of drive wheels 102, such as in the form of tires 102*a*, for a total number of eighty-four (84) drive wheels 102 in the drive assembly 100 of the vacuum transport tube vehicle 12 of FIGS. 2A-2F. However, the number of drive wheels 102 used may be more or less. The large number of drive wheels 102, such as in the form of tires 102*a*, minimizes or reduces the individual loading on each tire. Reduced loading on each drive wheel 102, such as in the form of tire 102*a*, may also result in reduced radial loading of each drive wheel 102, such as in the form of tire 102*a*, upon the vacuum transport tube 16, which, in turn, may reduce circumferential bending stresses in the vacuum transport tube 16.

The structural framework 72 (see FIGS. 2B, 2D-2F) connects the body 70 (see FIGS. 2B, 2D-2F), such as in the form of piston 70*a* (see FIGS. 2B, 2D-2F), to the drive assembly 100 (see FIGS. 2B, 2D-2F), such as in the form of drive wheels 102 (see FIGS. 2B, 2D-2F), which contact the inner surface 34*a* (see FIG. 2B) of the vacuum transport tube 16 (see FIG. 2B). One or more of the plurality of drive wheels 102 (see FIG. 2E) may contact the inner surface 34*a* (see FIG. 2E) of the vacuum transport tube 16 (see FIG. 2E), when the vacuum transport tube vehicle 12 travels through the vacuum transport tube 16.

Figure 16:
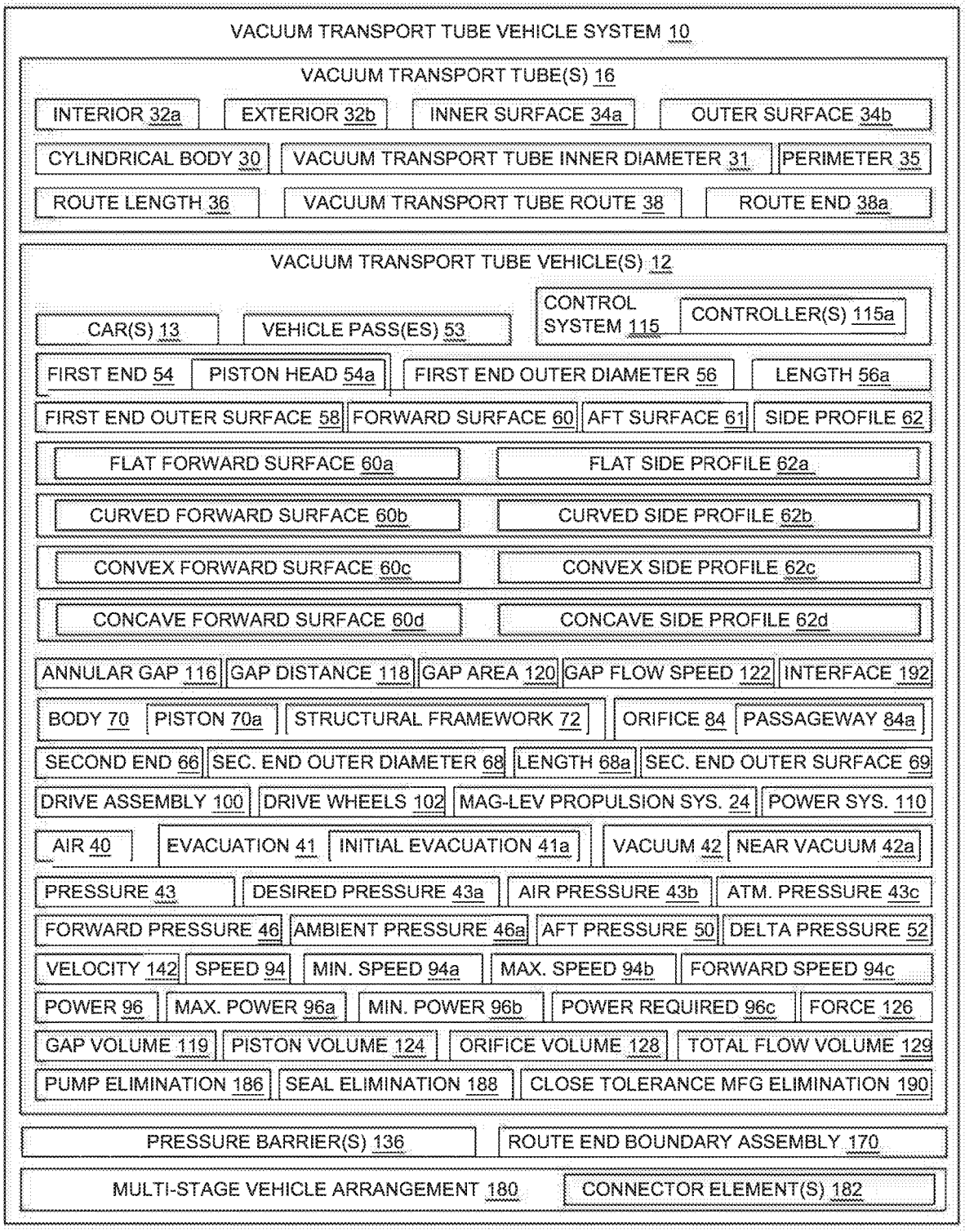
FIG. 16 is an illustration of a functional block diagram of an exemplary embodiment of a vacuum transport tube vehicle system of the disclosure.

Alternatively, in another embodiment, the drive assembly 100 (see FIG. 16) comprises a magnetic levitation (mag-lev) propulsion system 24 (see FIGS. 1B, 16). As discussed above, and as shown in FIG. 1B, the magnetic levitation (mag-lev) propulsion system 24 (see also FIG. 16) may comprise a plurality of guide magnets 26 and a plurality of vehicle magnets 28 to create both lift and substantially frictionless propulsion to move the vacuum transport tube vehicle 12 through the vacuum transport tube 16. As shown in FIG. 2D, the magnetic levitation (mag-lev) propulsion system 24 may be installed in an area 108 along the bottom of the vacuum transport tube vehicle 12, and the magnetic levitation (mag-lev) propulsion system 24 (see FIG. 16) may be used to drive or propel the vacuum transport tube vehicle 12, instead of the drive wheels 102.

As shown in FIGS. 2B, 2D-2F, the vacuum transport tube vehicle 12 further comprises a power system 110 coupled to the drive assembly 100 for powering the drive assembly 100. In one embodiment, as shown in FIGS. 2B, 2D-2D, the power system 110 preferably comprises one or more electric motors 112 coupled to one or more of the plurality of drive wheels 102. However, the power system 110 may also comprise another suitable motor or power source. As shown in FIGS. 2B, 2D-2F, one electric motor 112 supplies power to all of the plurality of drive wheels 102. Alternatively, in another embodiment, a single electric motor 112 may be located and used adjacent to each drive wheel 102.

As shown in FIGS. 2B, 2E, 2F, the vacuum transport tube vehicle 12 may further comprise electrical power pick-up elements 114 attached to the electric motor 112 of the power system 110. The electrical power pick-up elements 114 (see FIG. 2B) are separate from the magnetic levitation (mag-lev) propulsion system 24 (see FIG. 1B).

The vacuum transport tube vehicle 12 (see FIG. 2B) may further comprise a control system 115 (see FIGS. 2A, 2E, 2F, 16) with one or more controllers 115*a* (see FIGS. 2A, 2E, 2F, 16) for controlling the vacuum transport tube vehicle 12, such as a remotely controlled control system with sensors, wireless controls, and other suitable components. However, the vacuum transport tube vehicle 12 (see FIG. 2B) may be autonomous or self-driving as well, or may be autonomous with a manual override option from a central control facility or hardware.

The vacuum transport tube vehicle 12 (see FIGS. 2A, 2B) moves or travels through the vacuum transport tube 16 (see FIGS. 2A, 2B) and evacuates the vacuum transport tube 16, such as evacuates air 40 (see FIGS. 2A, 2B) from the vacuum transport tube 16, to create and maintain a vacuum 42 (see FIG. 16) within the interior 32*a* (see FIG. 2A) of the vacuum transport tube 16. The vacuum transport tube vehicle 12 does not use any pressure seals to prevent the air 40 (see FIG. 2B) from escaping past the vacuum transport tube vehicle 12, but instead, is constructed such that the annular gap 116 (see FIG. 2B), or interface 192 (see FIG. 16), formed between the first end outer surface 58 (see FIGS. 2B, 2F) at the first end 54 (see FIGS. 2B, 2F) of the vacuum transport tube vehicle 12 (see FIG. 2B) and the inner surface 34*a* (see FIG. 2*b*) of the vacuum transport tube 16 (see FIG. 2B), allows only a small amount of air 40 (see FIG. 2B) past the vacuum transport tube vehicle 12 from the forward space 44 (see FIG. 2*b*) to the aft space 48 (see FIG. 2B). The vacuum transport tube vehicle 12 (see FIG. 2B) also has the orifice 84 (see FIGS. 2B, 2C) that allows even more air 40 (see FIG. 2B) to escape from the forward space 44 (see FIG. 2B) at the front of the vacuum transport tube vehicle 12 to the aft space 48 (see FIG. 2B) behind or aft of the vacuum transport tube vehicle 12.

The annular gap 116 (see FIGS. 2B, 2C) has a gap distance 118 (see FIG. 2C) that is variable and is directly proportional to the length of the orifice diameter 92 (see FIG. 2C). Preferably, the annular gap 116 has a gap distance 118 (see FIG. 2C) in a range of about 0.25 inch to 1.0 (one) inch between the inner surface 34*a* (see FIG. 2C) of the vacuum transport tube 16 (see FIG. 2C) and the first end outer surface 58 (see FIG. 2C) at the first end 54 (see FIG. 2C) of the vacuum transport tube vehicle 12 (see FIG. 2B), when the vacuum transport tube vehicle 12 is within the vacuum transport tube 16 (see FIGS. 2B, 2C). As shown in FIG. 2C, the annular gap 116 also has a gap area ($A_{gap}$) 120, which is the cross-sectional area of the annular gap 116 between the inner surface 34*a* of the vacuum transport tube 16 and the first end outer surface 58 of the first end 54 of the vacuum transport tube vehicle 12.

The vacuum transport tube vehicle 12 (see FIGS. 2A, 2B) preferably evacuates the vacuum transport tube 16 (see FIGS. 2A, 2B) by reducing pressure 43 (see FIG. 16) in the interior 32*a* (see FIG. 2A) of the vacuum transport tube 16 with each successive vehicle pass 53 (see FIG. 16) through the vacuum transport tube 16, until a desired pressure 43*a* (see FIG. 16) is obtained and a vacuum 42 (see FIG. 16) is created in the interior 32*a* of the vacuum transport tube 16.

As discussed in further detail below in connection with FIG. 16, the vacuum transport tube vehicle system 10 may comprise one or more vacuum transport tube vehicles 12. Preferably, the vacuum transport tube vehicle system 10 (see FIG. 16) comprises an amount of ten (10) vacuum transport tube vehicles 12 to twenty (20) vacuum transport tube vehicles 12, installed or arranged in series, or in succession, within the vacuum transport tube 16. More preferably, the vacuum transport tube vehicle system 10 (see FIG. 16) comprises an amount of three (3) vacuum transport tube vehicles 12 to twenty (20) vacuum transport tube vehicles 12, installed or arranged in series, or in succession, within the vacuum transport tube 16. However, the vacuum transport tube vehicle system 10 may comprise a single vacuum transport tube vehicle 12 that makes multiple vehicle passes 53 (see FIG. 16) through the vacuum transport tube 16, or may comprise any combination of 2 to 20, or more, vacuum transport tube vehicles 12, or cars 13, each making one or more vehicle passes 53 (see FIG. 16) through the vacuum transport tube 16.

FIGS. 3A-5B show various operations 130 of the vacuum transport tube vehicle system 10 having a plurality of vacuum transport tube vehicles 12, such as in the form of ten (10) cars 13, numbered 1-10, within the vacuum transport tube 16.

Figures 3A, 3B:
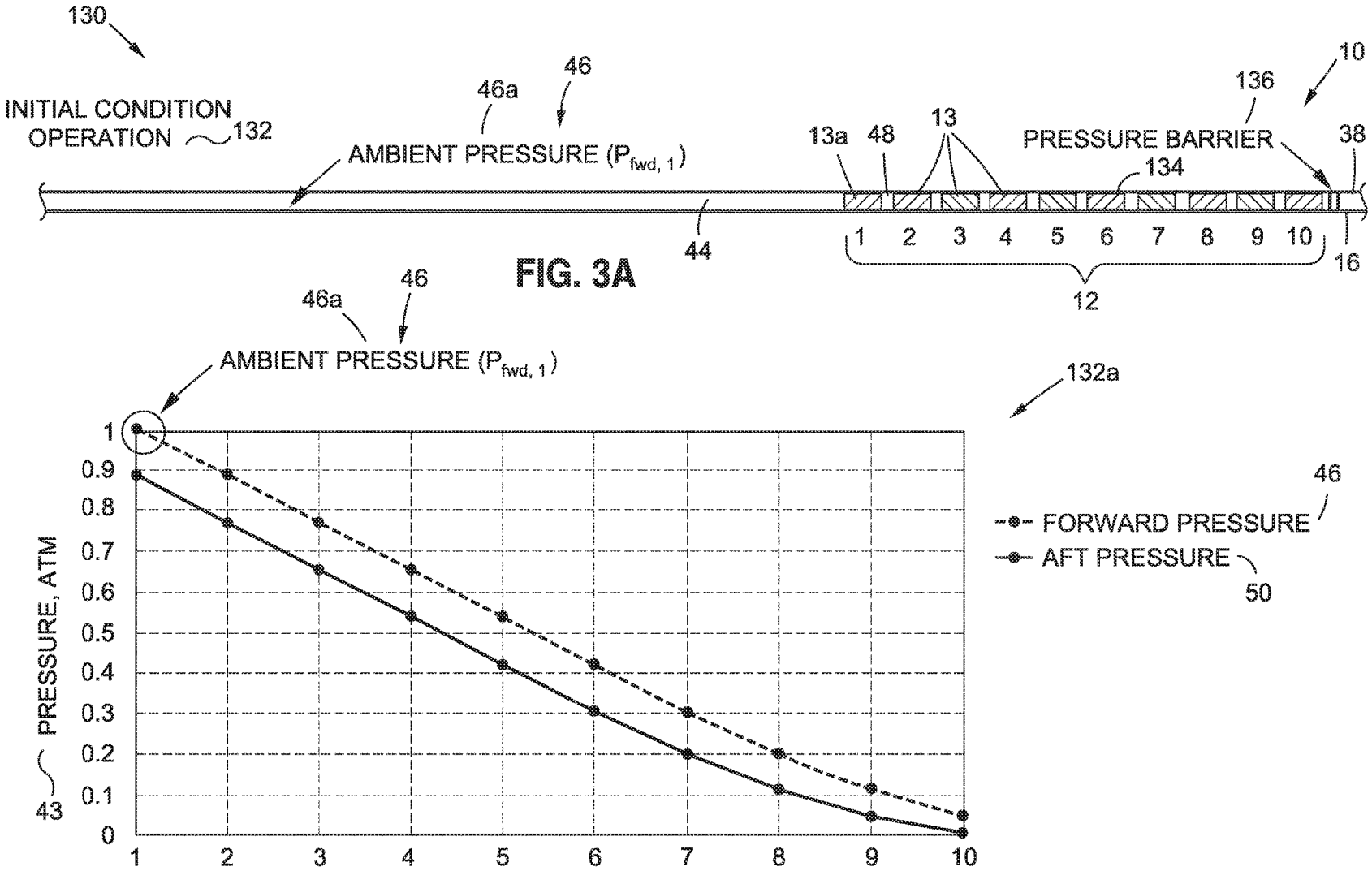
FIG. 3A is a schematic illustration of an initial condition operation of the vacuum transport tube vehicle system of the disclosure.
FIG. 3B is an illustration of an initial condition operation graph showing a pressure in front of and behind each car in the initial condition operation of FIG. 3A.

FIG. 3A is a schematic illustration of an operation 130 of an initial condition operation 132 of an embodiment of the vacuum transport tube vehicle system 10 of the disclosure. As shown in FIG. 3A, the vacuum transport tube vehicle system 10 comprises ten (10) vacuum transport tube vehicles 12, such as in the form of ten (10) cars 13, numbered 1-10, which are positioned in a right end-most portion 134 of the vacuum transport tube 16 of the vacuum transport tube route 38. A pressure barrier 136 is positioned behind the last of the ten (10) cars 13. As shown in FIG. 3A, the vacuum transport tube 16 has a forward pressure ($P_{fwd,\ 1}$) 46, in the form of an ambient pressure 46*a*, in the forward space 44 inside the vacuum transport tube 16, in front of the first car 13*a*. An aft space 48 (see FIG. 3A) is behind the first car 13*a*, and behind each successive car 13.

FIG. 3B is an illustration of an initial condition operation graph 132*a* showing the pressure 43 in front of and behind each of the 1-10 cars 13 in the initial condition operation 132 of FIG. 3A. The initial condition operation graph 132*a* shows plots of the forward pressure ($P_{fwd}$) 46, such as in the form of ambient pressure 46*a*, in front of each car 13, and shows plots of the aft pressure 50 behind each car 13.

Figure 4A:
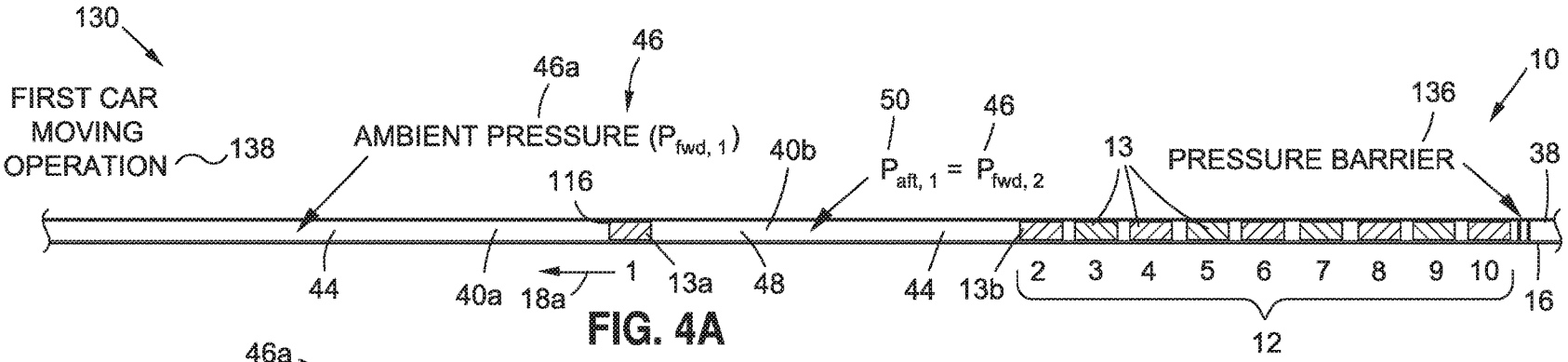
FIG. 4A is a schematic illustration of a first car moving operation of the vacuum transport tube vehicle system of the disclosure.

FIG. 4A is a schematic illustration of an operation 130 of a first car moving operation 138 of an embodiment of the vacuum tube vehicle system 10 of the disclosure. FIG. 4A shows the vacuum transport tube vehicle system 10 comprising ten (10) vacuum transport tube vehicles 12, such as in the form of ten (10) cars 13, numbered 1-10, positioned in the vacuum transport tube 16 of the vacuum transport tube route 38 with the pressure barrier 136 positioned behind the last of the ten (10) cars 13.

As shown in FIG. 4A, a first car 13*a* has started moving in a forward direction of travel 18*a*. FIG. 4A shows the forward pressure ($P_{fwd,\ 1}$) 46, in the form of ambient pressure 46*a*, in the forward space 44 inside the vacuum transport tube 16, in front of the first car 13*a*, and shows the forward pressure ($P_{fwd,\ 2}$) 46, in front of the second car 13*b*. FIG. 4A further shows the aft pressure ($P_{aft,\ 1}$) 50 in the aft space 48 behind the first car 13*a*. FIG. 4A shows the aft pressure ($P_{aft,\ 1}$) 50, behind the first car 13*a* being equal to a forward pressure ($P_{fwd,\ 2}$) 46, in front of the second car 13*b*.

Because the upstream air 40*a* (see FIG. 4A) in the forward space 44 (see FIG. 4A) flowing past the annular gap 116 (see FIG. 4A) of the first car 13*a* (see FIG. 4A) is not sufficient to completely replace the downstream air 40*b* (see FIG. 4A) in the aft space 48 (see FIG. 4A) behind the first car 13*a*, the aft pressure ($P_{aft,\ 1}$) 50 (see FIG. 4A) behind the first car 13*a* is lower than the forward pressure ($P_{fwd,\ 1}$) 46, in front of the first car 13*a*. The aft pressure ($P_{aft}$) 50 (see FIG. 4B) of each vacuum transport tube vehicle 12, such as the first car 13*a* and each successive car 13, depends upon the size of the gap distance 118 (see FIG. 2C) and the gap area 120 (see FIG. 2C) of the annular gap 116 (see FIGS. 2C, 4A), and a forward speed 94*c* (see FIG. 16) of the vacuum transport tube vehicle 12, such as the first car 13*a* and each successive car 13. Equations describing the relationship of the aft pressure ($P_{aft}$) 50 of the vacuum transport tube vehicle 12 and those quantities are discussed in connection with EXAMPLE 1 below.

Figure 4B:
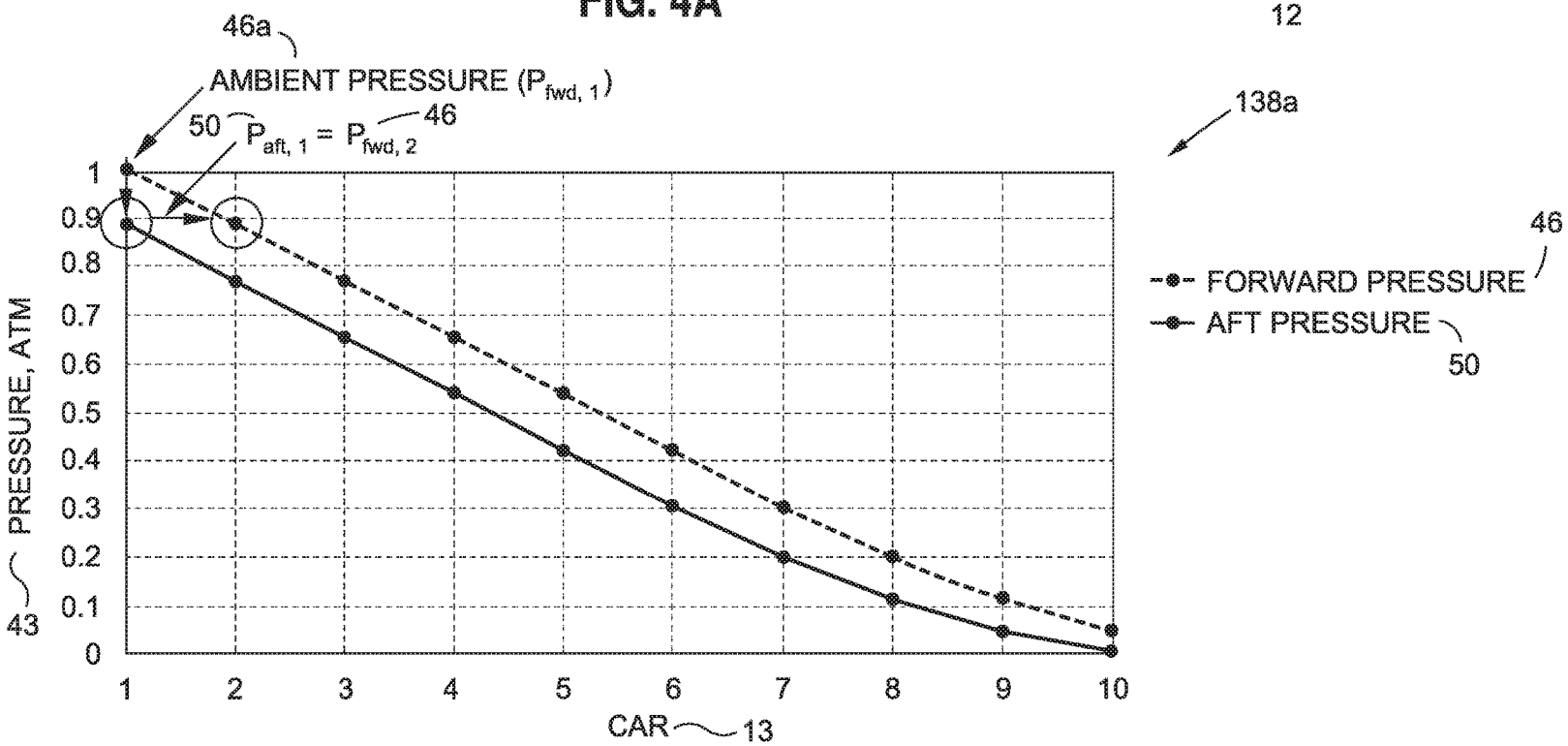
FIG. 4B is an illustration of a first car moving operation graph showing a pressure in front of and behind each car in the first car moving operation of FIG. 4A.

FIG. 4B is an illustration of a first car moving operation graph 138*a* showing the pressure 43 in front of and behind each of the 1-10 cars 13 in the first car moving operation 138 of FIG. 4A. The first car moving operation graph 138*a* shows a plot for the forward pressure ($P_{fwd,\ 1}$) 46, such as in the form of ambient pressure 46*a*, in front of the first car 13*a*, shows plots for the forward pressure ($P_{fwd}$) 46 in front of each successive car 13, shows a plot for the aft pressure ($P_{aft,\ 1}$) 50, behind the first car 13*a*, and shows plots for the aft pressure ($P_{aft}$) 50 behind each successive car 13. FIGS. 4A-4B show the aft pressure ($P_{aft,\ 1}$) 50, behind the first car 13*a*, being equal to the forward pressure ($P_{fwd,\ 2}$) 46, in front of the second car 13*b*.

Figure 5A:
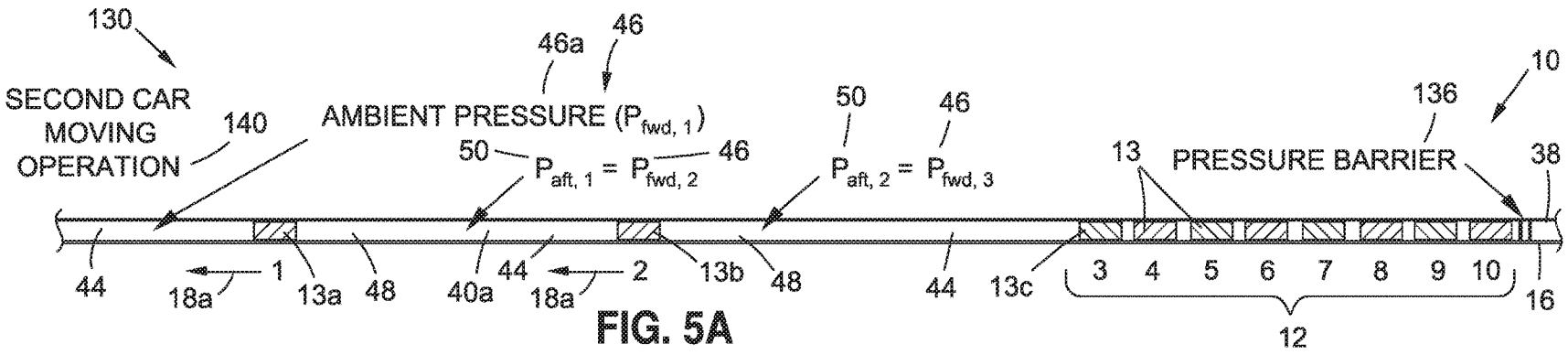
FIG. 5A is a schematic illustration of a second car moving operation of the vacuum transport tube vehicle system of the disclosure.

FIG. 5A is a schematic illustration of an operation 130 of a second car moving operation 140 of an embodiment of the vacuum tube vehicle system 10 of the disclosure. FIG. 5A shows the vacuum transport tube vehicle system 10 comprising ten (10) vacuum transport tube vehicles 12, such as in the form of ten (10) cars 13, numbered 1-10, positioned in the vacuum transport tube 16 of the vacuum transport tube route 38 with the pressure barrier 136 positioned behind all of the ten (10) cars 13.

FIG. 5A shows the first car 13*a* and the second car 13*b* both moving in a forward direction of travel 18*a*. FIG. 5A shows the forward pressure ($P_{fwd,\ 1}$) 46, in the form of ambient pressure 46*a*, in the forward space 44 inside the vacuum transport tube 16, in front of the first car 13*a*, and shows the forward pressure ($P_{fwd,\ 2}$) 46, in the forward space 44 in front of the second car 13*b*, and shows the forward pressure ($P_{fwd,\ 3}$) 46, in the forward space 44 in front of a third car 13*c*. FIG. 5A further shows the aft pressure ($P_{aft,\ 1}$) 50 in the aft space 48 behind the first car 13*a*, and shows the aft pressure ($P_{aft,\ 2}$) 50 in the aft space 48 behind the second car 13*b*.

FIG. 5A shows the second car 13*b* moving some distance behind the first car 13*a*. The second car 13*b* further reduces the aft pressure ($P_{aft,\ 2}$) 50 behind the second car 13*b*, relative to the forward pressure ($P_{fwd,\ 2}$) 46 in front of the second car 13*b*, with the result that the aft pressure ($P_{aft,\ 2}$) 50 behind the second car 13*b* is further reduced from the aft pressure ($P_{aft,\ 1}$) 50 behind the first car 13*a*. With each successive car 13 (and successive vehicle pass 53 (see FIG. 16) of each car 13), the pressure 43 (see FIG. 5B) is further reduced aft of the series of cars 13. The number of cars 13 used depends on the desired quality of vacuum 42 (see FIG. 16) to be achieved.

Figure 5B:
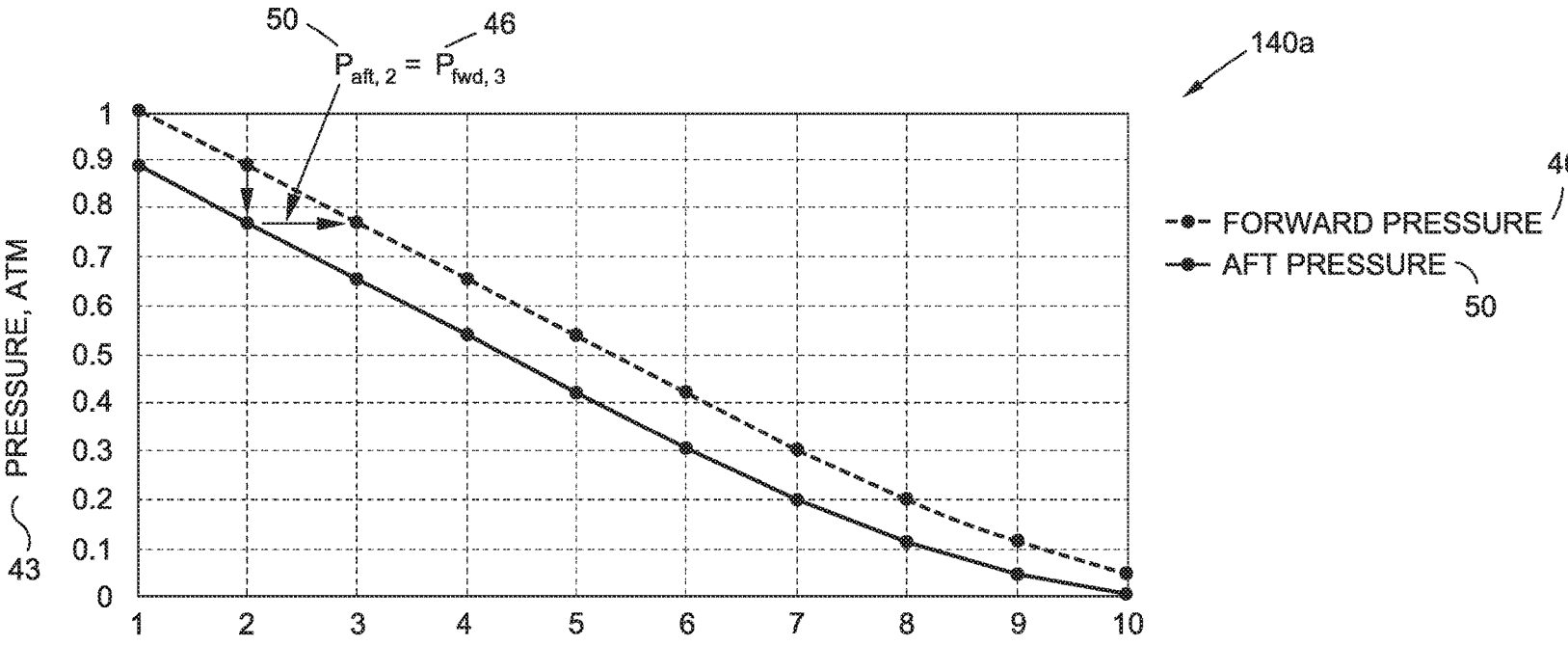
FIG. 5B is an illustration of a second car moving operation graph showing a pressure in front of and behind each car in the second car moving operation of FIG. 5A.

FIG. 5B is an illustration of a second car moving operation graph 140*a* showing the pressure 43 in front of and behind each of the 1-10 cars 13 in the second car moving operation 140 of FIG. 5A. The second car moving operation graph 140*a* shows plots of forward pressure 46 in front of each of the 1-10 cars 13, and shows plots of aft pressure 50 behind each of the 1-10 cars 13. FIG. 5A shows the aft pressure ($P_{aft,\ 1}$) 50, behind the first car 13*a* being equal to the forward pressure ($P_{fwd,\ 2}$) 46, in front of the second car 13*b*. FIGS. 5A and 5B show the aft pressure ($P_{aft,\ 2}$) 50 behind the second car 13*b* being equal to the forward pressure ($P_{fwd,\ 3}$) 46 in front of the third car 13*c*.

EXAMPLES

Various examples are discussed below with respect to operation of embodiments of the vacuum transport tube vehicle 12 and the vacuum tube vehicle system 10 disclosed herein.

Example 1

Figure 6:
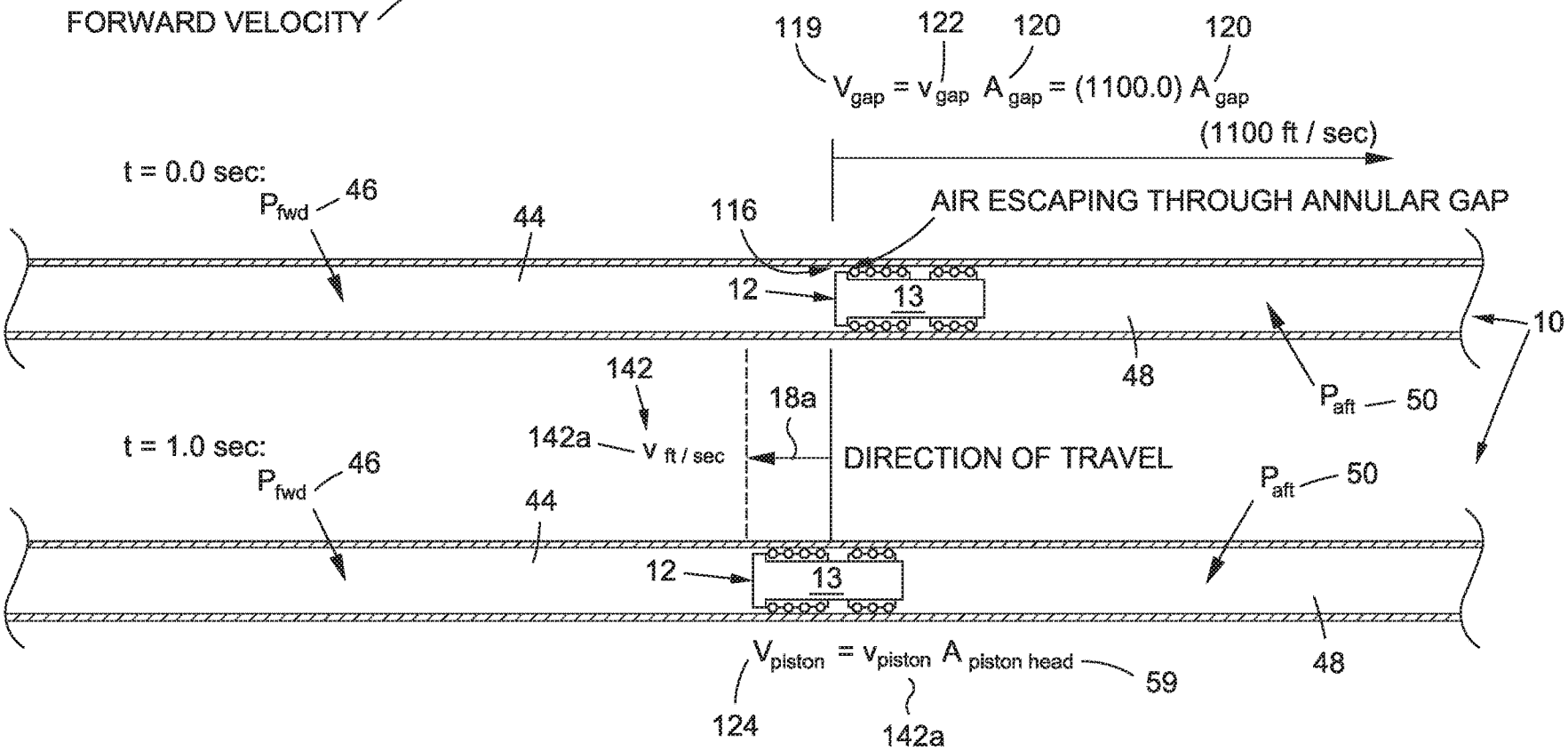
FIG. 6 is a schematic illustration of a forward velocity through a vacuum transport tube of a vacuum transport tube vehicle of the disclosure.

FIG. 6 is a schematic illustration of a velocity 142, such as a forward velocity 142*a*, from 0 (zero) second to 1 (one) second, through the vacuum transport tube 16, for an embodiment of a vacuum transport tube vehicle 12, such as a car 13, of an embodiment of the vacuum tube vehicle system 10 of the disclosure. FIG. 6, as well as FIG. 2C, shows the quantities that may be used to calculate the pressures 43 (see FIGS. 7A-7B), such as the forward pressure ($P_{fwd}$) 46 and the aft pressure ($P_{aft}$) 50.

The following example was prepared to illustrate the concept.

The gap area ($A_{gap}$) 120 (see FIGS. 2C, 6) was the gap distance (d) 118 (see FIG. 2C) multiplied by a perimeter 35 (see FIG. 16) of the vacuum transport tube vehicle 12. For a vacuum transport tube inner diameter 31 (see FIGS. 2C, 16) equal to 14.0 feet and a gap distance 118 (see FIG. 2C) of 0.25 inches (0.020833 ft), the gap area 120 (see FIG. 2C) was 0.916 square feet.

$$A_{gap}=(\pi)(D)(d)=(3.14159)(14.0)(0.020833)=0.916\ \text{ft}^2$$

The piston head area ($A_{piston\ head}$) 59 (see FIG. 2C) was given by the following equation:

$$A_{piston\ head}=(\pi)(D^2/4)=(\pi)((14.0)^2/4)=153.94\ \text{ft}^2$$

The gap volume ($V_{gap}$) 119 (see FIG. 6) of air 40 (see FIG. 2A) that escaped through the annular gap 116 (see FIGS. 2C) to the aft space 44 (see FIG. 2A) behind the vacuum transport tube vehicle 12 (see FIG. 2A) was given by the following equation.

$$V_{gap}=V_{gap}A_{gap}=(1100.0)(0.916)=1007.6\ \text{ft}^3/\text{sec}$$

Two conservative assumptions were made in the formulation of $V_{gap}=V_{gap}A_{gap}$. The first assumption was that there was sonic flow occurring in the annular gap 116 (see FIGS. 2B, 2C). Although this may be accurate if the forward pressure ($P_{fwd}$) 46 was in the form of ambient pressure 46*a*, and the aft pressure ($P_{aft}$) 50 of the vacuum transport tube vehicle 12 was a near vacuum, it would likely overestimate the velocity of the flow, if the difference in pressure between the forward volume (or space) and the aft volume (or space) was quite small.

The second assumption was that temperature of the air flow was not considered. Since the air 40 (see FIG. 2A) escaping into the aft space 48 (see FIG. 2A) behind the vacuum transport tube vehicle 12 (see FIG. 2A) would be cooled by the decompression, and the Mach number would consequently reduce, the velocity would also reduce. If a more accurate calculation was performed, it may result in one or two less vacuum transport tube vehicles 12 being required to achieve a given vacuum.

If the forward velocity ($v_{piston}$) 142*a* (see FIG. 6) of the vacuum transport tube vehicle 12 was equal to 8.93 ft/sec, the piston volume ($V_{piston}$) 124 (see FIG. 6) swept by the vacuum transport tube vehicle 12 was given by the following equation:

$$V_{piston}=(v_{piston})(A_{piston\ head})=(8.93)(153.94)=1375.1\ \text{ft}^3/\text{sec}$$

These quantities are illustrated in FIG. 6. For a steady state condition, the ratio of pressures (r) between the forward space 44 (see FIG. 6) in front of the vacuum transport tube vehicle 12 (see FIG. 6) and the aft space 48 (see FIG. 6) behind the vacuum transport tube vehicle 12 was given by the following equation:

$$r=V_{gap}/V_{piston}=1007.6/1375.1=0.733$$

If, for example, the forward pressure ($P_{fwd}$) 46 (see FIG. 6) of the vacuum transport tube vehicle 12 (see FIG. 6) was equal to 6.24 psi, the aft pressure ($P_{aft}$) 50 (see FIG. 6) of the vacuum transport tube vehicle 12 was equal to 4.57 psi (pounds per square inch):

$$P_{aft}=(r)(P_{fwd})=(0.733)(6.24)=4.57\ \text{psi}$$

The delta pressure 52 (see FIGS. 11A, 16) was given by the following equation:

$$\Delta P=P_{fwd}-P_{aft}=P_{fwd}(1-r)=1.67\ \text{psi}=240.0\ \text{psf}$$
(pounds per square foot)

The amount of force 126 (see FIG. 16) required of the drive assembly 100 (see FIG. 2B) to move the vacuum transport tube vehicle 12 forward was given by the delta pressure 52 (see FIG. 11A) multiplied by the piston head area ($A_{piston\ head}$) 59 (see FIGS. 2C, 6).

$$F=(\Delta P)(A_{piston\ head})=(240.0)(153.94)=36{,}943\ \text{lb}$$
(pounds)

The amount of power required 96*c* (see FIGS. 12A, 16) was given by the force (F) multiplied by the velocity ($v_{piston}$):

$$P=(F)(v_{piston})=(36{,}943)(8.93)=333{,}000\ \text{ft-lb/sec}=600\ \text{hp}$$
(horsepower)

That the power required 96*c* (see FIG. 12A) came out to exactly 600 hp (horsepower) showed that the velocity of 8.83 ft/sec was not arbitrary. This was indeed the case. The speed was chosen so as to make the example use a 600 hp motor.

Example 2

The operation of the vacuum transport tube vehicle 12 falls into three regimes, including orifice control 144 (see FIGS. 7A-13), speed control 146 (see FIGS. 7A-13), and constant pressure ratio 148 (see FIGS. 7A-13).

With respect to orifice control 144 (see FIGS. 7A-13), when starting out at ambient pressure 46*a* (see FIG. 3A), it is the case that using an annular gap 116 (see FIG. 2C) of only 0.25 inches results in a large delta pressure 52 (see FIGS. 11A-11B), or pressure differential, between the forward space 44, i.e., forward volume, and the aft space 48, i.e., aft volume. A large delta pressure 52, or pressure differential, may result in a large force being applied to the forward surface 60 (see FIG. 2B) of the vacuum transport tube vehicle 12 (see FIG. 2B). If a horsepower is limited to a certain value, this forces the speed of the vacuum transport tube vehicle 12, such as the first car 13*a* (see FIG. 4A) to be quite slow, perhaps 2 ft/sec (two feet per second) or 3 ft/sec (three feet per second). For a long vacuum transport tube route 38 (see FIG. 2A), for example, a 400 mile route, this would result in a travel time 169 (see FIG. 13) for the first car 13*a*, of at least one (1) week, which may not be desired. A way to resolve this situation is to provide an orifice 84 (see FIGS. 2C, 2F) in the forward surface 60 (see FIGS. 2C, 2F) of the first end 54 (see FIG. 2B) of the vacuum transport tube vehicle 12 (see FIGS. 2B, 2F) that increases the area available for the air 40 (see FIG. 2A) to escape into the aft space 48 (see FIG. 2A), i.e., aft volume, aft of or behind the vacuum transport tube vehicle 12. This way, the speed 94 (see FIG. 16) of the first car 13*a* or set of first cars may be set to an arbitrary acceptable value. By rewriting equations:

$$V_{piston}=(V_{piston})(A_{piston\ head}) \text{ and } r=V_{gap}/V_{piston}$$

to include the orifice area ($A_{orifice}$) 99 (see FIG. 2C), the orifice diameter 92 (see FIG. 2C) may be set so that the power and speed requirements are met. With the power and speed provided, the equations from Example 1 may be rewritten as follows in this Example 2. In this Example 2, the conditions for the first car 13*a* (see FIG. 4A) were ambient forward pressure 46*a* (see FIG. 4A) in front of the first car 13*a* (see FIG. 4A), a forward speed 94*c* (see FIG. 16) of 6 mph (8.8 ft/sec), and a 600 hp (horsepower) propulsion system. For a route length 36 (see FIG. 2A) of the vacuum transport tube route 38 (see FIG. 2A) of 263 miles (i.e., distance in miles one way from Los Angeles, Calif., USA to Las Vegas, Nev., USA), this resulted in a travel time 169 (see FIG. 13) of 43.8 hours, or 1.83 days.

The force (F) was given by the following equation:

$$F=P/V_{piston}=330{,}000/8.8=37{,}500 \text{ lb}$$

The delta pressure was given by the following equation:

$$\Delta P=F/A_{piston\ head}=37{,}500/153.94=243.6 \text{ psf}=1.69 \text{ psi}$$

The aft pressure ($P_{aft}$) 50 (see FIG. 6) behind the vacuum transport tube vehicle 12 (see FIG. 6) was given by the following equation:

$$P_{aft}=P_{fwd}-\Delta P=2116.7-243.6=1873.2 \text{ psf}=1.69 \text{ psi}$$

The pressure ratio (r) 154 (see FIG. 8) was given by the following equation:

$$r=P_{aft}/P_{fwd}=1873.2/2116.7=0.885$$

The equation for the piston volume ($V_{piston}$) 124 (see FIG. 6) swept by the piston was unchanged:

$$V_{piston}=(v_{piston})(A_{piston\ head})=(8.8)(153.94)=1354.6 \text{ ft}^3/\text{sec}$$

The volume ($V_{flow}$) for the combined flow through the annular gap 116 (see FIGS. 2C, 6) and the orifice 84 (see FIG. 2C) was given by the following equation:

$$V_{flow}=V_{gap}+V_{orifice}=(r)(V_{piston})=(0.885)(1354.6)=1198.8 \text{ ft}^3/\text{sec}$$

The equation for the gap volume ($V_{gap}$) 119 (see FIG. 6) of air that escaped through the annular gap 116 (see FIG. 6) to the aft space 48 (see FIGS. 2A, 6) aft of the vacuum transport tube vehicle 12 (see FIGS. 2A, 6) was unchanged:

$$V_{gap}=(V_{gap})(A_{gap})=(1100.0)(0.916)=1007.6 \text{ ft}^3/\text{sec}$$

The orifice volume ($V_{orifice}$) 128 (see FIG. 16) of air 40 (see FIG. 2A) escaping from the orifice 84 (see FIG. 2C) was the difference of the total flow volume ($V_{flow}$) 129 (see FIG. 16) of air 40 (see FIG. 2A) escaping and the gap volume ($V_{gap}$) 119 (see FIG. 6) escaping through the annular gap 116 (see FIG. 2C):

$$V_{orifice}=V_{flow}-V_{gap}=(1198.8)(1007.6)=191.2 \text{ ft}^3/\text{sec}$$

Assuming sonic flow through the orifice 84 (see FIGS. 2B, 2C) also, the orifice area ($A_{orifice}$) 99 (see FIG. 2C) was given by the following equation:

$$A_{orifice}=V_{orifice}/V_{gap}=191.2/1100.0=0.174 \text{ ft}^2$$

The orifice diameter 92 (see FIG. 2C) of the circular orifice 84 (see FIG. 2C) was given by the following equation:

$$D_{orifice}=\sqrt{(4)(A_{orifice})/\pi}=\sqrt{(4)(0.174)/3.14159}=0.47 \text{ ft}^2=5.64 \text{ in (inch)}$$

Example 3

With regard to speed control 146 (see FIGS. 7A-13), at some point, the orifice diameter 92 (see FIG. 2C) becomes zero, or less than zero, and the orifice 84 (see FIG. 2C) may be closed. If the annular gap 116 (see FIG. 2C) was maintained at the same value, the power required 96*c* (see FIG. 12A) will decrease if the speed 94 (see FIG. 16) is held constant. If one desires to maintain the same horsepower required, the speed may be increased. The speed at which this occurs was given by the following equation:

$$v_{piston}=P+(V_{gap})(P_{fwd})/(P_{fwd})(A_{piston\ head})=330{,}000+(1007.6)(2116.7)/(2116.7)(153.94)=8.932 \text{ ft/sec (feet per second)}$$

The rest of the quantities could be calculated using the equations from Example 1.

With regard to the constant pressure ratio 148 (see FIGS. 7A-13), it may be desirable to limit the top speed of the vacuum transport tube vehicle 12. In this case, the equations from Example 1 could be used.

Now referring to FIGS. 7A-12B, FIGS. 7A-12B show the values of various quantities and illustrate the three pressure regimes, including orifice control 144, speed control 146, and constant pressure ratio 149, for example, with the following given quantities: vacuum transport tube inner diameter (D) 31 (see FIGS. 2C, 16)=14.0 ft (feet); gap distance 118 (see FIG. 2C)=0.25 in (inch); gap flow speed ($V_{gap}$) 122 (see FIG. 6)=1100.0 ft/sec (feet per second); ambient pressure 46*a* (see FIG. 3A)=14.7 psi (pounds per square inch), 216.8 psf (pounds per square foot); maximum power 96*a* (see FIG. 16)=600 hp (horsepower), 330,000 ft-lb/sec (foot-pound per second); minimum speed 94*a* (see FIG. 16)=6.0 mph (miles per hour), 8.8 ft/sec (feet per second); maximum speed 94*b* (see FIG. 16)=60.0 mph (miles per hour), 88.0 ft/sec (feet per second); and route length 36 (see FIGS. 2A, 16)=263 mi (miles).

Figure 7B:
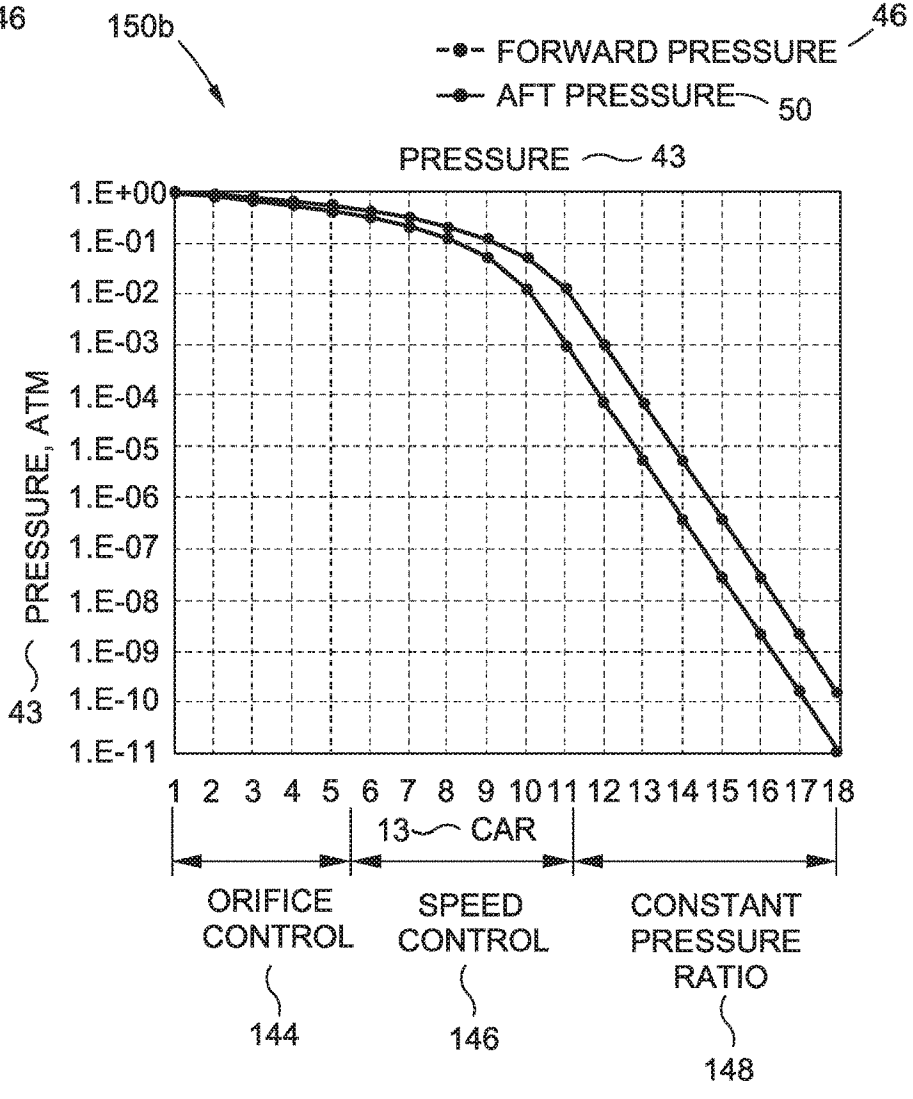
FIG. 7B is an illustration of a logarithmic scale pressure graph showing forward pressure and aft pressure for each car of an embodiment of the vacuum transport tube vehicle system of the disclosure.
Figure 7A:
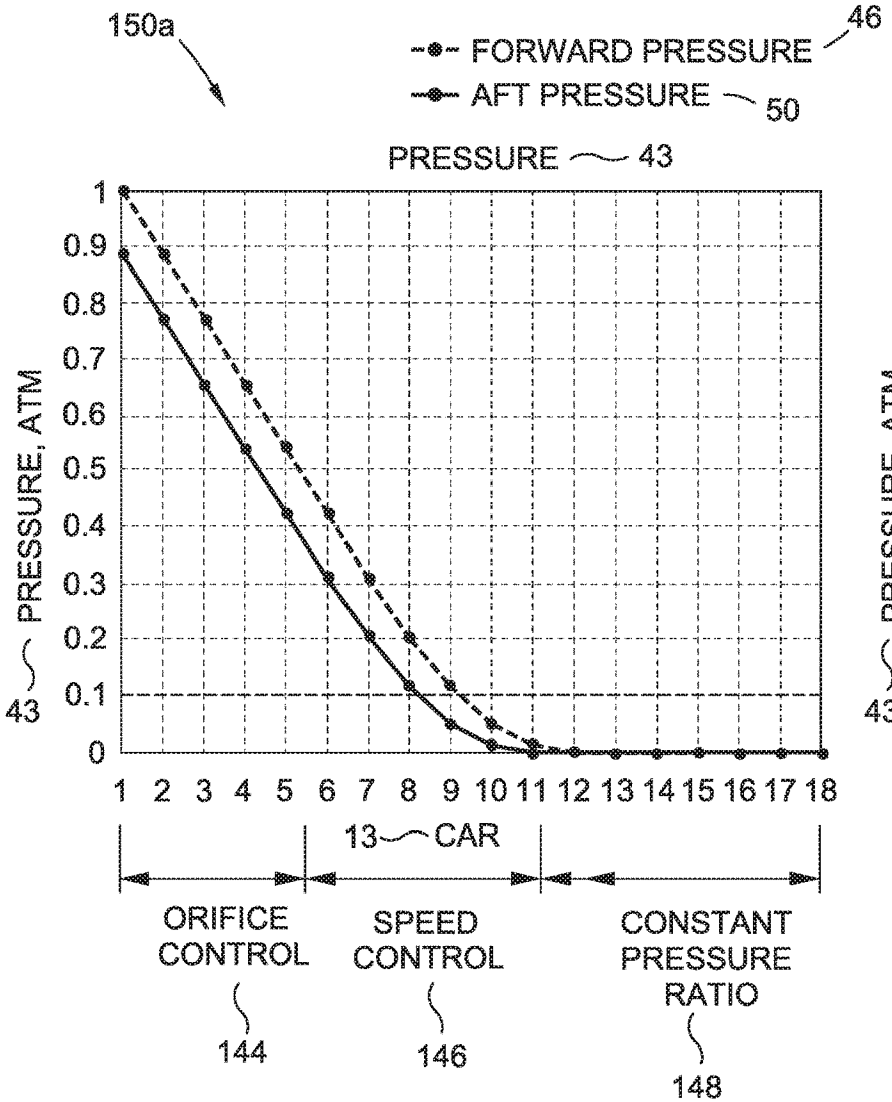
FIG. 7A is an illustration of a linear scale pressure graph showing forward pressure and aft pressure for each car of an embodiment of the vacuum transport tube vehicle system of the disclosure.

Now referring to FIGS. 7A and 7B, FIG. 7A is an illustration of a linear scale pressure graph 150*a* showing plots of forward pressure 46 and plots of aft pressure 50 for each of 1-18 cars 13, in series, of an embodiment of the vacuum transport tube vehicle system 10 (see FIG. 16) of the disclosure. FIG. 7B is an illustration of a logarithmic scale graph 150*b* showing plots of forward pressure 46 and plots of aft pressure 50 for each of 1-18 cars 13, in series, of an embodiment of the vacuum transport tube vehicle system 10 (see FIG. 16) of the disclosure. FIGS. 7A-7B show the pressure 43 in atmospheres (atm) both forward and aft of each car 13, in both a linear scale (FIG. 7A) and a logarithmic scale (FIG. 7B). For cars 1 through 5, orifice control 144 is used, with the speed set at 8.8 ft/sec (6.0 miles per hour) and the maximum power setting at 600 hp (horsepower). For a one way Los Angeles, Calif., USA, to a Las Vegas, Nev., USA, route length 36 (see FIG. 16), this results in a trip time of 48.83 hours, or 1.83 days. Cars 6-11 use speed control 146. The maximum horsepower of 600 hp is used, but the speed is allowed to increase. At car 12, the behavior is in the constant pressure ratio 148 regime, with the maximum speed set to 60 mph (88.0 ft/sec). It takes about ten (10) cars 13 to achieve even a near vacuum 42*a* (see FIG. 16). However, after that near vacuum, or partial vacuum, is reached, obtaining a high quality vacuum requires only a few more cars 13 as the constant pressure ratio 148 of the device of 0.0744 allows for a pressure reduction at each car 13 of approximately an order of magnitude.

Figure 8:
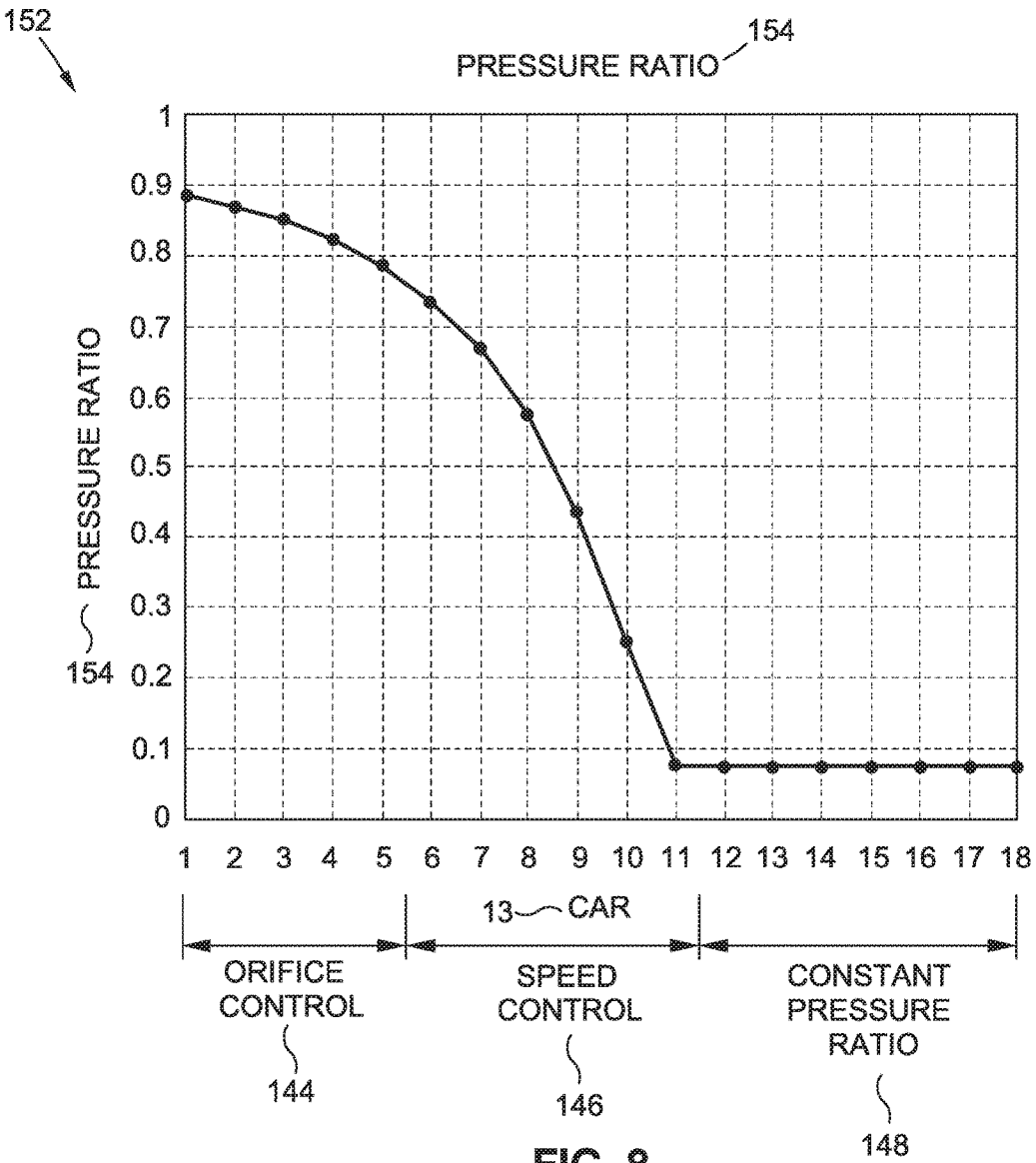
FIG. 8 is an illustration of a pressure ratio graph showing pressure ratio for each car of an embodiment of the vacuum transport tube vehicle system of the disclosure.

Now referring to FIG. 8, FIG. 8 is an illustration of a pressure ratio graph showing plots of pressure ratio 154 for each of 1-18 cars 13, in series, of an embodiment of the vacuum transport tube vehicle system 10 (see FIG. 16) of the disclosure. FIG. 8 shows the variation of pressure ratio 154 for the cars 13 for the orifice control 144, the speed control 146, and the constant pressure ratio 148 regimes. The pressure ratio 154 is kept relatively close to 1.0 since the power is limited to 600 horsepower. After the pressures drop, the pressure ratio 154 also drops as the speed 94 (see FIG. 16) increases. As the speed is held constant in the constant pressure ratio 148 regime, the pressure ratio 154 remains constant at 7.44% (percent). This pressure ratio 154 is governed by the speed 94 (see FIG. 16) of the vacuum transport tube vehicle 12, the gap flow speed ($V_{gap}$) 122 (see FIGS. 6, 16) past the annular gap 116, and the ratio of areas between the piston head area ($A_{piston\ head}$) 59 (see FIG. 2C) and the gap area ($A_{gap}$) 120 (see FIG. 2C). Smaller annular gaps 116 (see FIGS. 2B, 16) and higher speeds 94 (see FIG. 16) of the vacuum transport tube vehicle 12 result in lower pressure ratios 154 (see FIG. 8).

Figure 9:
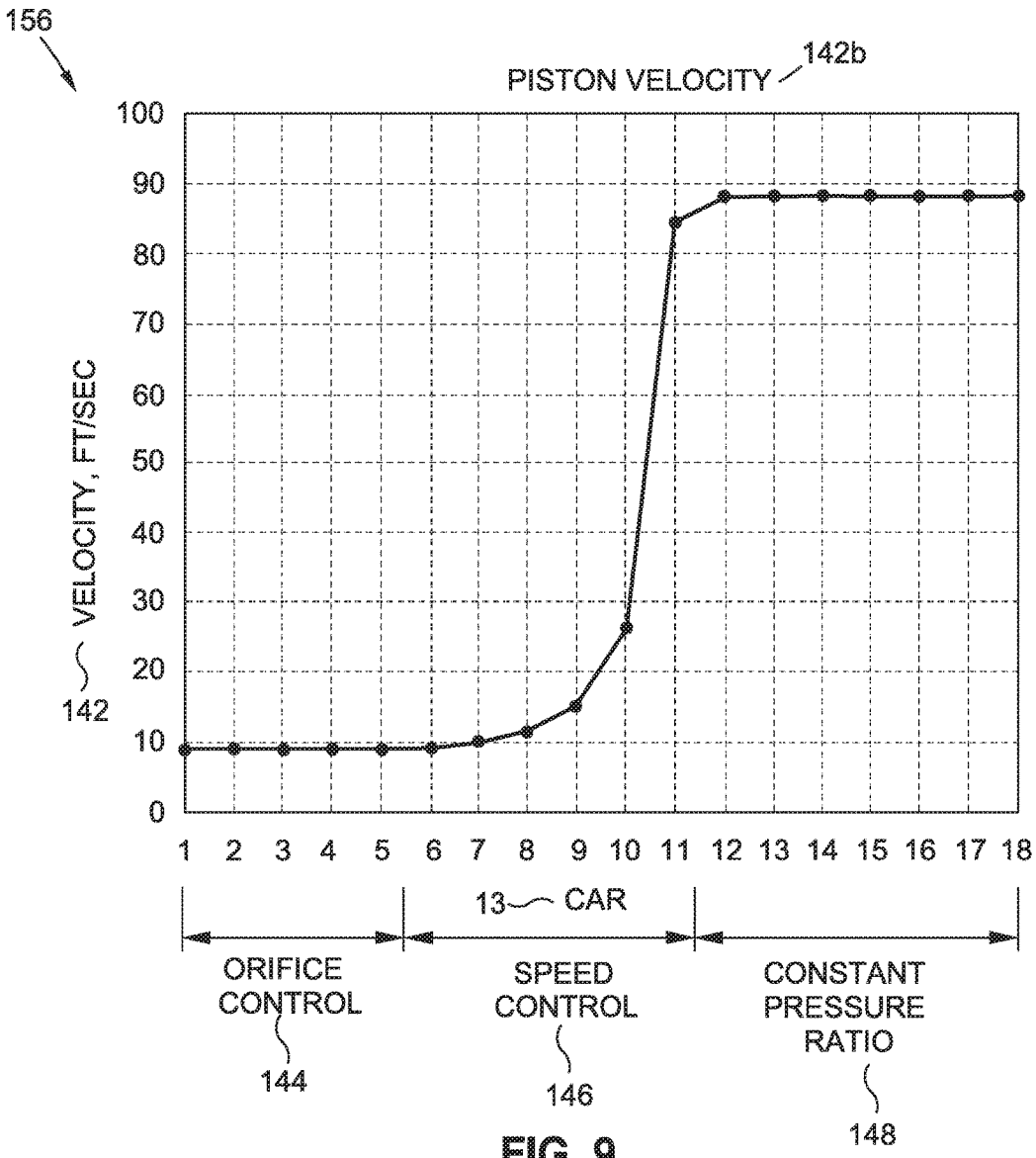
FIG. 9 is an illustration of a piston velocity graph showing piston velocity for each car of an embodiment of the vacuum transport tube vehicle system of the disclosure.

Now referring to FIG. 9, FIG. 9 is an illustration of a piston velocity graph 156 showing plots of piston velocity 142*b* for each of the 1-18 cars 13, in series, of an embodiment of the vacuum transport tube vehicle system 10 (see FIG. 16) of the disclosure. FIG. 9 shows plots of the velocity 142 in feet per second (ft/sec) of the 1-18 cars 13 for the orifice control 144, the speed control 146, and the constant pressure ratio 148 regimes.

Figure 10B:
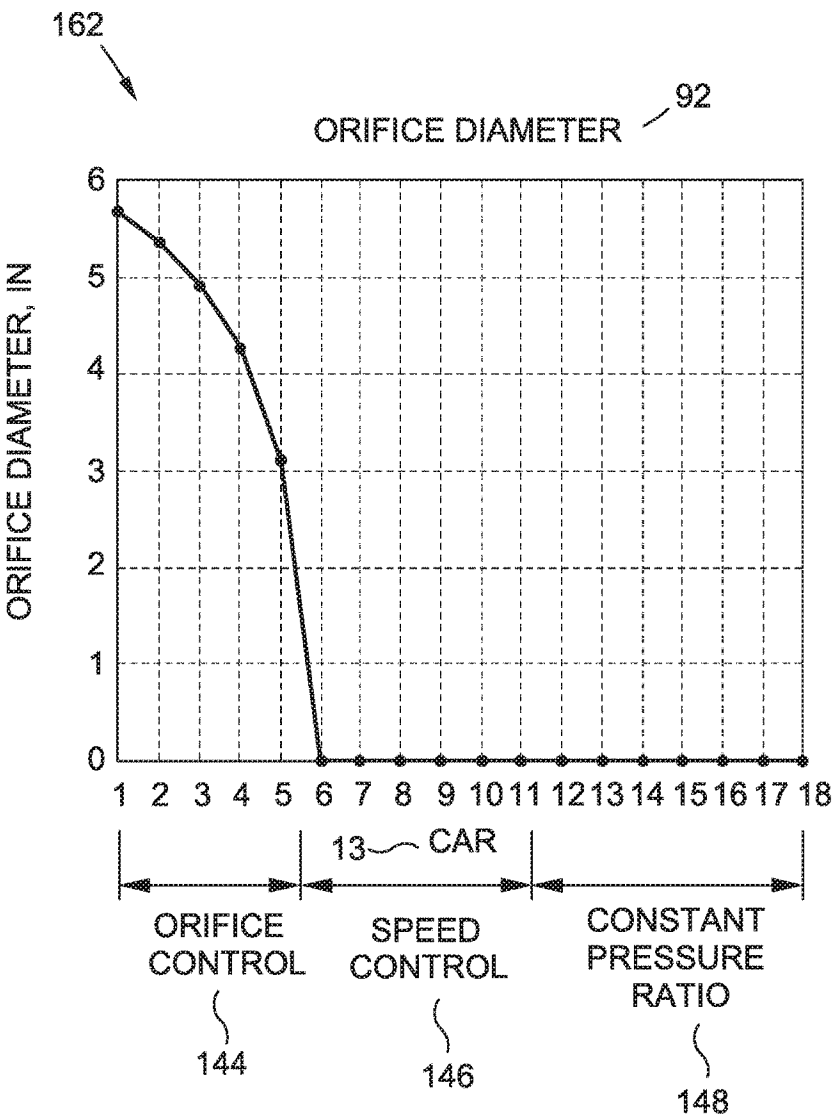
FIG. 10B is an illustration of an orifice diameter graph showing another orifice effect of an orifice diameter for each car of an embodiment of the vacuum transport tube vehicle system of the disclosure.
Figure 10A:
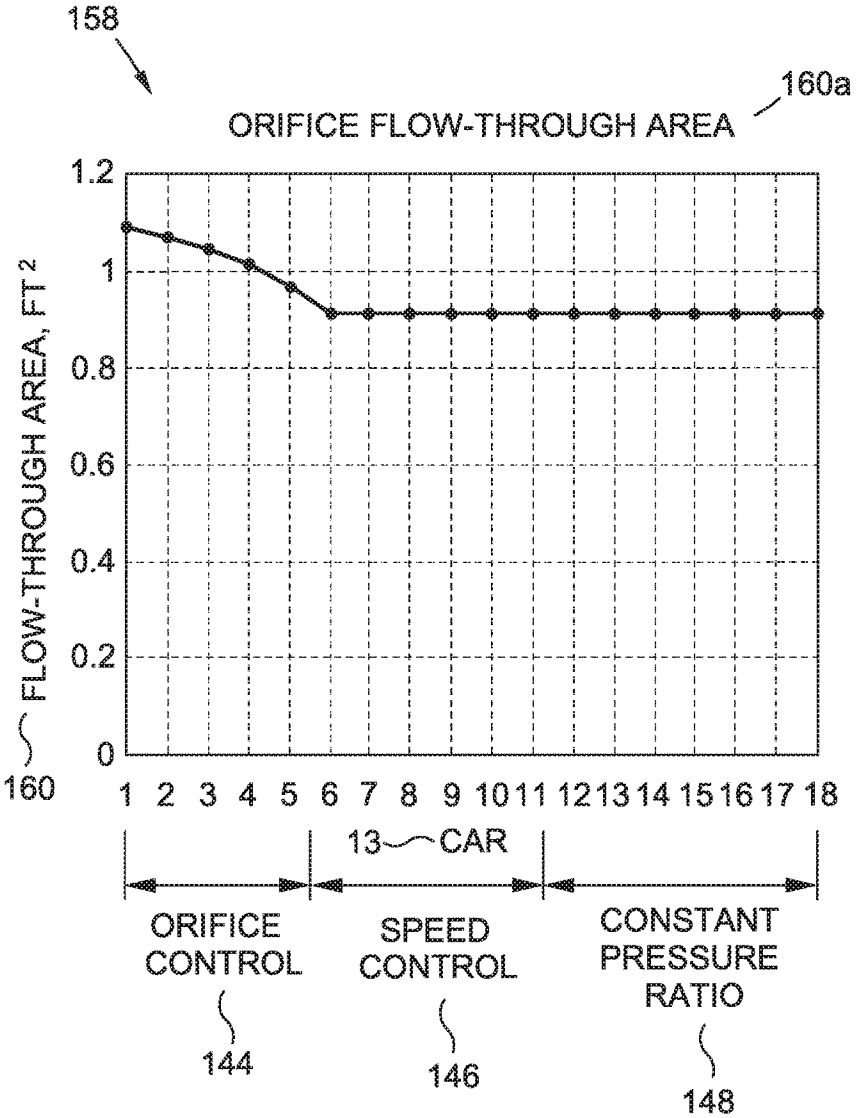
FIG. 10A is an illustration of an orifice flow-through area graph showing an orifice effect of a flow-through area of the orifice for each car of an embodiment of the vacuum transport tube vehicle system of the disclosure.

Now referring to FIGS. 10A and 10B, FIG. 10A is an illustration of an orifice flow-through area graph 158 showing the effect of flow-through area 160, such as orifice flow-through area 160*a*, for each of 1-18 cars 13, in series, of an embodiment of the vacuum transport tube vehicle system 10 (see FIG. 16) of the disclosure. FIG. 10B is an illustration of an orifice diameter graph 162 showing the effect of orifice diameter 92 for each of 1-18 cars 13, in series, of an embodiment of the vacuum transport tube vehicle system 10 (see FIG. 16) of the disclosure. FIG. 10A shows plots of the flow-through area 160 in square feet ($ft^2$) of the 1-18 cars 13 for the orifice control 144, the speed control 146, and the constant pressure ratio 148 regimes. FIG. 10B shows plots of the orifice diameter 92 in inches (in) of the 1-18 cars 13 for the orifice control 144, the speed control 146, and the constant pressure ratio 148 regimes. FIGS. 10A-10B show the effect of the orifice 84 (see FIGS. 2C-2F). The addition of area in the minimum speed orifice control 144 regime allows for higher minimum speed 94*a* (see FIG. 16) than would be otherwise.

Figure 11B:
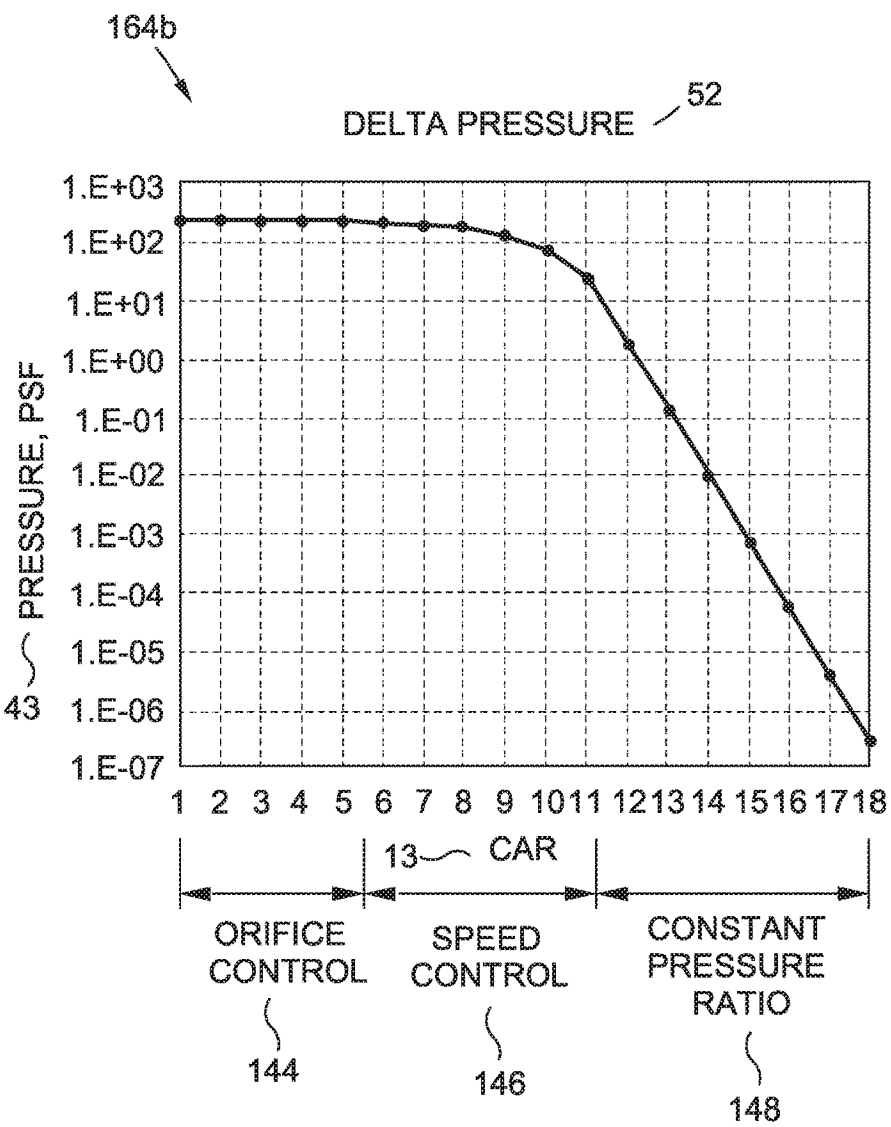
FIG. 11B is an illustration of a logarithmic scale delta pressure graph showing delta pressure for each car of an embodiment of the vacuum transport tube vehicle system of the disclosure.
Figure 11A:
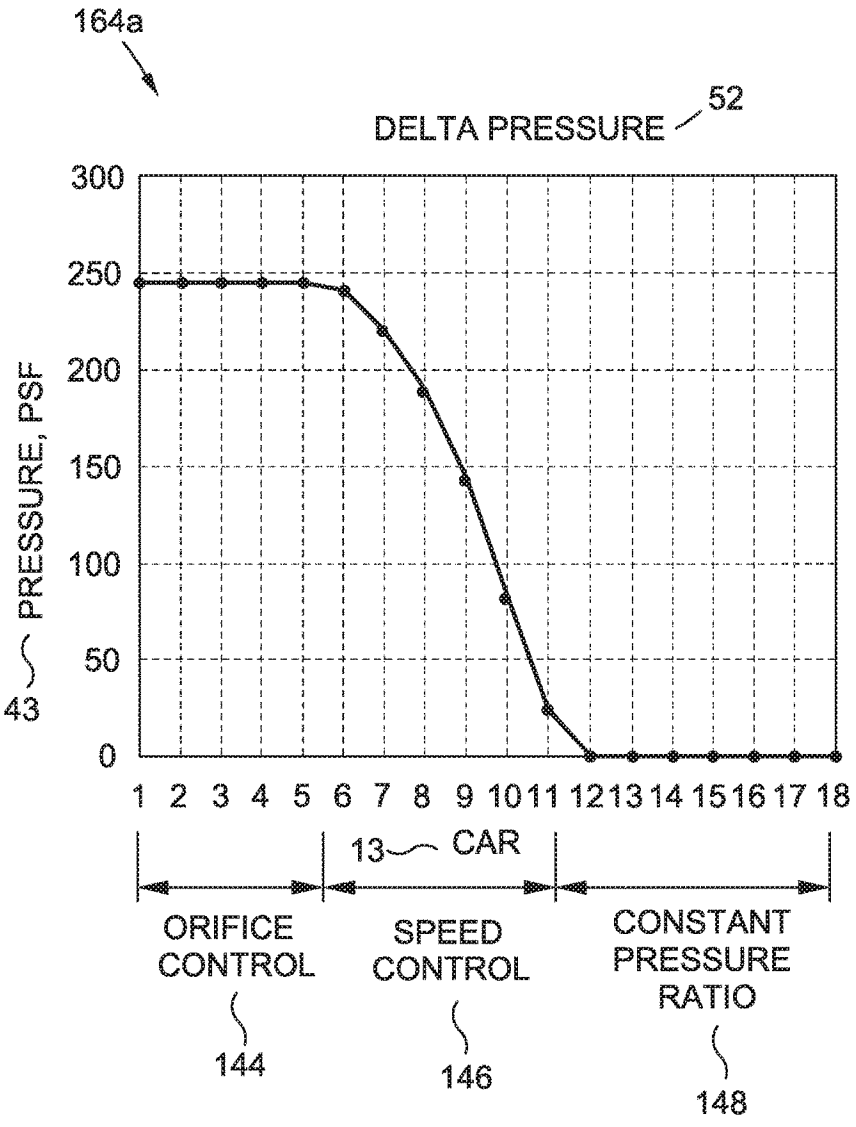
FIG. 11A is an illustration of a linear scale delta pressure graph showing delta pressure for each car of an embodiment of the vacuum transport tube vehicle system of the disclosure.

Now referring to FIGS. 11A and 11B, FIG. 11A is an illustration of a linear scale delta pressure graph 164*a* showing the change in pressure 43 measured in pounds per square foot (psf), i.e., delta pressure 52, in a linear scale for each of 1-18 cars 13, in series, of an embodiment of the vacuum transport tube vehicle system 10 (see FIG. 16) of the disclosure. FIG. 11B is an illustration of a logarithmic scale delta pressure graph 164*b* showing the change in pressure 43 measured in pounds per square foot (psf), i.e., delta pressure 52, delta pressure 52 in a logarithmic scale for each of 1-18 cars 13, in series, of an embodiment of the vacuum transport tube vehicle system 10 (see FIG. 16) of the disclosure. FIG. 11A shows plots of the delta pressure 52 in pounds per square foot (psf) of the 1-18 cars 13 for the orifice control 144, the speed control 146, and the constant pressure ratio 148 regimes. FIG. 11B shows plots of the delta pressure 52 in pounds per square foot (psf) of the 1-18 cars 13 for the orifice control 144, the speed control 146, and the constant pressure ratio 148 regimes. As shown in FIGS. 11A-11B, the delta pressure 52 is held constant in the orifice control 144 regime, decreases in the speed control 146 regime, and becomes very small in the constant pressure ratio 148 regime.

Figure 12B:
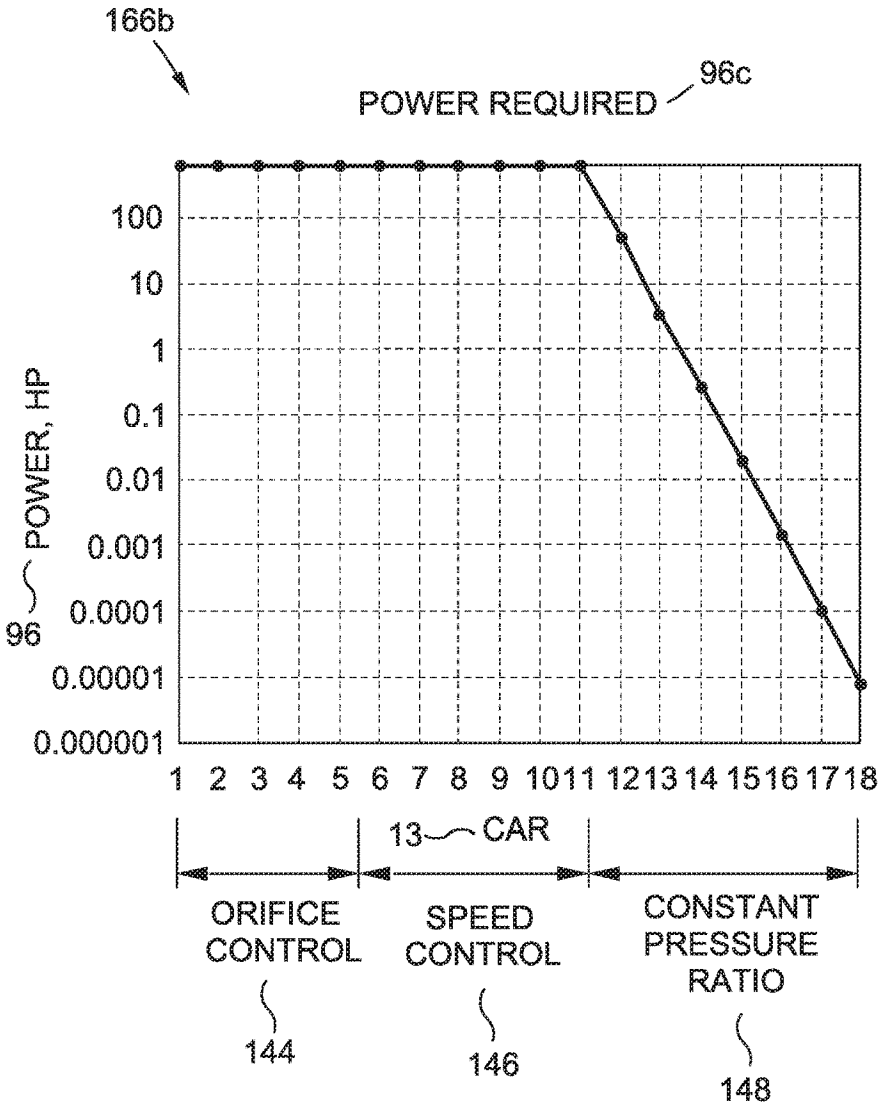
FIG. 12B is an illustration of a logarithmic scale power required graph showing power required for each car of an embodiment of the vacuum transport tube vehicle system of the disclosure.
Figure 12A:
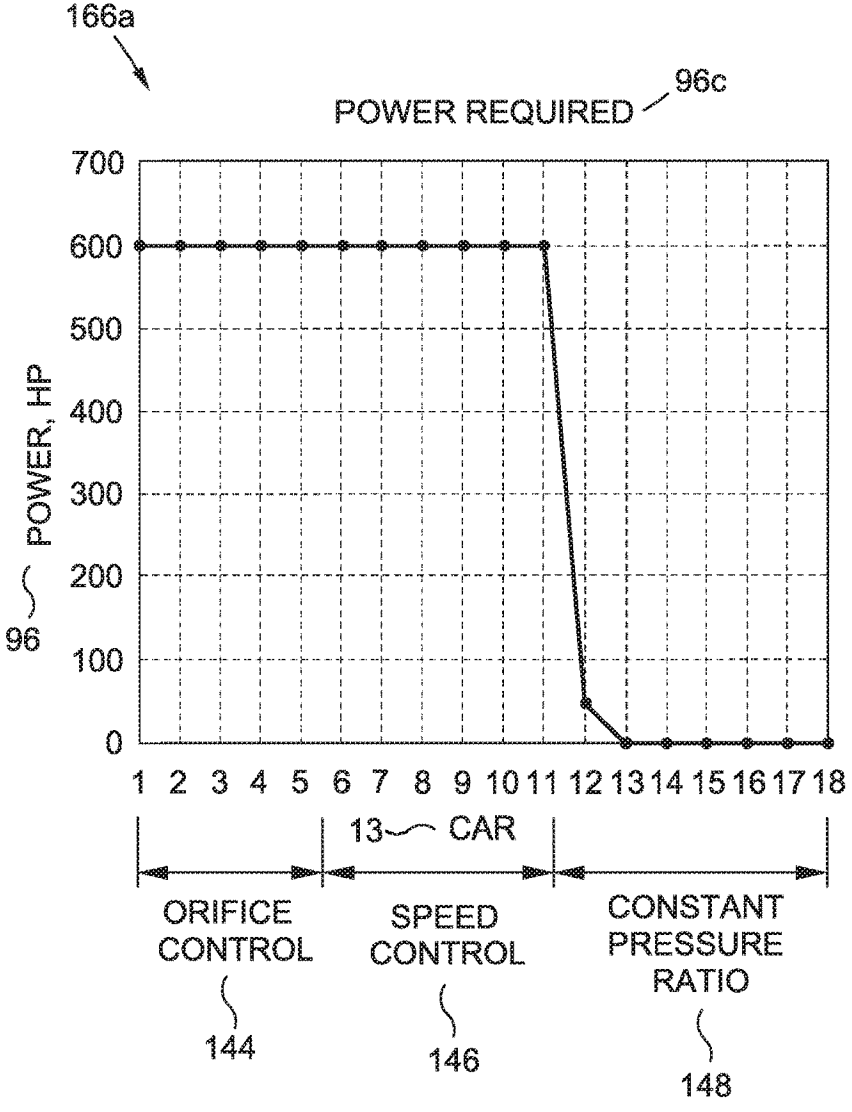
FIG. 12A is an illustration of a linear scale power required graph showing power required for each car of an embodiment of the vacuum transport tube vehicle system of the disclosure.

Now referring to FIGS. 12A and 12B, FIG. 12A is an illustration of a linear scale power required graph 166*a* showing power required 96*c* in a linear scale for each of 1-18 cars 13, in series, of an embodiment of the vacuum transport tube vehicle system 10 (see FIG. 16) of the disclosure. FIG. 12B is an illustration of a logarithmic scale power required graph 166*b* showing power required 96*c* in a logarithmic scale for each of 1-18 cars 13, in series, of an embodiment of the vacuum transport tube vehicle system 10 (see FIG. 16) of the disclosure. FIG. 12A shows power 96 in horsepower (hp) of the 1-18 cars 13 for the orifice control 144, the speed control 146, and the constant pressure ratio 148 regimes. FIG. 12A shows power 96 in horsepower (hp) of the 1-18 cars 13 for the orifice control 144, the speed control 146, and the constant pressure ratio 148 regimes. FIGS. 12A-12B show the power 96 in horsepower (hp) for the power required 96*c*, and the power 96 remains constant at 600 hp (horsepower) through the orifice control 144 and speed control 146 regimes, and decreases exponentially in the constant pressure ratio 148 regime.

Figure 13:
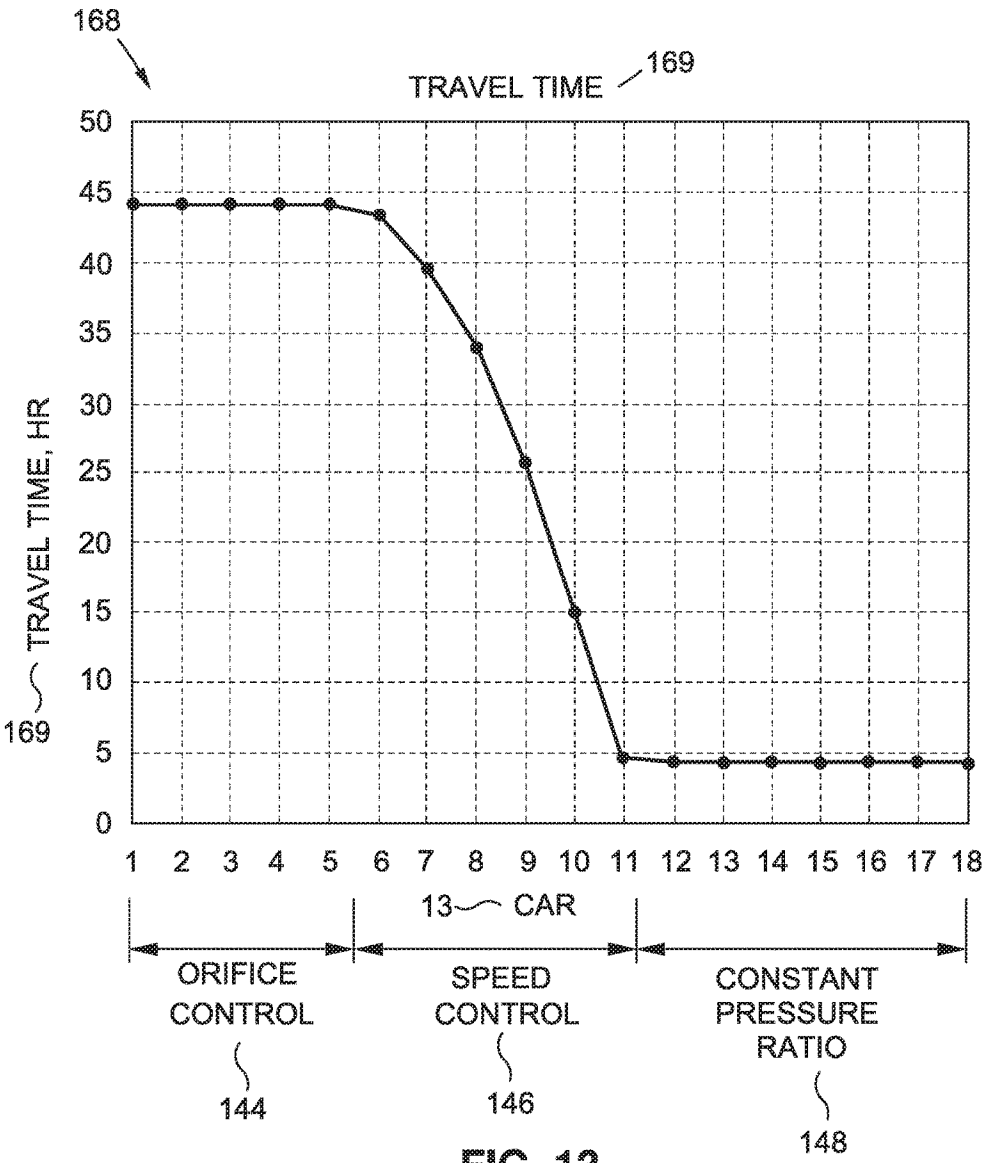
FIG. 13 is an illustration of a travel time graph showing travel time for each car of an embodiment of the vacuum transport tube vehicle system of the disclosure.

Now referring to FIG. 13, FIG. 13 is an illustration of a travel time graph 168 showing travel time 169 in hours (hr) for each of the 1-18 cars 13, in series, of an embodiment of the vacuum transport tube vehicle system 10 (see FIG. 16) of the disclosure. FIG. 13 shows plots of the travel time 169 in hours (hr) of the 1-18 cars 13 for the orifice control 144, the speed control 146, and the constant pressure ratio 148 regimes.

Now referring to FIGS. 14A-14I, FIGS. 14A-14I are illustrations of various conditions of a route end boundary assembly 170 for the vacuum transport tube vehicles 12 of an embodiment of the vacuum transport tube vehicle system 10 of the disclosure. As the various vacuum transport tube vehicles 12 (see FIGS. 14A-14I) reach a route end 38*a* (see FIGS. 14A-14I), of the vacuum transport tube route 38 (see FIGS. 14A-14I), through the vacuum transport tube 16 (see FIGS. 14A-14I), FIGS. 14A-14I show the various conditions of the route end boundary assembly 170 which are designed to accommodate the vacuum transport tube vehicles 12. As shown in FIGS. 14A-14I, the route end boundary assembly 170 comprises a first route end pressure barrier 172, a second route end pressure barrier 174 forward from the first route end pressure barrier 172, and a flapper valve 176 located between the first route end pressure barrier 172 and the second route end pressure barrier 174. The flapper valve 176 (see FIGS. 14A-14I) may be attached to the vacuum transport tube 16 to open and close a portion of the vacuum transport tube 16 to the outside air. Alternatively, the flapper valve 176 may exit to a plenum (not shown) which is evacuated with an evacuation apparatus or process, or the flapper valve 176 may be installed as a pressure barrier in the interior 34*a* (see FIG. 2A) of the vacuum transport tube 16, where the flapper valve pressure barrier extends a distance past the route end 38*a* (see FIGS. 14A-14I), or the flapper valve 176 may be attached or installed in another suitable manner.

Figure 14A:
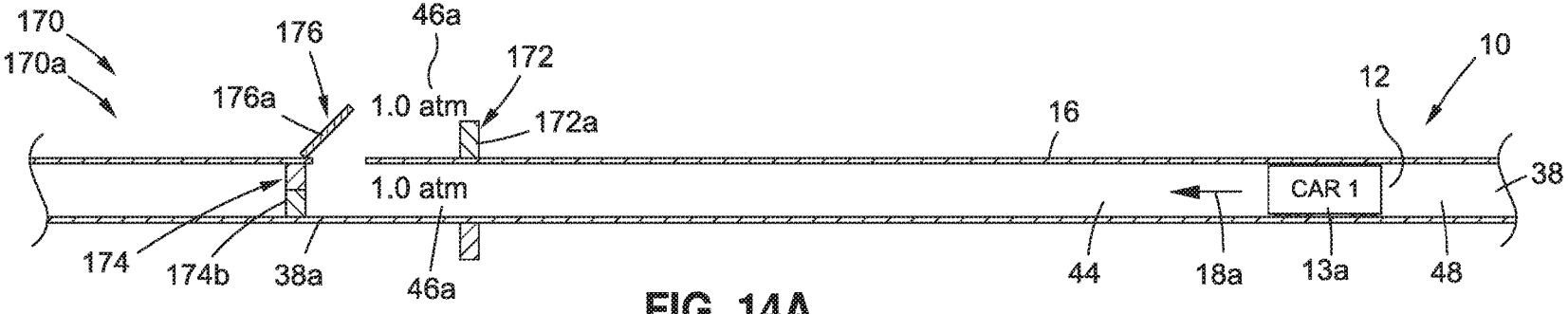
FIGS. 14A-14I are illustrations of various conditions of a route end boundary assembly for vacuum transport tube vehicles of the vacuum transport tube vehicle system of the disclosure.

As shown in FIG. 14A, the route end boundary assembly 170 is in a first car approaching from a distance condition 170*a*, where the vacuum transport tube vehicle 12, such as in the form of a first car 13*a*, approaches from a distance in a forward direction of travel 18*a* with a forward space 44 in front of the first car 13*a* and an aft space 48 behind the first car 13*a*. Since the pressure in the forward space 44 in front of the first car 13*a* is at an ambient pressure 46*a* of 1.0 atm. (one atmosphere), the vacuum transport tube 16 may be open to the outside ambient air 46*a* of 1.0 atm. (one atmosphere) with the flapper valve 176 in an open flapper valve position 176*a*. As shown in FIG. 14A, the first route end pressure barrier 172 is in an open first route end pressure barrier position 172*a*, and the second route end pressure barrier 174 is in a closed second route end pressure barrier position 174*b*.

Figure 14B:
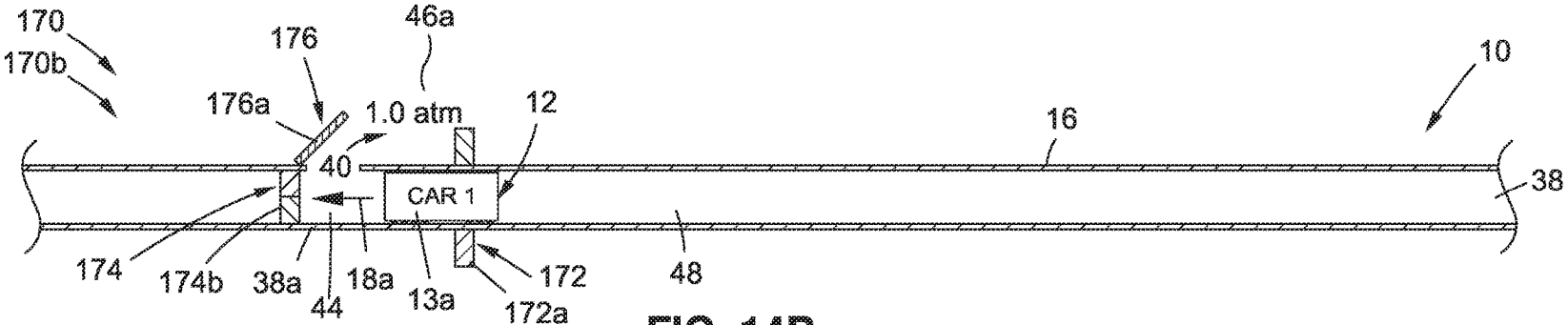

As shown in FIG. 14B, the route end boundary assembly 170 is in a first car approaching a flapper valve condition 170*b*, where the vacuum transport tube vehicle 12, such as in the form of first car 13*a*, approaches the flapper valve 176, which is in the open flapper valve position 176*a*, and where the first car 13*a* approaches the flapper valve 176 in the forward direction of travel 18*a* and pushes the air 40 in the forward space 44 in front of it and the flapper valve 176 in the open flapper valve position 176*a* allows the air 40 to escape from the vacuum transport tube 16 to the outside ambient air 46*a*, which is at a pressure of 1.0 atm. (one atmosphere). As shown in FIG. 14B, the first route end pressure barrier 172 is in the open first route end pressure barrier position 172*a*, and the second route end pressure barrier 174 is in the closed second route end pressure barrier position 174*b*.

Figure 14C:
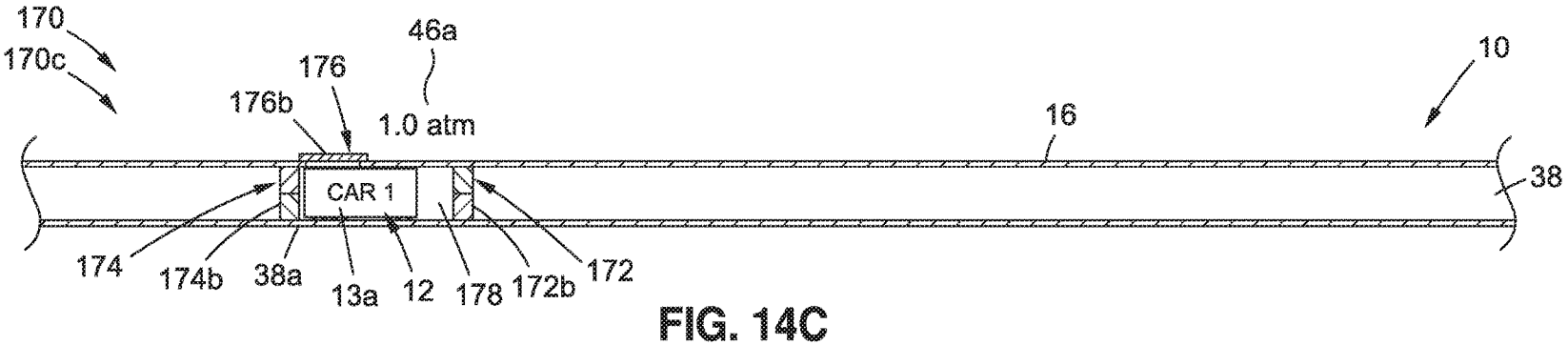

As shown in FIG. 14C, the route end boundary assembly 170 is in a first airlock condition 170*c*, where the vacuum transport tube vehicle 12, such as in the form of first car 13*a*, has evacuated all of the air 40 (see FIG. 14B) out of the vacuum transport tube 16 and the flapper valve 176 is in the closed flapper valve position 176*b*, so that the first car 13*a* is in an airlock 178. Outside the vacuum transport tube 16 is ambient air 46*a* at a pressure of 1.0 atm. (one atmosphere). As shown in FIG. 14C, the first route end pressure barrier 172 is in the closed first route end pressure barrier position 172*b*, and the second route end pressure barrier 174 is in the closed second route end pressure barrier position 174*b*, thus temporarily shutting off the route end 38*a* of the vacuum transport tube route 38 from the rest of the vacuum transport tube 16.

Figure 14D:
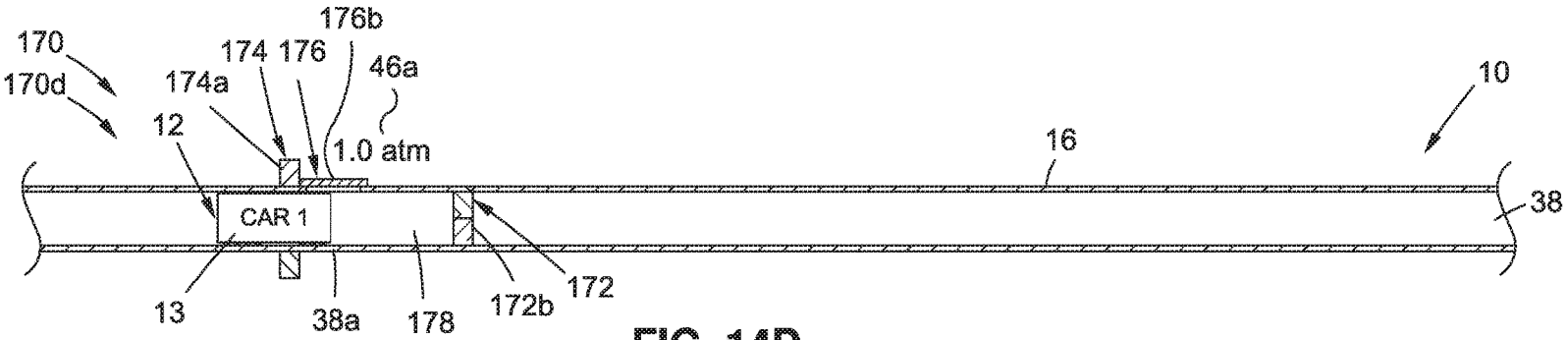

As shown in FIG. 14D, the route end boundary assembly 170 is in a first car exit condition 170*d*, where the vacuum transport tube vehicle 12, such as in the form of first car 13*a*, exits the airlock 178 at the route end 38*a* through the second route end pressure barrier 174 which is in the open second route end pressure barrier position 174*a*. FIG. 14D further shows the flapper valve 176 in the closed flapper valve position 176*b*, the first route end pressure barrier 172 in the closed first route end pressure barrier position 172*b*, and ambient air 46*a* at a pressure of 1.0 atm. (one atmosphere) outside the vacuum transport tube 16.

Figure 14E:
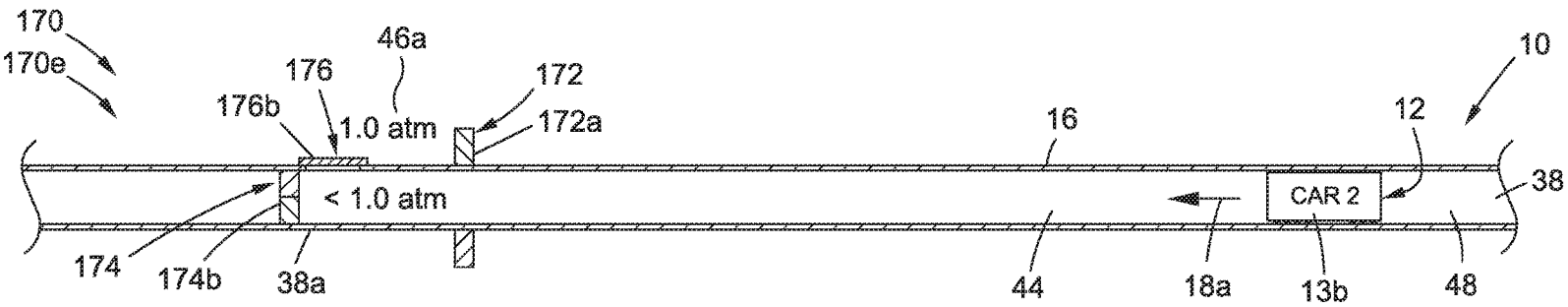

As shown in FIG. 14E, the route end boundary assembly 170 is in a second car approaching from a distance condition 170*e*, where the vacuum transport tube vehicle 12, such as in the form of a second car 13*b*, approaches from a distance in a forward direction of travel 18*a* with a forward space 44 in front of the second car 13*b* and an aft space 48 behind the second car 13*b*. Since the pressure in the forward space 44 in front of the second car 13*b* (and behind the first car 13*a* (see FIG. 14D)) is less than 1.0 atm. (one atmosphere), it is necessary that the flapper valve 176 remain in the closed flapper valve position 176*b*. Otherwise air 40 (see FIGS. 14B, 14F) would flow from the outside, which is at ambient pressure 46*a* of 1.0 atm. (one atmosphere), to the interior 34*a* (see FIG. 2A) or inside of the vacuum transport tube 16, which is at a less than ambient pressure 46*a*. As further shown in FIG. 14E, the first route end pressure barrier 172 is in the open first route end pressure barrier position 172*a*, and the second route end pressure barrier 174 is in the closed second route end pressure barrier position 174*b*.

Figure 14F:
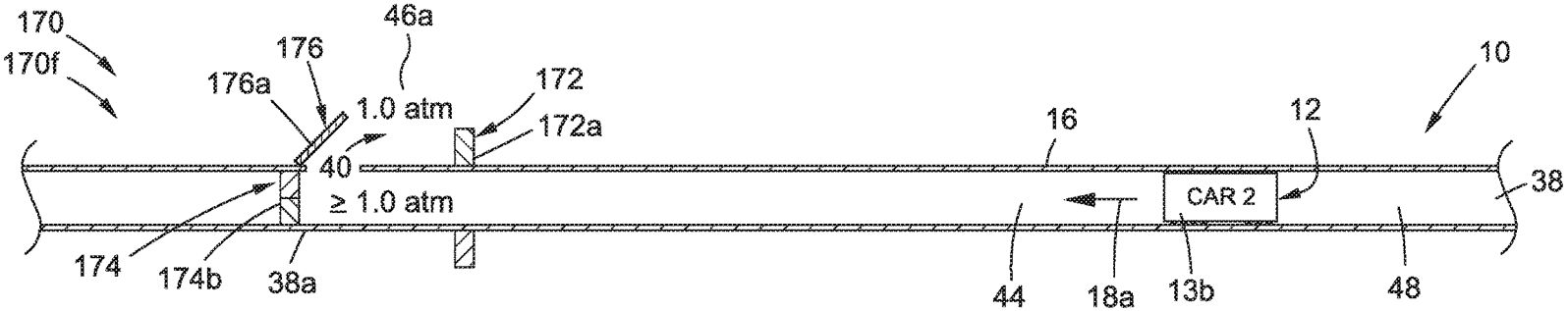

As shown in FIG. 14F, the route end boundary assembly 170 is in an air compressed condition 170*f*. Since the air 40 (see FIG. 14F) in the forward space 44 (see FIG. 14F) in front of the vacuum transport tube vehicle 12 (see FIG. 14F), such as in the form of second car 13*b* (see FIG. 14F), is enclosed by a volume or space that is decreasing, at some point in time, the pressure in the forward space 44 (see FIG. 14F) in front of the second car 13*b* (see FIG. 14F) increases, so that it is greater than or equal to 1.0 atm. (one atmosphere), which is greater than or equal to the ambient pressure 46*a* of 1.0 atm. (one atmosphere) outside the vacuum transport tube 16 (see FIG. 14F). As further shown in FIG. 14F, at the time the air 40 is compressed and the pressure increases inside the vacuum transport tube 16, the flapper valve 176 opens to the open flapper valve position 176*a*, so that the air 40 is allowed to flow outside the vacuum transport tube 16 and escape. At the time that this happens, the behavior and operation of the second car 13*b* (see FIG. 14F) is identical to that of the first car 13*a* (see FIG. 14D) when it was in the first car approaching a flapper valve condition 170*b* (see FIG. 14B). As further shown in FIG. 14F, the first route end pressure barrier 172 is in the open first route end pressure barrier position 172*a*, and the second route end pressure barrier 174 is in the closed second route end pressure barrier position 174*b*.

Figure 14G:
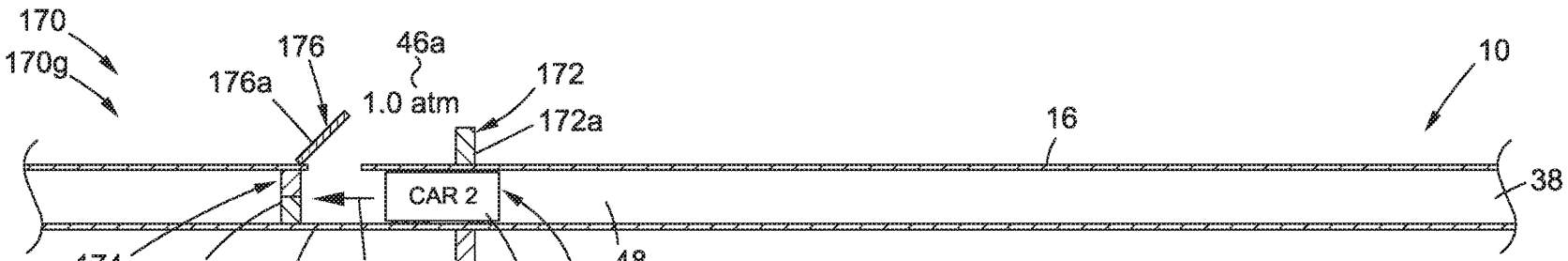

As shown in FIG. 14G, the route end boundary assembly 170 is in a second car approaching a flapper valve condition 170*g*, where the vacuum transport tube vehicle 12, such as in the form of second car 13*b*, approaches the flapper valve 176, which is in the open flapper valve position 176*a*, and where the second car 13*a* approaches the flapper valve 176 in the forward direction of travel 18*a* and pushes the air 40 (see FIG. 14F) in the forward space 44 (see FIG. 14F) in front of it, and the flapper valve 176 in the open flapper valve position 176*a* allows the air 40 (see FIG. 14F) to escape from the vacuum transport tube 16 to the outside ambient air 46*a*, which is at a pressure of 1.0 atm. (one atmosphere). As shown in FIG. 14G, the first route end pressure barrier 172 is in the open first route end pressure barrier position 172*a*, and the second route end pressure barrier 174 is in the closed second route end pressure barrier position 174*b*.

Figure 14H:
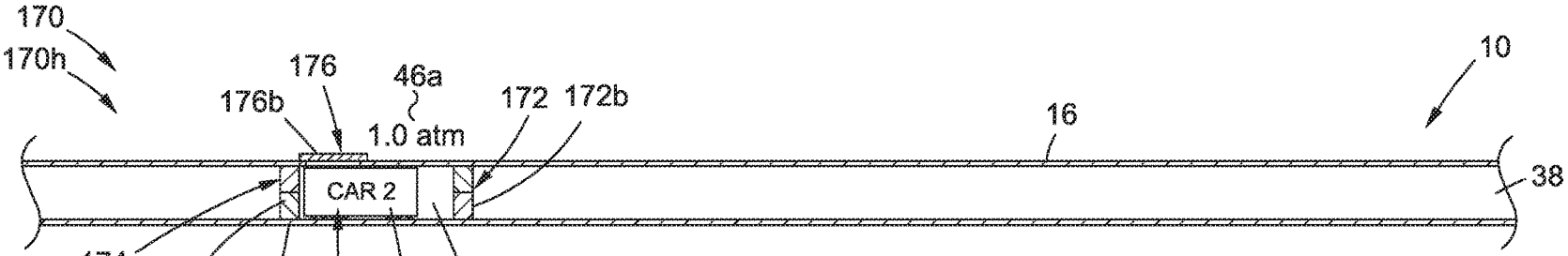

As shown in FIG. 14H, the route end boundary assembly 170 is in a second airlock condition 170*h*, where the vacuum transport tube vehicle 12, such as in the form of second car 13*b*, has evacuated all of the air 40 (see FIG. 14F) out of the vacuum transport tube 16 and the flapper valve 176 is in the closed flapper valve position 176*b*, so that the second car 13*b* is in an airlock 178. Outside the vacuum transport tube 16 is ambient air 46*a* at a pressure of 1.0 atm. (one atmosphere). As shown in FIG. 14H, the first route end pressure barrier 172 is in the closed first route end pressure barrier position 172*b*, and the second route end pressure barrier 174 is in the closed second route end pressure barrier position 174*b*, thus temporarily shutting off the route end 38*a* of the vacuum transport tube route 38 from the rest of the vacuum transport tube 16.

Figure 14I:
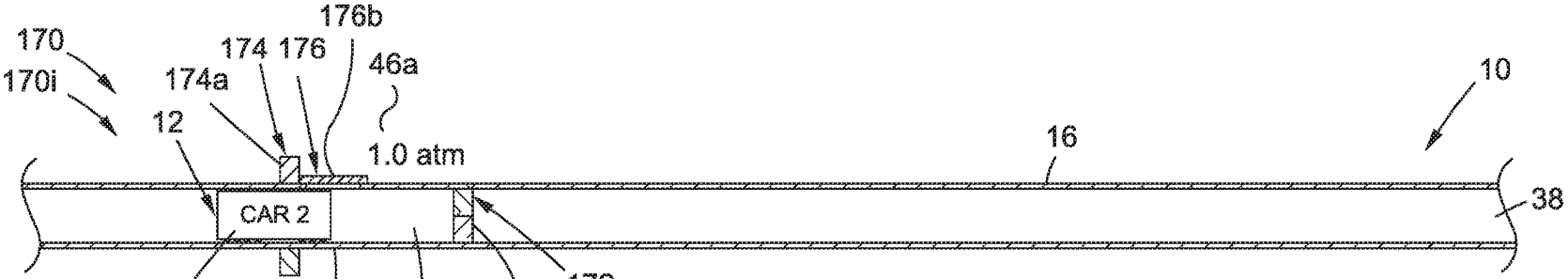

As shown in FIG. 14I, the route end boundary assembly 170 is in a second car exit condition 170*i*, where the vacuum transport tube vehicle 12, such as in the form of second car 13*b*, exits the airlock 178 at the route end 38*a* through second route end pressure barrier 174 which in the open second route end pressure barrier position 174*a*. FIG. 14I further shows the flapper valve 176 in the closed flapper valve position 176*b*, the first route end pressure barrier 172 in the closed first route end pressure barrier position 172*b*, and ambient air 46*a* at a pressure of 1.0 atm. (one atmosphere) outside the vacuum transport tube 16.

At the route end 38*a* (see FIGS. 14A-14I) for the cars 13 (see FIGS. 3A, 16) after the first car 13*a* (see FIG. 14A), the outside atmosphere of 1.0 atm. will result in a delta pressure 52 (see FIG. 16), or pressure differential, that may exceed the power 96 (see FIG. 16) of the electric motor 112 (see FIG. 2B), if the same speed 94 (see FIG. 16) is maintained. Several ways of resolving these route end 38*a* (see FIGS. 14A-14I) conditions may be used. One way includes having the previous cars 13 (see FIGS. 3A, 16) "back up" along the vacuum transport tube route 38 (see FIGS. 14A-14I) to re-evacuate the last section of the vacuum transport tube route 38 as the successive cars 13 cause the pressure 43 (see FIG. 16) to build up before them. Another way includes slowing the cars 13 (see FIGS. 3A, 16) down as the pressure 43 (see FIG. 16) builds up. Another way includes having the flapper valve 176 exit to a plenum which is evacuated by a suitable evacuation apparatus or process. This may be achieved by having the flapper valve 176 installed as a barrier internal to the vacuum transport tube 16 that extends for some distance past the route end 38*a* (see FIGS. 14A-14I). This section of the vacuum transport tube 16 may be evacuated by the first sequence or series of cars 13.

Figure 15:
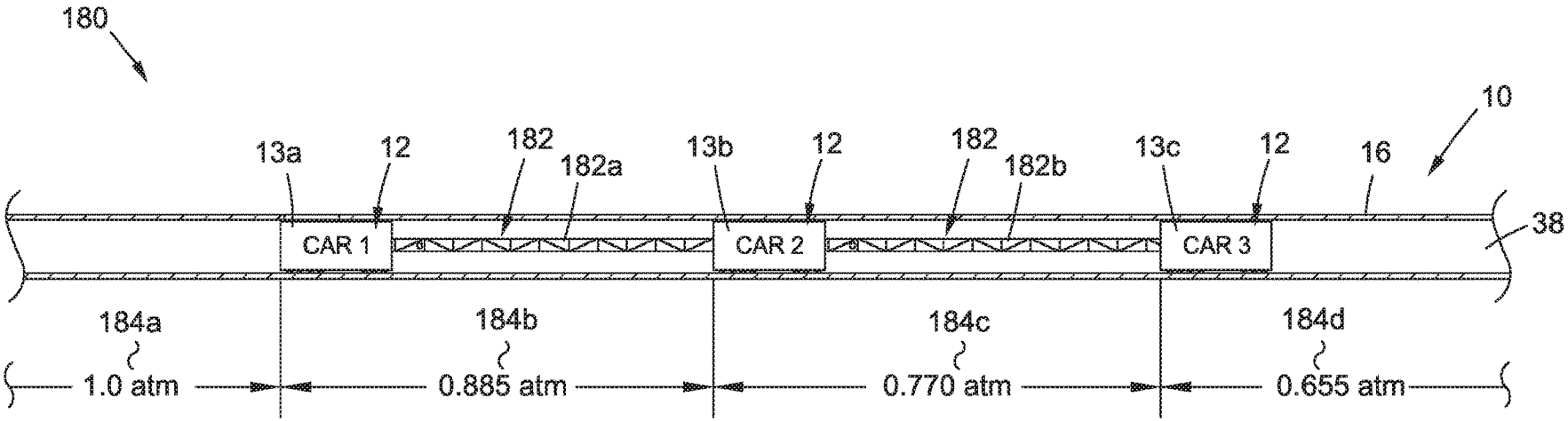
FIG. 15 is an illustration of another embodiment of the vacuum transport tube vehicle system of the disclosure, in the form of a multi-stage vehicle arrangement.

Now referring to FIG. 15, FIG. 15 is an illustration of another embodiment of the vacuum transport tube vehicle system 10 of the disclosure, in the form of a multi-stage vehicle arrangement 180. In a manner similar to how pumps may be staged, the vacuum transport tube vehicle 12 (see FIG. 15) may also be staged, so that several pressure reductions may be accomplished by a single multi-stage vehicle arrangement 180, as shown in FIG. 15. For example, as shown in FIG. 15, a first zone 184*a* in front of the first car 13*a* has a pressure of 1.0 atm. (atmosphere), a second zone 184*b* behind the first car 13*a* and in front of the second car 13*b* has a reduced pressure of 0.885 atm, a third zone 184*c* behind the second car 13*b* and in front of the third car 13*c* has a further reduced pressure of 0.770 atm., and a fourth zone 184*d* behind the third car 13*c* has an even further reduced pressure of 0.655 atm. The distances between the various cars 13 of the series may be set to minimize concerns of turbulence in the air flow between one car 13 and a subsequent car 13.

FIG. 15 shows an exemplary multi-stage vehicle arrangement 180 with three (3) vacuum transport tube vehicles 12, including the first car 13*a*, a second car 13*b*, and a third car 13*c*, connected to each other in a series. Additional cars 13 may also be subsequently connected in the series. As shown in FIG. 15, the first car 13*a* is connected to the second car 13*b* via a connector element 182, such as a structural connector element. The connector element 182, such as a structural connector element, may comprise a first connector 182*a*, for example, a structural connector element, apparatus, or device that structurally connects the cars together. As shown in FIG. 15, the second car 13*a* is connected to the third car 13*c* via a connector element 182, such as a structural connector element. The connector element 182, such as the structural connector element, may comprise a second connector 182*b*, for example, a structural connector element, apparatus, or device that structurally connects the cars together. A magnetic levitation (mag-lev) propulsion system 24 (see FIG. 1B) may be used with the multi-stage vehicle arrangement 180, or another suitable type of propulsion may be attached to the connector elements 182 (see FIG. 15), or they may even be separate cars 13 (not shown). The multi-stage vehicle arrangement 180 (see FIG. 15) allows the vacuum transport tube vehicle system 10 to be modular. The propulsion may be evenly distributed among the vacuum transport tube vehicles 12, such as the cars 13, or it may be concentrated in one vacuum transport tube vehicle 12, or car 13, such as the first car 13*a* (see FIG. 15). The horsepower requirements for the multi-stage vehicle arrangement 180 are preferably the sum of the requirements for each vacuum transport tube vehicle 12, or car 13, for example, 1800 horsepower, or another suitable power amount.

Now referring to FIG. 16, FIG. 16 is an illustration of a functional block diagram of an exemplary embodiment of a vacuum transport tube vehicle system 10 of the disclosure. As shown in FIG. 16, and as discussed above, the vacuum transport tube vehicle system 10 comprises a vacuum transport tube 16, or a plurality of vacuum transport tubes 16, such as a first vacuum transport tube 16*a* (see FIG. 1A) and a second vacuum transport tube 16*b* (see FIG. 1A). As shown in FIG. 16, the vacuum transport tube 16 (see FIG. 16) has an interior 32*a*, an exterior 32*b*, an inner surface 34*a*, an outer surface 34*b*, a cylindrical body 36, a vacuum transport tube inner diameter 31 (see also FIG. 2C), and a perimeter 35. The vacuum transport tube 16 (see FIG. 16) has a vacuum transport tube route 38 (see FIG. 16) having a route length 36 (see FIG. 16) and a route end 38*a* (see FIG. 16).

As further shown in FIG. 16, vacuum transport tube vehicle system 10 comprises one or more vacuum transport tube vehicles 12, as discussed in detail above, configured for moving or traveling through the interior 32*a* of the vacuum transport tube 16 and evacuating air 40 from the interior 32*a* of the vacuum transport tube 16 over a route length 36 of a vacuum transport tube route 38, to create and maintain a vacuum 42 within the vacuum transport tube 16. The vacuum transport tube vehicle system 10 preferably comprises an amount of ten (10) vacuum transport tube vehicles 12 to twenty (20) vacuum transport tube vehicles 12, and more preferably, three (3) vacuum transport tube vehicles 12 to twenty (20) vacuum transport tube vehicles 12, installed or arranged in series, or in succession, separately or attached together, within the vacuum transport tube 16. The vacuum transport tube vehicle system 10 may comprise a single vacuum transport tube vehicle 12 that makes multiple vehicle passes 53 (see FIG. 16), or may comprise any combination of 2 to 20, or more, vacuum transport tube vehicles 12 or cars 13 each making one or more vehicle passes 53 through the vacuum transport tube 16, where the pressure 43 inside the vacuum transport tube 16 is successively reduced, or further reduced, with each vehicle pass 53.

As further shown in FIG. 16, each of the one or more vacuum transport tube vehicles 12 may be in form of a car 13, and comprises a first end 54 comprising a piston head 54*a*. The first end 54 (see FIG. 16) has a first end outer diameter 56 (see FIG. 16) having a length 56*a* (see FIG. 16), and a first end outer surface 58 (see FIG. 2E), wherein when each vacuum transport tube vehicle 12 is installed in the vacuum transport tube 16, an annular gap 116 (see also FIG. 2B) is formed between the inner surface 34*a* of the vacuum transport tube 16 and the first end outer surface 58.

As shown in FIG. 16, the annular gap 116 has a gap distance 118, a gap area 120, a gap flow speed 122, and a gap volume 119. The annular gap 116 (see FIG. 16) preferably has a gap distance 118 (see FIG. 16) in a range of from about 0.25 inch to about 1.0 inch between the inner surface 34*a* of the vacuum transport tube 16 and the first end outer surface 58 at the first end 54 of the vacuum transport tube vehicle 12, when the vacuum transport tube vehicle 12 is installed in the interior 32*a* of the vacuum transport tube 16.

As further shown in FIG. 16, the first end 54, such as in the form of piston head 54*a*, has a forward surface 60, an aft surface 61, and a side profile 62. As further shown in FIG. 16, the forward surface 60 may comprise a flat forward surface 60*a* with a flat side profile 62*a*, or a curved forward surface 60*b* with a curved side profile 62*b*, such as including, a convex forward surface 60*c* with a convex side profile 62*c* or a concave forward surface 60*d* with a concave side profile 62*d*, or the forward surface 60 may comprise another suitable forward surface with a suitable side profile. Preferably, the flat forward surface 60*a* (see FIG. 16) is a circular shape 64 (see FIG. 2F). However, the forward surface 60 may comprise another suitable shape.

As further shown in FIG. 16, each vacuum transport tube vehicle 12 comprises a second end 66 having a second end outer diameter 68 with a length 68*a*, and having a second end outer surface 69. As further shown in FIG. 16, each vacuum transport tube vehicle 12 comprises a body 70 disposed between the first end 54 and the second end 66, where the body 70 comprises a piston 70*a* having a structural framework 72.

As further shown in FIG. 16, each vacuum transport tube vehicle 12 comprises at least one orifice 84, such as in the form of a passageway 84*a*, extending from a first inlet portion 86 (see FIG. 2F) in the first end 54 through to a second outlet portion 88 (see FIG. 2F) of the vacuum transport tube vehicle 12, such as formed through the body 70 and through to the second end 66. The at least one orifice 84 (see FIG. 16) is configured to allow air 40 (see FIG. 16) to flow from a forward space 44 (see FIG. 2A) in front of the vacuum transport tube vehicle 12 (see FIG. 16) to an aft space 48 (see FIG. 2A) behind the vacuum transport tube vehicle 12, to create a delta pressure 52 (see FIG. 16) between a forward pressure ($P_{fwd}$) 46 (see FIGS. 2A, 16) in the forward space 44 and an aft pressure ($P_{aft}$) 50 (see FIGS. 2A, 16) in the aft space 48, such that the aft pressure ($P_{aft}$) 50 is lower than the forward pressure ($P_{fwd}$) 46, and the forward pressure ($P_{fwd}$) 46 is higher than the aft pressure ($P_{aft}$) 50, with each successive vehicle pass 53 (see FIG. 16), the pressure, such as the aft pressure ($P_{aft}$) 50, is further reduced.

As further shown in FIG. 16, each vacuum transport tube vehicle 12 comprises a drive assembly 100 coupled to the body 70 for driving each vacuum transport tube vehicle 12 through the vacuum transport tube 16. In one embodiment, the drive assembly 100 comprises a plurality of drive wheels 102 (see FIG. 2D) arranged in a circumferential arrangement 104 (see FIG. 2D) around the body 70 (see FIGS. 2A, 2D), the plurality of drive wheels 102 being in contact with the inner surface 34*a* of the vacuum transport tube 16, when the vacuum transport tube vehicle 12 travels through the vacuum transport tube 16.

In another embodiment, the drive assembly 100 (see FIG. 16) comprises a magnetic levitation (mag-lev) propulsion system 24 (see FIGS. 1B, 16) comprising a plurality of guide magnets 26 (see FIG. 1B) and a plurality of vehicle magnets 28 (see FIG. 1B) to create both lift and substantially frictionless propulsion to move the one or more vacuum transport tube vehicles 12 through the vacuum transport tube 16.

As further shown in FIG. 16, each vacuum transport tube vehicle 12 comprises a power system 110 coupled to the drive assembly 100 for powering the drive assembly 100. In one embodiment, the power system 110 (see FIG. 16) comprises one or more electric motors 112 (see FIG. 2B) coupled to one or more of the plurality of drive wheels 102. The power system 110 (see FIG. 16) may comprise other suitable power elements.

When each of the one or more vacuum transport tube vehicles 12 (see FIG. 16) makes one or more vehicle passes 53 (see FIG. 16) through the interior 32*a* (see FIG. 16) of the vacuum transport tube 16 (see FIG. 16), pressure 43 (see FIG. 16) in the interior 32*a* of the vacuum transport tube 16 is successively reduced with each successive vehicle pass 53, until a desired pressure 43*a* (see FIG. 16) is obtained.

The operational regimes of the one or more vacuum transport tube vehicles 12 (see FIG. 16), including orifice control 144 (see FIGS. 7A-13), speed control 146 (see FIGS. 7A-13), and constant pressure ratio 148 (see FIGS. 7A-13), as well as other measurement, for the vacuum transport tube vehicle system 10 (see FIG. 16), may be measured, calculated, and/or quantified using various parameters, including, as shown in FIG. 16, pressure 43, such as air pressure 43*b* and atmospheric pressure 43*c*, forward pressure 46, ambient pressure 46*a*, aft pressure 50, delta pressure 52, velocity 142, speed 94, minimum speed 94*a*, maximum speed 94*b*, forward speed 94*c*, power 96, maximum power 96*a*, power required 96*c*, force 126, gap volume 119, piston volume 124, orifice volume 128, total flow volume 129, gap distance 118, gap area 120, gap flow speed 122, as well as other suitable parameters, discussed above.

As further shown in FIG. 16, the vacuum transport tube vehicle system 10 provides for pump elimination 186 of pumps, seal elimination 188 of seals, such as pressure seals or modular pressure seals, and close tolerance manufacturing elimination 190 of an interface 192 between the inner surface 34*a* of the vacuum transport tube 16 and each vacuum transport tube vehicle 12, as compared to existing vacuum transport tube evacuation systems and methods that use expensive pumps, expensive seals, and/or close manufacturing tolerances.

As further shown in FIG. 16, the vacuum transport tube vehicle system 10 comprises one or more pressure barriers 136 (see also FIG. 3A) positioned in the interior 32*a* of the vacuum transport tube 16 and positioned or located aft of the one or more vacuum transport tube vehicles 12. The one or more pressure barriers 136 may comprise solid steel plates that are not susceptible to air leaks, or another suitable type of pressure barrier.

As further shown in FIG. 16, the vacuum transport tube vehicle system 10 may further comprise a route end boundary assembly 170 positioned at a route end 38*a* of the vacuum transport tube route 38. As shown in FIGS. 14A-14I, discussed in detail above, the route end boundary assembly 170 comprises a first route end pressure barrier 172, a second route end pressure barrier 174, and a flapper valve 176.

In another embodiment, as shown in FIG. 16, the vacuum transport tube vehicle system 10 may comprise a multi-stage vehicle arrangement 180 (see FIGS. 15, 16), as discussed in detail above. The multi-stage vehicle arrangement 180 comprises two or more vacuum transport tube vehicles 12 connected together, in series or in succession, via one or more connector elements 182 (see FIG. 15) to form the multi-stage vehicle arrangement 180 which may function as a single vehicle.

Figure 17:
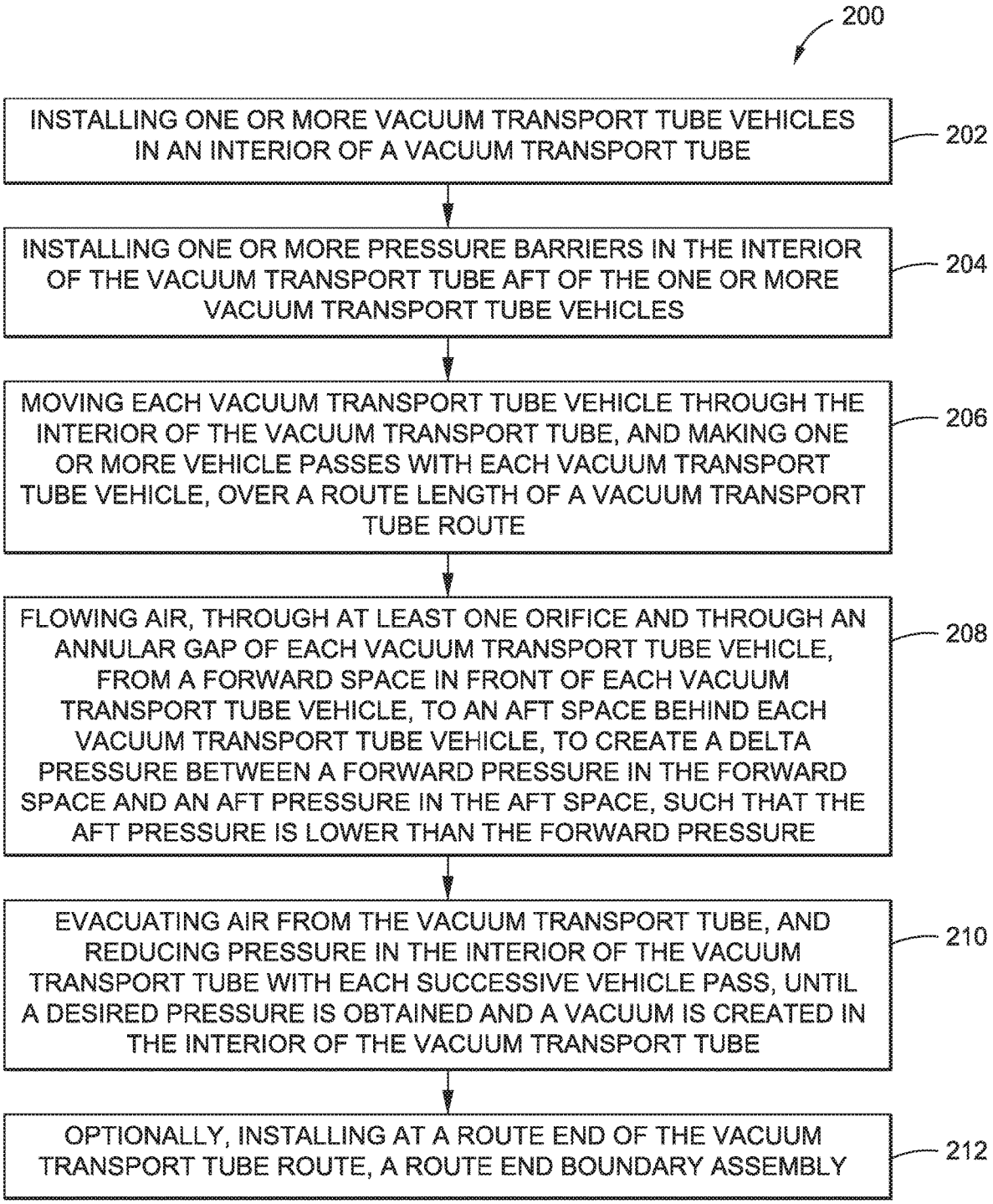
FIG. 17 is an illustration of a flow diagram showing an exemplary embodiment of a method of the disclosure.

Now referring to FIG. 17, FIG. 17 is an illustration of a flow diagram showing an exemplary embodiment of a method 200 of the disclosure. In another embodiment, there is provided the method 200 (see FIG. 17) of evacuating a vacuum transport tube 16 (see FIG. 2A), such as initially evacuating air 40 (see FIG. 2A) from a vacuum transport tube 16 (see FIG. 2A), to create a vacuum 42 (see FIG. 16) within the vacuum transport tube 16.

As shown in FIG. 17, the method 200 comprises step 202 of installing one or more vacuum transport tube vehicles 12 (see FIG. 2A) in an interior 32*a* (see FIG. 2A) of the vacuum transport tube 16 (see FIG. 2A). The vacuum transport tube 16 (see FIG. 2A) has an inner surface 34*a* (see FIG. 2A) and an outer surface 34*b* (see FIG. 2A).

As discussed in detail above, each of the one or more vacuum transport tube vehicles 12 (see FIG. 2B) comprises a first end 54 (see FIG. 2B) comprising a piston head 54*a* (see FIG. 2B). The first end 54 having a first end outer diameter 56 (see FIG. 2B) and a first end outer surface 58 (see FIG. 2B). An annular gap 116 (see FIG. 2B) is formed between the first end outer surface 58 (see FIG. 2B) and the inner surface 34*a* (see FIG. 2B) of the vacuum transport tube 16 (see FIG. 2B).

Each of the one or more vacuum transport tube vehicles 12 (see FIG. 2B) further comprises a second end 66 (see FIG. 2B) having a second end outer diameter 68 (see FIG. 2B). Each of the one or more vacuum transport tube vehicles 12 (see FIG. 2B) further comprises a body 70 (see FIG. 2B) disposed between the first end 54 and the second end 66. The body 70 (see FIG. 2B) comprises a piston 70*a* (see FIG. 2B) having a structural framework 72 (see FIG. 2B).

Each of the one or more vacuum transport tube vehicles 12 (see FIG. 2B) further comprises at least one orifice 84 (see FIG. 2B), as discussed above, extending from a first inlet portion 86 (see FIG. 2F) in the first end 54 (see FIGS. 2B, 2F) through to a second outlet portion 88 (see FIGS. 2B, 2F) of the vacuum transport tube vehicle 12 (see FIGS. 2B, 2F). The second outlet portion 88 (see FIG. 2F) is positioned aft of the first inlet portion 86 (see FIG. 2F).

Each of the one or more vacuum transport tube vehicles 12 (see FIG. 2B) further comprises a drive assembly 100 (see FIG. 2B), as discussed above, coupled to the body 70 (see FIG. 2B) for driving the vacuum transport tube vehicle 12 (see FIG. 2B) through the vacuum transport tube 16 (see FIG. 2B). Each of the one or more vacuum transport tube vehicles 12 (see FIG. 2B) further comprises a power system 110 (see FIG. 2B) coupled to the drive assembly 100 (see FIG. 2B) for powering the drive assembly 100 (see FIG. 2B).

The step of installing 202 (see FIG. 17) one or more vacuum transport tube vehicles 12 (see FIG. 2A) in the interior 32*a* (see FIG. 2A) of the vacuum transport tube 16 (see FIG. 2A) comprises preferably installing an amount of ten (10) vacuum transport tube vehicles 12, or less, depending on if the power available to each car is increased (i.e., increased power per car may decrease the number of cars), to twenty (20) vacuum transport tube vehicles 12, such as cars 13 (see FIG. 16) in series, or in succession, within the vacuum transport tube 16. More preferably, the step of installing 202 comprises installing an amount of three (3) vacuum transport tube vehicles 12 to twenty (20) vacuum transport tube vehicles 12, such as cars 13 (see FIG. 16) in series, or in succession, within the vacuum transport tube 16. However, the vacuum transport tube vehicle system 10 may comprise more than twenty (20) vacuum transport tube vehicles 12, or cars 13, or one to nine (1-9) vacuum transport tube vehicles 12, or cars 13, within the vacuum transport tube 16.

The step of installing 202 (see FIG. 17) one or more vacuum transport tube vehicles 12 (see FIG. 2A) in the interior 32*a* (see FIG. 2A) of the vacuum transport tube 16 (see FIG. 2A) may comprise, in one embodiment, installing a multi-stage vehicle arrangement 180 (see FIG. 15) comprising two or more vacuum transport tube vehicles 12 (see FIG. 15) connected together, in series, or in succession, within the transport tube vehicle 16 (see FIG. 15). The multi-stage vehicle arrangement 180 is discussed in detail above in connection with FIG. 15.

As shown in FIG. 17, the method 200 further comprises step 204 of installing one or more pressure barriers 136 (see FIG. 3A) in the interior 32*a* (see FIG. 2A) of the vacuum transport tube 16 (see FIGS. 2A, 3A) aft of the one or more vacuum transport tube vehicles 12 (see FIGS. 2A, 3A).

As shown in FIG. 17, the method 200 further comprises step 206 of moving each vacuum transport tube vehicle (12) through the interior (32*a*) of the vacuum transport tube (16), and making one or more vehicle passes (53) with each vacuum transport tube vehicle (12) over a route length (36) of a vacuum transport tube route (38. The step of moving 206 (see FIG. 18) each vacuum transport tube vehicle 12 through the interior 32*a* of the vacuum transport tube 16 may comprise, in one embodiment, moving each vacuum transport tube vehicle 12 with the drive assembly 100 (see FIG. 2D) comprising a plurality of drive wheels 102 (see FIG. 2D) arranged in a circumferential arrangement 104 (see FIG. 2D) around the body 70 (see FIG. 2D).

The step of moving 206 (see FIG. 18) each vacuum transport tube vehicle 12 through the interior 32*a* of the vacuum transport tube 16 may comprise, in another embodiment, moving each vacuum transport tube vehicle 12 via a magnetic levitation (mag-lev) propulsion system 24 (see FIGS. 1B, 16) comprising a plurality of guide magnets 26 (see FIG. 1B) and a plurality of vehicle magnets 28 (see FIG. 1B), to create both lift and substantially frictionless propulsion to move each vacuum transport tube vehicle 12 (see FIG. 2A) through the vacuum transport tube 16 (see FIG. 2A).

As shown in FIG. 17, the method 200 further comprises step 208 of flowing air 40 (see FIG. 2B), through the at least one orifice 84 (see FIG. 2B) and through the annular gap 116 (see FIG. 2B) of each vacuum transport tube vehicle 12 (see FIG. 2B), from a forward space 44 (see FIG. 2B) in front of each vacuum transport tube vehicle 12 (see FIG. 2B), to an aft space 48 (see FIG. 2B) behind each vacuum transport tube vehicle 12, to create a delta pressure 52 (see FIG. 16) between a forward pressure 46 (see FIG. 2A) in the forward space 44 (see FIGS. 2A, 2B) and an aft pressure 50 (see FIG. 2A) in the aft space 48 (see FIGS. 2A, 2B), such that the aft pressure 50 is lower than the forward pressure 46, as the vacuum transport tube vehicle 12 moves.

The step of flowing 208 (see FIG. 17) air 40 (see FIG. 2B) through the annular gap 116 (see FIG. 2B) comprises flowing air 40 through the annular gap 116 having a gap distance 118 (see FIG. 2C) in a range of from about 0.25 inch to about 1.0 inch between the inner surface 34*a* (see FIG. 2A) of the vacuum transport tube 16 (see FIG. 2A) and the first end outer surface 58 (see FIG. 2B) at the first end 54 (see FIG. 2E) of the vacuum transport tube vehicle 12 (see FIG. 2E), when the vacuum transport tube vehicle 12 is installed in or moving or traveling through the interior 32*a* of the vacuum transport tube 16.

As shown in FIG. 17, the method 200 further comprises step 210 of evacuating air 40 (see FIG. 2A) from the vacuum transport tube 16 (see FIG. 2B), and reducing pressure 43 (see FIG. 7A) in the interior 32*a* (see FIG. 2A) of the vacuum transport tube 16 (see FIG. 2A) with each successive vehicle pass 53 (see FIG. 16), until a desired pressure 43*a* (see FIG. 16) is obtained and a vacuum 42 (see FIG. 16)

is created in the interior 32*a* (see FIG. 2A) of the vacuum transport tube 16 (see FIG. 2A).

As shown in FIG. 17, the method 200 further comprises optional step 212 of installing at a route end 38*a* (see FIG. 14A) of the vacuum transport tube route 38 (see FIG. 14A), a route end boundary assembly 170 (see FIG. 14A). The route end boundary assembly 170 (see FIG. 14A) comprises a first route end pressure barrier 172 (see FIG. 14A), a second route end pressure barrier 174 (see FIG. 14A), and a flapper valve 176 (see FIG. 14A).

Disclosed embodiments of the vacuum transport tube vehicle system 10 (see FIGS. 2A, 2B, 16), the vacuum transport tube vehicle 12 (see FIGS. 2A, 2B), and the method 200 (see FIG. 17) provide for one or more vacuum transport tube vehicles 12 (see FIGS. 2A, 2B) that function like a piston inside a vacuum transport tube 16 (see FIG. 2A), and enable the economic and quick evacuation 41 (see FIG. 16), such as an initial evacuation 41*a* (see FIG. 16), of air 40 (see FIGS. 2A, 16), or other fluids, from inside the vacuum transport tube 16 (see FIG. 2A), over the route length 36 (see FIG. 16) of the vacuum transport tube route 38 (see FIG. 16), to eliminate or greatly reduce aerodynamic drag through the vacuum transport tube 16. Using the vacuum transport tube vehicle 12 (see FIGS. 2A, 2B) like a piston inside the cylindrical vacuum transport tube 16 (see FIG. 2A) allows for eliminating the use of commercially available pumping equipment, which may be very costly and may add additional weight to the vehicle. In addition, disclosed embodiments of the vacuum transport tube vehicle system 10 (see FIGS. 2A, 2B, 16), the vacuum transport tube vehicle 12 (see FIGS. 2A, 2B), and the method 200 (see FIG. 17) allow for a reduction in the cost, expense, and time to perform the evacuation 41, such as the initial evacuation 41*a* (see FIG. 16), of air 40 (see FIGS. 2A, 16), or other fluids, from inside the vacuum transport tubes 16 (see FIG. 2A).

Moreover, disclosed embodiments of the vacuum transport tube vehicle system 10 (see FIGS. 2A, 2B, 16), the vacuum transport tube vehicle 12 (see FIGS. 2A, 2B), and the method 200 (see FIG. 17) provide for pump elimination 186 (see FIG. 16) of expensive pumps, seal elimination 188 (see FIG. 16) of expensive seals, such as pressure seals or modular pressure seals, and close tolerance manufacturing elimination 190 (see FIG. 16) of the interface 192 (see FIG. 16) between the inner surface 34*a* (see FIG. 2A) of the vacuum transport tube 16 (see FIG. 2A) and each vacuum transport tube vehicle 12 (see FIG. 2A), as compared to existing vacuum transport tube evacuation systems and methods. The selection of geometry and piston speeds of the vacuum transport tube vehicle 12 (see FIG. 2A) moving or traveling through the vacuum transport tube 16 (see FIG. 2A) eliminate the need for expensive seals or close tolerance manufacturing of the interface 192 (see FIG. 16) between the vacuum transport tube vehicle 12 (see FIG. 2A) and the inner surface 34*a* (see FIG. 2A) of the vacuum transport tube 16 (see FIG. 2A). The orifice 84 (see FIGS. 2B, 2C) allows for the speed 94 (see FIG. 16) at a minimum speed 94*a* (see FIG. 16), or a low-speed regime, to be equal for several vacuum transport tube vehicles 12 (see FIGS. 2A, 3A, 4A).

The vacuum transport tube vehicle 12 (see FIGS. 2A, 2B) disclosed herein does not use a pressure seal to prevent the air 40 (see FIG. 2A) from escaping past the vacuum transport tube vehicle 12, but instead is constructed such that there is a small annular gap 116 (see FIGS. 2B, 2C) that is formed between the vacuum transport tube vehicle 12 (see FIG. 2B) and the inner surface 34*a* (see FIG. 2A) of the vacuum transport tube 16 (see FIG. 2A), when the vacuum transport tube vehicle 12 is installed or positioned within and moves or travels through the interior 32*a* (see FIG. 2A) of the vacuum transport tube 16 (see FIG. 2A). This approach greatly reduces the manufacturing costs, since the vacuum transport tube vehicle 12 that allows an annular gap 116 (see FIG. 2C) having a gap distance 118 (see FIG. 2C) in a range of about 0.25 inch to about 1 inch may be easily manufactured. This gap distance 118 (see FIG. 2C) range provides for close tolerance manufacturing elimination 190 (see FIG. 16), and thus, the manufacturing tolerances of the inner surface 34*a* (see FIG. 2A) of the vacuum transport tube 16 and the vacuum transport tube vehicle 12 (see FIGS. 2A, 2B) that is close to the inner surface 34*a* need not be a high tolerance, and using lower tolerance manufacturing reduces the cost of manufacturing. Further, the maintenance costs may be greatly reduced because there is no seal or wiper to wear out.

In addition, disclosed embodiments of the vacuum transport tube vehicle system 10 (see FIGS. 2A, 2B, 16), the vacuum transport tube vehicle 12 (see FIGS. 2A, 2B), and the method 200 (see FIG. 17) enable a relatively inexpensive vacuum 42 (see FIG. 16) to be created and maintained in vacuum transport tubes 16 (see FIG. 2A, 16), using one or more vacuum transport tube vehicles 12 configured for moving air 40 (see FIGS. 2A, 2B) from a first end 54 (see FIG. 2B) through an orifice 84 (see FIG. 2B) to an opposite end, such as to the second end 66 (see FIG. 2B), or through another side or body orifice in the vacuum transport tube vehicle 12, aft of the first end 54. The orifice 84 (see FIG. 2B, 2C) is preferably variable for fluid control, such as control of air 40 (see FIG. 2A), in achieving speed 94 (see FIG. 16) and power 96 (see FIG. 16) of the vacuum transport tube vehicle 12 (see FIGS. 2A, 2B). As the vacuum transport tube vehicle 12 (see FIGS. 2A, 2B) is propelled in a forward direction of travel 18*a* (see FIG. 2A), it pushes the air 40 (see FIG. 2A) in front of it out of the way, and lets only a small amount of air past it. Thus, a lower pressure results in the aft space 48 (see FIG. 2A) aft of the vacuum transport tube vehicle 12 (see FIGS. 2A-2B) because air 40 is not allowed to flow into the forward space 44 (see FIG. 2A) that has been enlarged by the movement of the vacuum transport tube vehicle 12 (see FIGS. 2A-2B) in the forward direction of travel 18*a* (see FIG. 2A).

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting or exhaustive. Although specific terms are employed herein, they are used in a generic and descriptive sense only and not for purposes of limitation. Any claimed embodiment of the disclosure does not necessarily include all of the embodiments of the disclosure.

What is claimed is:

1. A vacuum transport tube vehicle for evacuating a vacuum transport tube, the vacuum transport tube vehicle comprising:

a first end comprising a piston head, the first end having a first end outer diameter and a first end outer surface, wherein an annular gap is formed between the first end outer surface and an inner surface of the vacuum transport tube, when the vacuum transport tube vehicle is installed in an interior of the vacuum transport tube;

a second end having a second end outer diameter;

a body disposed between the first end and the second end, the body comprising a piston having a structural framework;

at least one orifice extending from a first inlet portion in the first end through to a second outlet portion of the vacuum transport tube vehicle, the second outlet portion positioned aft of the first inlet portion, wherein when the vacuum transport tube vehicle moves through the interior of the vacuum transport tube, air flows through the at least one orifice and the annular gap, and a delta pressure is created between a forward pressure in front of the vacuum transport tube vehicle and an aft pressure behind the vacuum transport tube vehicle, such that the aft pressure is lower than the forward pressure;

a drive assembly coupled to the body for driving the vacuum transport tube vehicle through the vacuum transport tube; and a power system coupled to the drive assembly for powering the drive assembly, wherein the vacuum transport tube vehicle is configured to create a vacuum with a desired pressure in the interior of the vacuum transport tube by causing successive vehicle pass through the vacuum transport tube such that the pressure in the interior of the vacuum transport tube is reduced through each vehicle pass.

2. The vacuum transport tube vehicle of claim 1 wherein the piston head has a forward surface comprising one of, a flat forward surface, and a curved forward surface, including a convex forward surface, and a concave forward surface.

3. The vacuum transport tube vehicle of claim 1 wherein the annular gap has a gap distance in a range of about 0.25 inch to about 1.0 inch between the inner surface of the vacuum transport tube and the first end outer surface of the vacuum transport tube vehicle, when the vacuum transport tube vehicle is installed in the vacuum transport tube.

4. The vacuum transport tube vehicle of claim 1 wherein a length of the second end outer diameter is less than a length of the first end outer diameter.

5. The vacuum transport tube vehicle of claim 1 wherein the structural framework comprises a plurality of stiffened panels, a plurality of longitudinal stiffener members, one or more brace members, one or more cross support members, and one or more circumferential frame members.

6. The vacuum transport tube vehicle of claim 1 wherein the at least one orifice comprises a passageway extending from the first inlet portion in the first end through the body to the second outlet portion formed in the second end of the vacuum transport tube vehicle.

7. The vacuum transport tube vehicle of claim 1 wherein the at least one orifice has an orifice diameter that is variable and that is configurable based on a desired speed and a desired power of the vacuum transport tube vehicle.

8. The vacuum transport tube vehicle of claim 1 wherein the drive assembly comprises a plurality of drive wheels arranged in a circumferential arrangement around the body, the plurality of drive wheels being in contact with the inner surface of the vacuum transport tube, when the vacuum transport tube vehicle moves through the vacuum transport tube.

9. The vacuum transport tube vehicle of claim 8 wherein the power system comprises one or more electric motors coupled to one or more of the plurality of drive wheels.

10. The vacuum transport tube vehicle of claim 1 wherein the drive assembly comprises a magnetic levitation (maglev) propulsion system comprising a plurality of guide magnets and a plurality of vehicle magnets to create both lift and substantially frictionless propulsion to move the vacuum transport tube vehicle through the vacuum transport tube.

11. A vacuum transport tube vehicle system for evacuating a vacuum transport tube, the vacuum transport tube vehicle system comprising:

a vacuum transport tube having an inner surface, an outer surface, and an interior;

one or more vacuum transport tube vehicles configured for moving through the interior of the vacuum transport tube and evacuating air from the interior of the vacuum transport tube over a route length of a vacuum transport tube route, each of the one or more vacuum transport tube vehicles comprising:

a first end comprising a piston head, the first end having a first end outer diameter and a first end outer surface, wherein when each vacuum transport tube vehicle is installed in the vacuum transport tube, an annular gap is formed between the inner surface of the vacuum transport tube and the first end outer surface;

a second end having a second end outer diameter;

a body disposed between the first end and the second end, the body comprising a piston having a structural framework;

at least one orifice extending from a first inlet portion in the first end through to a second outlet portion of the vacuum transport tube vehicle, the second outlet portion positioned aft of the first inlet portion, the at least one orifice configured to allow air to flow from a forward space in front of the vacuum transport tube vehicle to an aft space behind the vacuum transport tube vehicle, to create a delta pressure between a forward pressure in the forward space and an aft pressure in the aft space, such that the aft pressure is lower than the forward pressure;

a drive assembly coupled to the body for driving the vacuum transport tube vehicle through the vacuum transport tube; and a power system coupled to the drive assembly for powering the drive assembly;

wherein the one or more vacuum transport tube vehicles are configured to create a vacuum with a desired pressure in the interior of the vacuum transport tube by causing successive vehicle pass through the vacuum transport tube such that the pressure in the interior of the vacuum transport tube is reduced through each vehicle pass; and one or more pressure barriers positioned in the interior of the vacuum transport tube aft of the one or more vacuum transport tube vehicles.

12. The vacuum transport tube vehicle system of claim 11 further comprising a route end boundary assembly positioned at a route end of the vacuum transport tube route, the route end boundary assembly comprising a first route end pressure barrier, a second route end pressure barrier, and a flapper valve.

13. The vacuum transport tube vehicle system of claim 11 wherein the vacuum transport tube vehicle system comprises an amount of three (3) vacuum transport tube vehicles to twenty (20) vacuum transport tube vehicles, installed in series within the vacuum transport tube.

14. The vacuum transport tube vehicle system of claim 11 wherein the vacuum transport tube vehicle system comprises a multi-stage vehicle arrangement comprising two or more vacuum transport tube vehicles connected together, in series, via one or more connector elements.

15. The vacuum transport tube vehicle system of claim 11 wherein the annular gap has a gap distance in a range of about 0.25 inch to about 1.0 inch between the inner surface of the vacuum transport tube and the first end outer surface at the first end of the vacuum transport tube vehicle, when the vacuum transport tube vehicle is moving through the interior of the vacuum transport tube.

16. The vacuum transport tube vehicle system of claim 11 wherein the drive assembly comprises a plurality of drive wheels arranged in a circumferential arrangement around the body, the plurality of drive wheels being in contact with the inner surface of the vacuum transport tube, when the vacuum transport tube vehicle travels through the vacuum transport tube.

17. The vacuum transport tube vehicle system of claim 16 wherein the power system comprises one or more electric motors coupled to one or more of the plurality of drive wheels.

18. The vacuum transport tube vehicle system of claim 11 wherein the drive assembly comprises a magnetic levitation (mag-lev) propulsion system comprising a plurality of guide magnets and a plurality of vehicle magnets to create both lift and substantially frictionless propulsion to move the one or more vacuum transport tube vehicles through the vacuum transport tube.

19. The vacuum transport tube vehicle system of claim 11 wherein the vacuum transport tube vehicle system provides for pump elimination, seal elimination, and close tolerance manufacturing elimination of an interface between the inner surface of the vacuum transport tube and each vacuum transport tube vehicle, as compared to existing vacuum transport tube evacuation systems.

20. A method for evacuating a vacuum transport tube, the method comprising the steps of:

installing one or more vacuum transport tube vehicles in an interior of the vacuum transport tube, the vacuum transport tube having an inner surface and an outer surface, and each of the one or more vacuum transport tube vehicles comprising:

a first end comprising a piston head, the first end having a first end outer diameter and a first end outer surface, wherein an annular gap is formed between the first end outer surface and the inner surface of the vacuum transport tube;

a second end having a second end outer diameter;

a body disposed between the first end and the second end, the body comprising a piston having a structural framework;

at least one orifice extending from a first inlet portion in the first end through to a second outlet portion of the vacuum transport tube vehicle, the second outlet portion positioned aft of the first inlet portion;

a drive assembly coupled to the body for driving the vacuum transport tube vehicle through the vacuum transport tube; and a power system coupled to the drive assembly for powering the drive assembly;

installing one or more pressure barriers in the interior of the vacuum transport tube aft of the one or more vacuum transport tube vehicles;

moving each vacuum transport tube vehicle through the interior of the vacuum transport tube, and making one or more vehicle passes with each vacuum transport tube vehicle over a route length of a vacuum transport tube route;

flowing air, through the at least one orifice and through the annular gap of each vacuum transport tube vehicle, from a forward space in front of each vacuum transport tube vehicle, to an aft space behind each vacuum transport tube vehicle, to create a delta pressure between a forward pressure in the forward space and an aft pressure in the aft space, such that the aft pressure is lower than the forward pressure; and evacuating air from the vacuum transport tube, and reducing pressure in the interior of the vacuum transport tube with each successive vehicle pass, until a desired pressure is obtained and a vacuum is created in the interior of the vacuum transport tube.

21. The method of claim 20, further comprising the step of installing at a route end of the vacuum transport tube route, a route end boundary assembly comprising a first route end pressure barrier, a second route end pressure barrier, and a flapper valve.

22. The method of claim 20, wherein installing one or more vacuum transport tube vehicles in the interior of the vacuum transport tube comprises installing an amount of three (3) vacuum transport tube vehicles to twenty (20) vacuum transport tube vehicles, in series, in the vacuum transport tube.

23. The method of claim 20, wherein installing one or more vacuum transport tube vehicles in the interior of the vacuum transport tube comprises installing a multi-stage vehicle arrangement comprising two or more vacuum transport tube vehicles connected together in series via one or more connector elements.

24. The method of claim 20, wherein flowing air through the annular gap comprises flowing air through the annular gap having a gap distance in a range of from about 0.25 inch to about 1.0 inch between the inner surface of the vacuum transport tube and the first end outer surface at the first end of the vacuum transport tube vehicle, when the vacuum transport tube vehicle is moving through the interior of the vacuum transport tube.

25. The method of claim 20, wherein moving each vacuum transport tube vehicle through the interior of the vacuum transport tube comprises moving each vacuum transport tube vehicle with the drive assembly comprising one of, a plurality of drive wheels arranged in a circumferential arrangement around the body, or a magnetic levitation (mag-lev) propulsion system comprising a plurality of guide magnets and a plurality of vehicle magnets to create both lift and substantially frictionless propulsion to move each vacuum transport tube vehicle through the vacuum transport tube.

* * * * *